US006584891B1

(12) United States Patent
Smith et al.

(10) Patent No.: US 6,584,891 B1
(45) Date of Patent: Jul. 1, 2003

(54) APPARATUS AND METHODS FOR WIRE-TYING BUNDLES OF OBJECTS

(75) Inventors: Donald Smith, Aberdeen, WA (US); Scott McNeal, Aberdeen, WA (US); Darrell Robinson, Aberdeen, WA (US); David Doyle, Aberdeen, WA (US); Michael Kindsvogel, Aberdeen, WA (US)

(73) Assignee: Enterprises International, Inc., Hoquiam, WA (US)

( * ) Notice: Subject to any disclaimer, the term of this patent is extended or adjusted under 35 U.S.C. 154(b) by 0 days.

(21) Appl. No.: 09/525,988

(22) Filed: Mar. 15, 2000

(51) Int. Cl.[7] ..... B65B 13/04; B65B 13/28

(52) U.S. Cl. ..... 100/26; 100/31; 100/32; 100/29

(58) Field of Search ..... 100/29, 30, 31, 100/32, 27, 25, 26

(56) References Cited

U.S. PATENT DOCUMENTS

| | | | | | |
|---|---|---|---|---|---|
| 2,575,899 | A | | 11/1951 | Vining et al. | 100/31 |
| 3,190,613 | A | | 6/1965 | Embree | 254/51 |
| 3,196,799 | A | | 7/1965 | Embree | 100/4 |
| 3,447,448 | A | | 6/1969 | Pasic | 100/4 |
| 3,735,555 | A | | 5/1973 | Pasic | 53/124 D |
| 3,884,139 | A | | 5/1975 | Pasic | 100/26 |
| 3,889,584 | A | | 6/1975 | Wiklund | 100/26 |
| 3,929,063 | A | | 12/1975 | Stromberg et al. | 100/26 |
| 4,106,403 | A | * | 8/1978 | Sutehall | 100/25 |
| 4,252,157 | A | | 2/1981 | Ohnishi | 140/93 |
| 4,450,763 | A | | 5/1984 | Saylor | 100/31 |
| 4,498,379 | A | | 2/1985 | Saylor | 100/2 |
| 4,577,554 | A | * | 3/1986 | Brouse | 100/26 |
| 4,912,912 | A | * | 4/1990 | Tagomori | 53/589 |
| 5,027,701 | A | * | 7/1991 | Izui et al. | 100/26 |
| 5,031,523 | A | * | 7/1991 | Poloni | 100/25 |
| 5,146,847 | A | * | 9/1992 | Lyon et al. | 100/2 |
| 5,613,432 | A | * | 3/1997 | Hoshino | 100/26 |
| 5,746,120 | A | * | 5/1998 | Jonsson | 100/4 |

FOREIGN PATENT DOCUMENTS

| | | | |
|---|---|---|---|
| DE | 456 146 | * | 2/1928 |
| DE | 296 12 531 U1 | * | 9/1996 |

OTHER PUBLICATIONS

Plastic Extruders Limited—Ancillaries Price List Jan. 1, 1993.

* cited by examiner

*Primary Examiner*—Rinaldi I. Rada
*Assistant Examiner*—Gloria R Weeks
(74) *Attorney, Agent, or Firm*—Seed IP Law Group PLLC

(57) ABSTRACT

Apparatus and methods for wire-tying one or more objects. A wire accumulating and feeding mechanism feeds the wire axially through the hollow axle of an accumulator drum and then out to a drive wheel. The wire is wrapped around the periphery of the drum to accumulate the wire during tensioning. A wire gripping mechanism is a simple, economical device including a gripper block having a wire receptacle formed therein, an opposing wall positioned proximate the wire receptacle, and in one embodiment a tapered gap formed in the gripper block proximate the wire receptacle and opposite from the opposing wall, and a gripper disc mounts in a gripper release lever constrained to move within the tapered gap and frictionally engageable with the length of wire disposed within the wire receptacle, the gripper disc being driven into the tapered gap by frictional engagement with the length of wire and pinching the length of wire against the opposing wall when the drive motor is operated in the tension direction. In an alternative embodiment the gripper release lever pinches the wire against the gripping wall. In another embodiment, an apparatus includes a track assembly including multiple modular segments forming a corner of the track. In yet another aspect, a twisting assembly includes a twist motor coupled to a rotatable twist axle having a plurality of cams attached thereto, the primary functions of the twisting assembly being cam-actuated.

16 Claims, 41 Drawing Sheets

Wire feeding from external source

Insertion of wire from external source (b) Wire accumulation onto drum at 225 degrees of rotation (a) Initiation of tension cycle.

(c) Wire accumulation onto drum at 2 drum revolutions (b) Wire feeding from drum accumulation at 225 degrees (a) Wire feeding from drum accumulation at 2 revolutions (c) Return to feed from external wire source.

Cross-section through drum, hub, and axle illustrating feed path through axle

Insertion of wire from external source.

Wire feeding from external source.

Wire accumulation onto drum at 225 degrees of rotation.

Initiation of tension cycle.

Wire accumulation onto drum at 2 drum revolutions.

Wire feeding from drum accumulation at 225 degrees.

Wire feeding from drum accumulation at 2 revolutions

Return to feed from external wire source.

APPARATUS AND METHODS FOR WIRE-TYING BUNDLES OF OBJECTS

TECHNICAL FIELD

This invention relates to apparatus and methods for wire-tying one or more objects, including, for example, wood products, newspapers, magazines, pulp bales, waste paper bales, rag bales, pipe, or other mechanical elements.

BACKGROUND OF THE INVENTION

A variety of automatic wire-tying machines have been developed, such as those disclosed in U.S. Pat. No. 5,027,701 issued to Izui and Hara, U.S. Pat. No. 3,889,584 issued to Wiklund, U.S. Pat. No. 3,929,063 issued to Stromberg and Lindberg, U.S. Pat. No. 4,252,157 issued to Ohnishi, and U.S. Pat. No. 5,746,120 issued to Jonsson. The wire-tying machines disclosed by these references typically include a track that surrounds a bundling station where a bundle of objects may be positioned, a feed assembly for feeding a length of wire about the track, a gripping assembly for securing a free end of the length of wire after it has been fed about the track, a tensioning assembly for pulling the length of wire tightly about the bundle of objects, a twisting assembly for tying or otherwise coupling the length of wire to form a wire loop around the bundle of objects, a cutting assembly for cutting the length of wire from a wire supply, and an ejector for ejecting the wire loop from the machine.

One drawback to conventional wire-tying machines is their complexity. For example, a variety of elaborate hydraulically-driven, or pneumatically-driven actuation systems are commonly used for performing such functions as securing the free end of the length of wire, for cutting the length of wire from the wire supply, and for ejecting the wire loop from the machine. Track assemblies also typically require some type of spring-loaded hydraulic or pneumatic system to actuate the track between a closed position for feeding the wire about the track, and an open position for tensioning the wire about the bundle of objects.

Such hydraulic or pneumatic actuation systems require relatively expensive cylinder and piston actuators, pressurized lines, pumps, valves, and fluid storage facilities. These components not only add to the initial cost of the wire-tying machine, but also require considerable maintenance. The handling, storage, disposal, and cleanup of fluids used in typical hydraulic systems also presents issues related to safety and environmental regulations.

SUMMARY OF THE INVENTION

This invention relates to improved apparatus and methods for wire-tying one or more objects. In one aspect of the invention, an apparatus includes a track assembly, a feed and tension assembly, and a twister assembly having a gripping mechanism engageable with the length of wire, a twisting mechanism including a twisting motor operatively coupled to a twist pinion engageable with the length of wire, the twist pinion being rotatable to twist a portion of the length of wire to form a knot, a cutting mechanism engageable with the length of wire proximate the knot, and an ejecting mechanism engageable with the length of wire to disengage the length of wire from the twister assembly. The gripping mechanism includes a gripper block having a wire receptacle formed therein, an opposing wall positioned proximate the wire receptacle, and a gripper disc constrained to move toward the opposing wall to frictionally engage with the length of wire disposed within the wire receptacle, the gripper disc being driven into frictional engagement with the length of wire and pinching the length of wire against the opposing wall when the drive motor is operated in the tension direction. Thus, the wire is secured using a simple, passive, economical, and easily maintained gripping mechanism.

While a combination of various subcombination assemblies combine to make this overall wire-tying apparatus and method, several of the sub-assemblies are themselves unique and may be employed in other wire tying apparatus and methods. Thus, the invention is not limited to only one combination apparatus and method.

For example, a unique passive wire gripping subassembly includes a wire receptacle having a slot sized to receive a first passage of wire in one portion thereof and a second passage of wire in another portion thereof, a passive gripper disk being frictionally engageable with the second passage of wire to hold the free end of the wire.

In the twister assembly, the assembly includes a multi-purpose cam rotatably driven by the twister motor, and the gripping mechanism includes a gripper release engageable with the gripper disk and actuatable by the multi-purpose cam.

A unique feature of the track assembly includes multiple ceramic or high hardness steel sections or segments disposed proximate to a corner guide at the corners of the track assembly, the sections each having a curved face at least partially surrounding the wire guide path to redirect the motion of the length of wire about the corners. The sections resist gouging from the relatively sharp free end of the length of wire as it is guided along the wire path, reducing mis-feeds, improving reliability, and enhancing durability of the apparatus. The sections are less expensive to manufacture for replacement and, by adding more sections to larger corner guides, the corner radius of the wire path may be increased with little cost increase.

In one aspect of the invention, an apparatus includes a track assembly, a feed and tension assembly, and a twister assembly having a twist motor coupled to a rotatable twist axle having a first multi-purpose cam, an ejector cam, a drive gear, and a second multi-purpose cam attached thereto, a gripping mechanism engageable with the length of wire and having a gripper cam follower engageable with the second multi-purpose cam, the gripping mechanism being actuatable by the second multi-purpose cam, a twisting mechanism having a twist pinion engageable with the length of wire, the twist pinion being actuatable by the drive gear and rotatable to twist a portion of the length of wire to form a knot, a cutting mechanism engageable with the length of wire proximate the knot and having a cutting cam follower engageable with the first multi-purpose cam, the cutting mechanism being actuatable by the first multi-purpose cam; and an ejecting mechanism engageable with the length of wire to disengage the length of wire from the twister assembly and having an ejecting cam follower engageable with the ejector cam, the ejecting mechanism being actuatable by the ejector cam. Thus, the primary functions of the twisting assembly are cam-actuated, eliminating more expensive and complex actuating mechanisms, and improving the economy of the apparatus.

Another aspect of the invention is a unique wire accumulation drum through which the length of wire is axially fed and from which the length of wire tangentially exits at its periphery to be engaged by a drive wheel. The accumulator drum is shown in alternative forms.

Another aspect of the invention is a unique feed and tension assembly pulling wire axially through a drum, then tangentially off the drum to a feed drive wheel and then back onto the periphery of the drum when tensioning the wire. Alternative forms are shown.

Another aspect of the invention is a simple shaft driven drive for twisting the wire, gripping the wire, releasing the twisted wire, and cutting the wire.

Another aspect of the invention is a passive wire gripper that uses the friction of the wire to cause the wire free end to be squeezed and held against movement out of the twister mechanism. The passive wire gripper has several alternative forms.

These and other benefits of the present invention will become apparent to those skilled in the art based on the following detailed description.

BRIEF DESCRIPTION OF THE DRAWINGS

FIGS. 4-1 through 4-8 are schematic operational views of one embodiment of the feed and tension assembly.

FIGS. 4A-1 through 4A-9 are schematic operational schematics of the embodiment of FIG. 4A.

FIG. 5 is an exploded isometric view of an accumulator of the feed and tension assembly of FIG. 4.

FIG. 6 is an exploded isometric view of a drive unit of the feed and tension assembly of FIG. 4.

FIG. 7 is an exploded isometric view of a stop block of the feed and tension assembly of FIG. 4.

FIG. 8 is an isometric view of a wire feed path of the feed and tension assembly of FIG. 4.

FIG. 9 is an isometric view of a twister assembly of the wire-tying machine of FIG. 1.

In the drawings, identical reference numbers identify identical or substantially similar elements or steps.

DETAILED DESCRIPTION OF THE INVENTION

The present disclosure is directed toward apparatus and methods for wire-tying bundles of objects. Specific details of certain embodiments of the invention are set forth in the following description, and in FIGS. 1–25, to provide a thorough understanding of such embodiments. A person of ordinary skill in the art, however, will understand that the present invention may have additional embodiments, and that the invention may be practiced without several of the details described in the following description.

Figure 1:
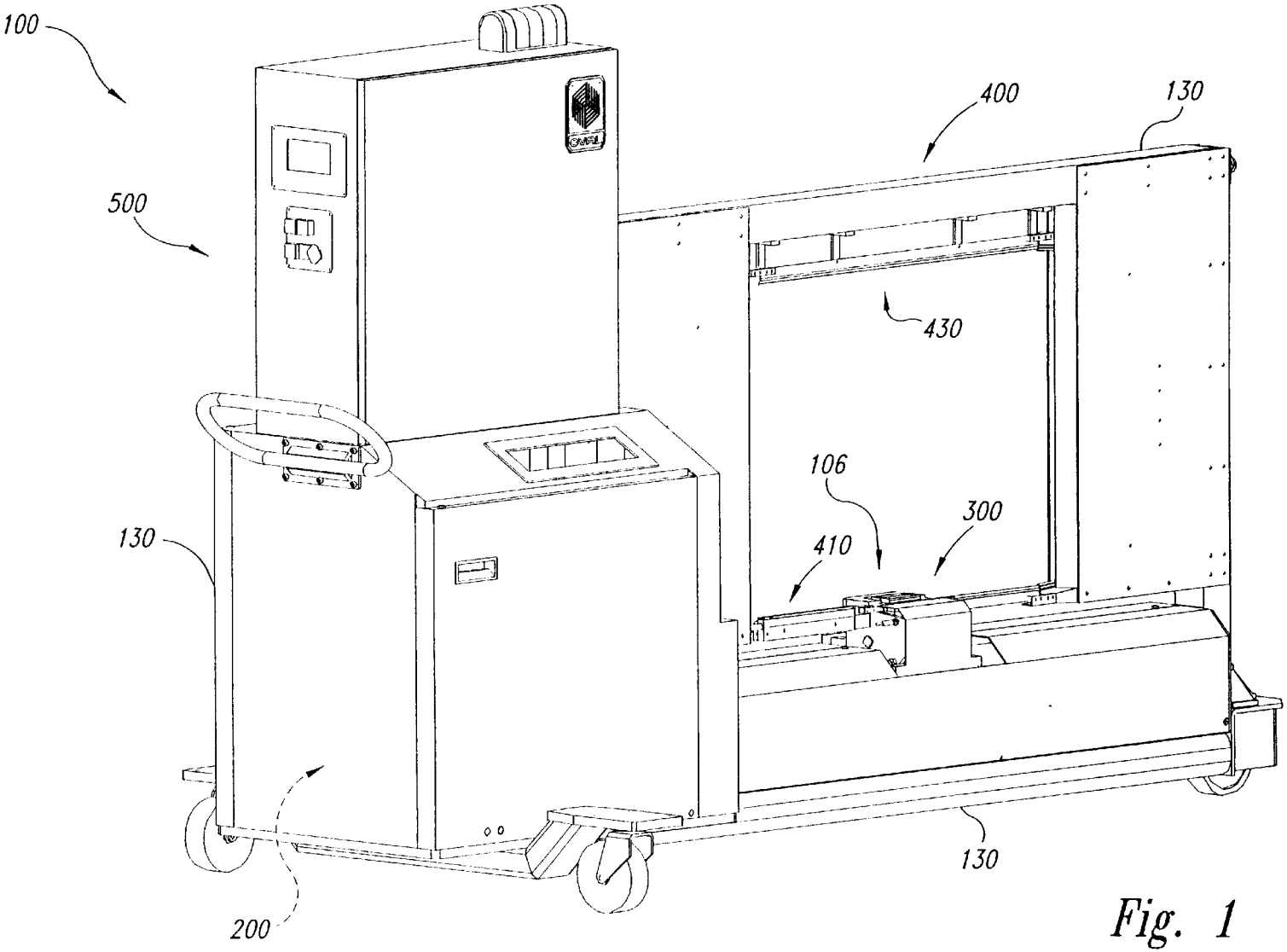
FIG. 1 is a front isometric view of a wire-tying machine in accordance with the invention.
Figure 2:
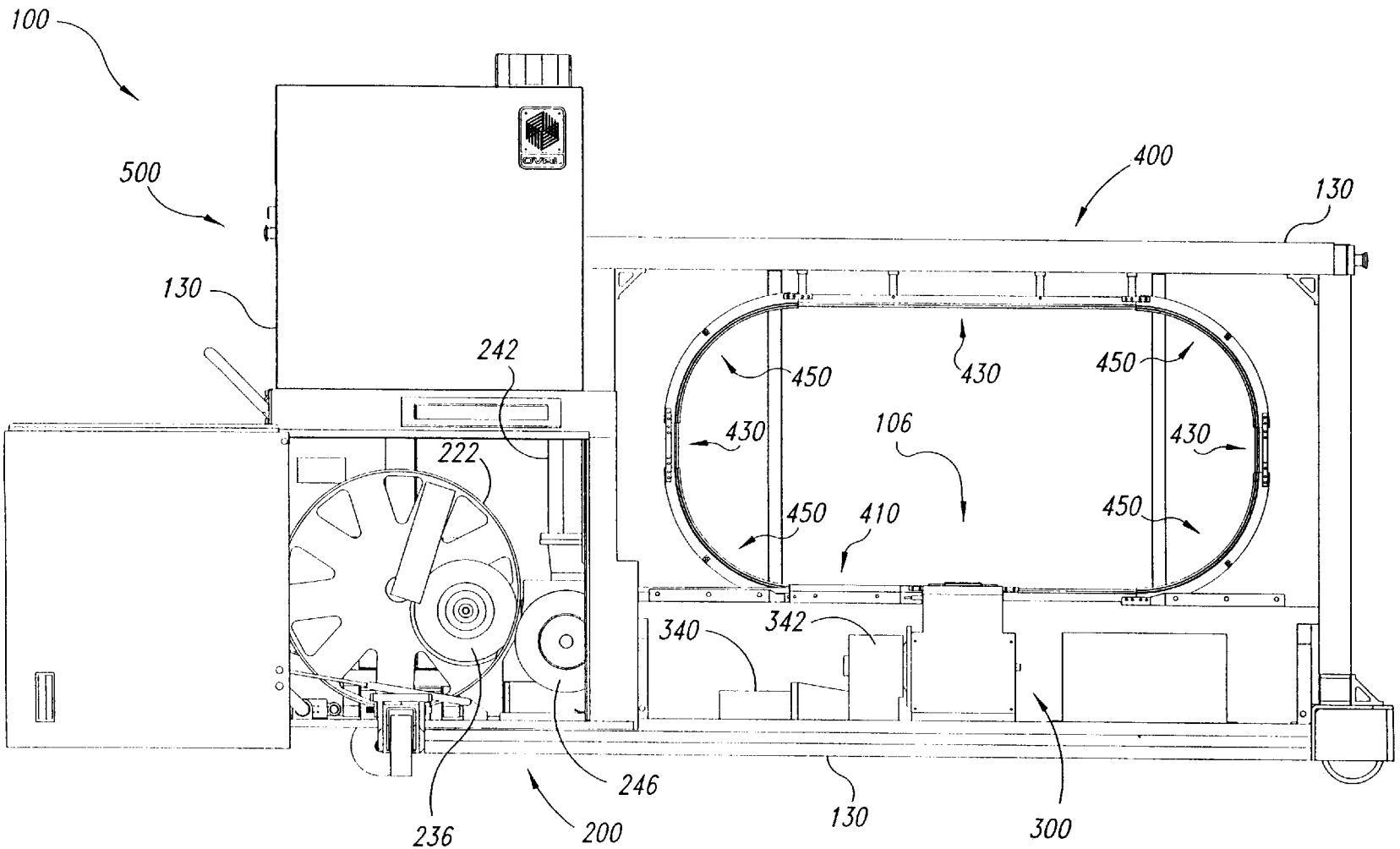
FIG. 2 is a front elevational view of the wire-tying machine of FIG. 1.
Figure 3:
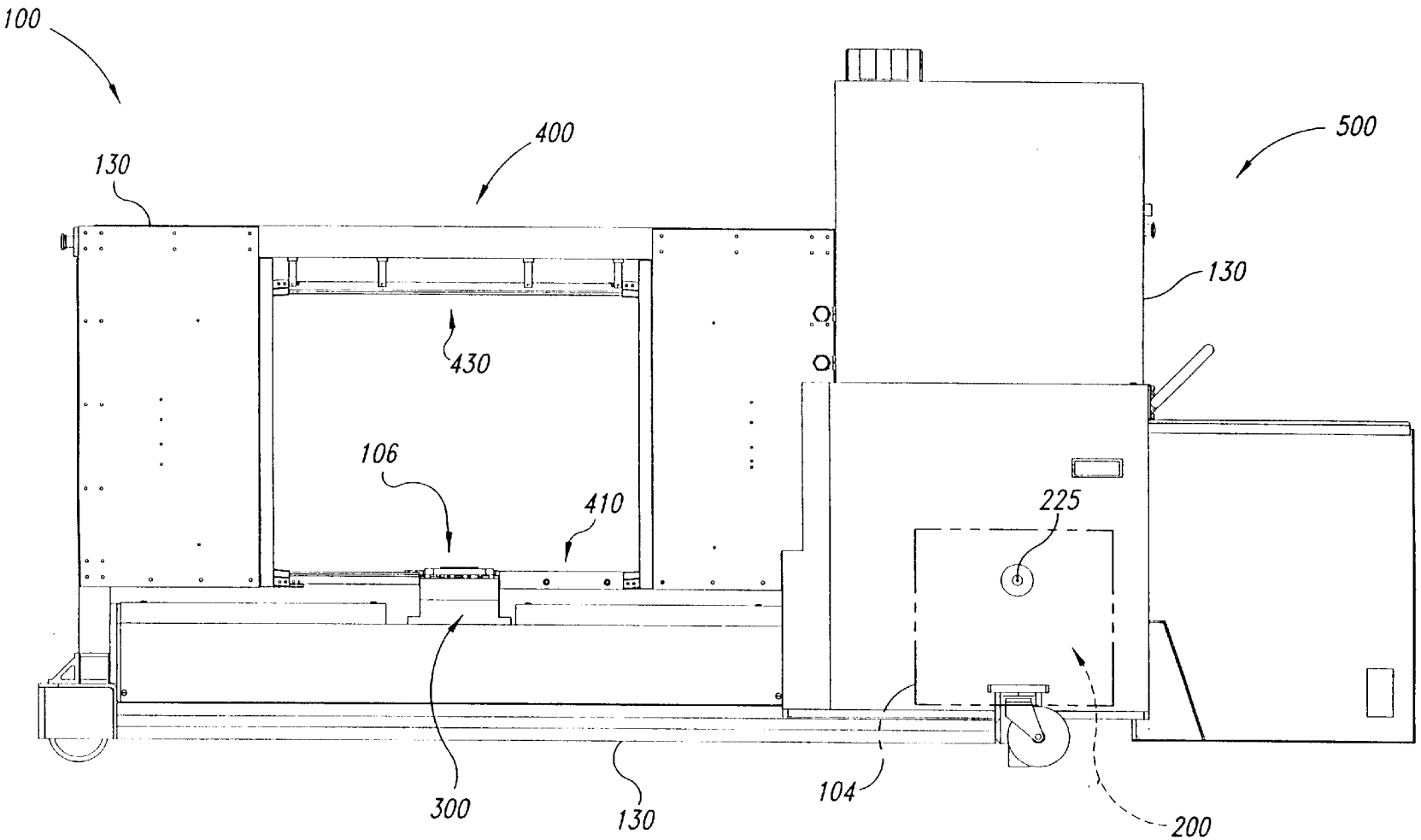
FIG. 3 is a back elevational view of the wire-tying machine of FIG. 1.

FIG. 1 is a front isometric view of a wire-tying machine 100 in accordance with an embodiment of the invention. FIGS. 2 and 3 are front partial sectional and back elevational views, respectively, of the wire-tying machine 100 of FIG. 1. The wire-tying machine 100 has several major assemblies, including a feed and tension assembly 200, a twister assembly 300, a track assembly 400, and a control system 500. The wire-tying machine 100 includes a housing 130 that structurally supports and/or encloses the major subassemblies of the machine.

In brief, the overall operation of the wire-tying machine 100 begins with the feed and tension assembly 200 drawing a length of wire 102 from an external wire supply 104 (e.g., a spool or reel, not shown) into the wire-tying machine 100 past the ring sensor 412. The length of wire 102 is then fed by depressing a manual feed button switch actuator, whereupon, the free end of the length of wire 102 is pushed through the twister assembly 300, into and about the track assembly 400, and back into the twister assembly 300. The track assembly 400 forms a wire guide path 402 that substantially surrounds a bundling station 106 where one or more objects may be positioned for bundling.

Once the length of wire 102 has been completely fed about wire path 402, manual or automatic operation is possible. The control system 500 signals the feed and tension assembly 200 to tension the length of wire 102 about the one or more objects. During a tension cycle, the feed and tension assembly 200 pulls the length of wire 102 in a direction opposite the feed direction. The track assembly 400 opens releasing the length of wire 102 from the wire guide path 402, allowing the length of wire 102 to be drawn tightly about the one or more objects within the bundling station 106. An excess length of wire 114 is retracted back into the feed and tension assembly 200 and accumulated about the accumulator drum 222 until the control system 500 signals the feed and tension assembly 200 to stop tensioning, as described more fully below.

After the tension cycle is complete, (the free end 108 of the length of wire 102, having been securely retained by the gripper subassembly 320 of the twister assembly 300 during the tension cycle) the twister assembly 300 joins the free end 108 of the length of wire 102*b* to an adjacent portion of the length of wire 102*a* forming a fixed constricting wire loop 116 about the one or more objects forming a bundle 120. The wire loop 116 is secured by twisting the free end of the length of wire 102*b* and the adjacent portion of the length of wire 102*a* about one another to form a knot 118. The twister assembly 300 then severs the knot 118, and the formed wire loop 116, from the length of wire 102. The twister assembly 300 then ejects the knot 118 and returns all components of the twister assembly 300 to the home position. A feed cycle is subsequently initiated, at which time, the bundle 120 may be removed from the bundling station 106. All succeeding feed cycles will thus re-feed any accumulated wire 102 from about the accumulator drum 222 prior to again drawing sufficient added wire 102 from the external wire source 104 (not shown) to complete said feed cycles, until the external wire source 104 has been depleted and the load cycle must be repeated. At the completion of any feed cycle the overall sequence of cycles may be re-initiated.

Generally, there are five operational cycles utilized by the wire-tying machine 100: the load cycle, the feed cycle, the tension cycle, the twist cycle, and the wire reject cycle. The wire tying machine 100 may be operated in a manual mode or in an automatic mode. The feed, tension, and twist cycles normally operate in the automatic mode, but may be operated in the manual mode, for example, for maintenance and clearing wire from the machine. These cycles may also overlap at various points in the operation. The load and wire reject cycles are usually operated in the manual mode only. The five operational cycles and the two operating modes of the wire-tying machine 100 are described in greater detail below.

Figure 4:
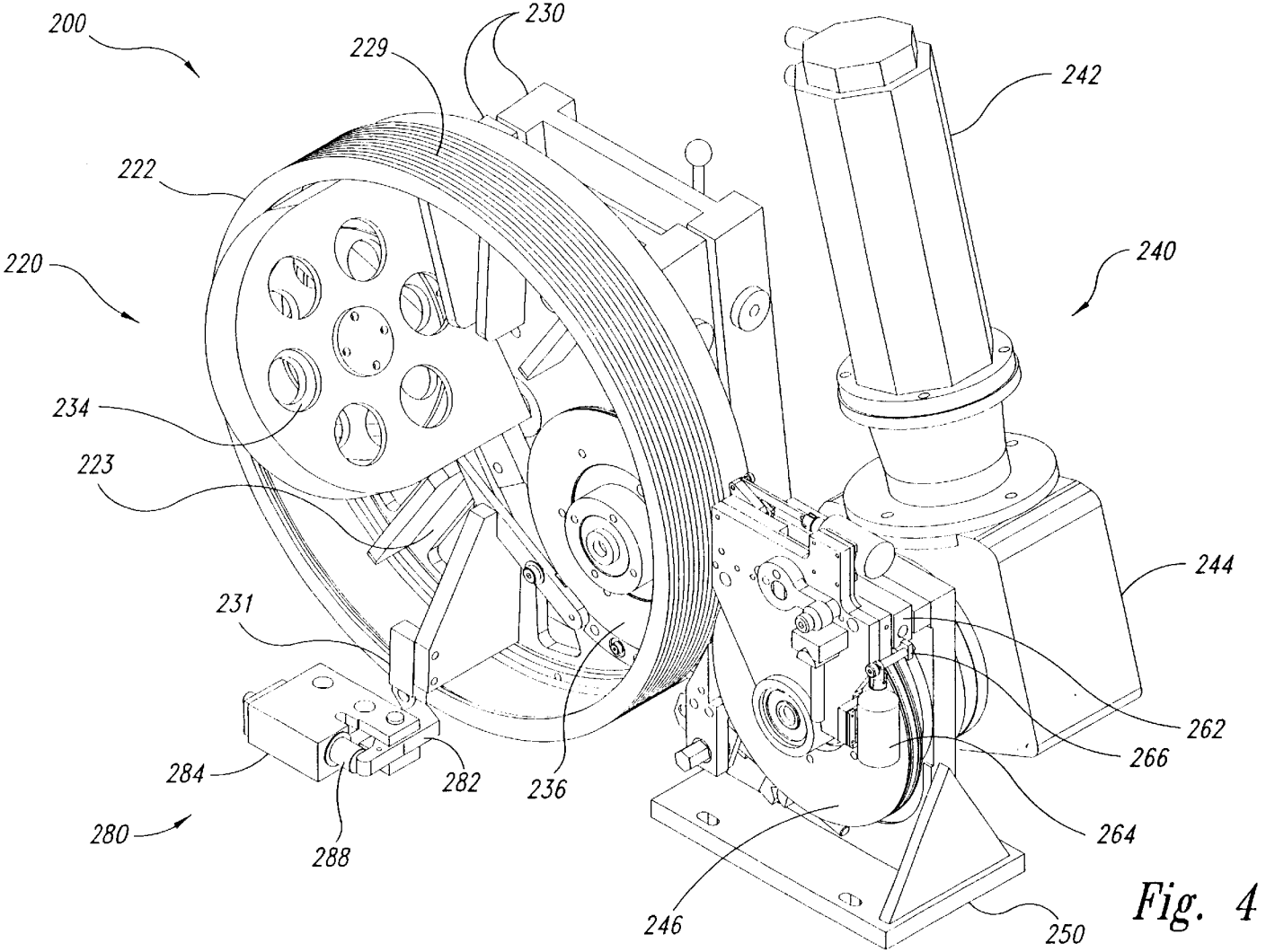
FIG. 4 is a front isometric view of a feed and tension assembly of the wire-tying machine of FIG. 1.
Figures 2, 4:
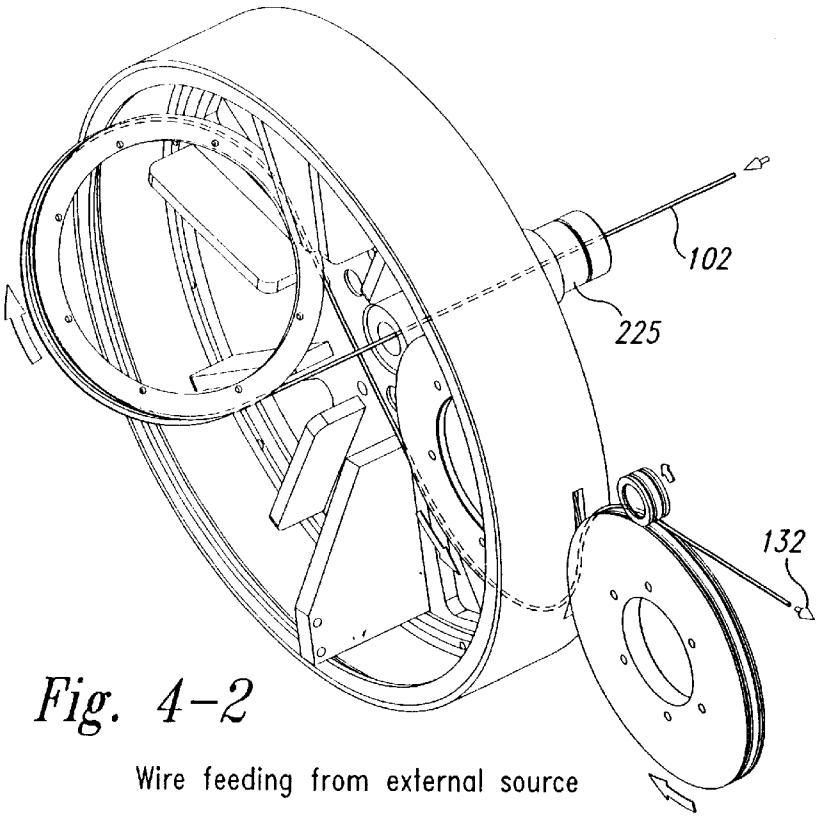
Figures 1, 4:
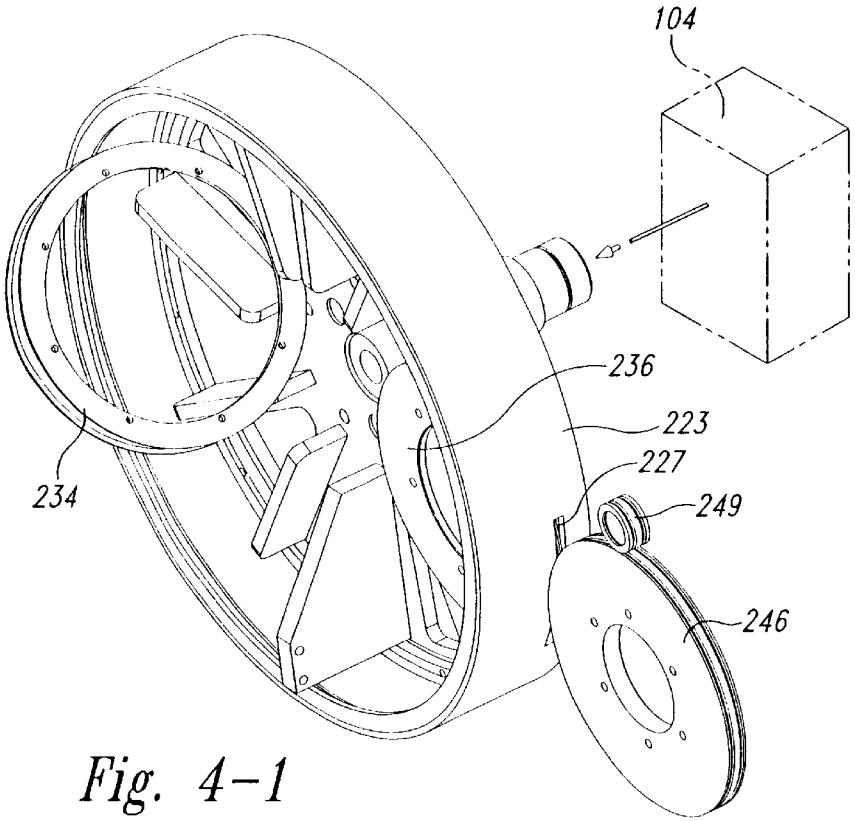
Figure 4:
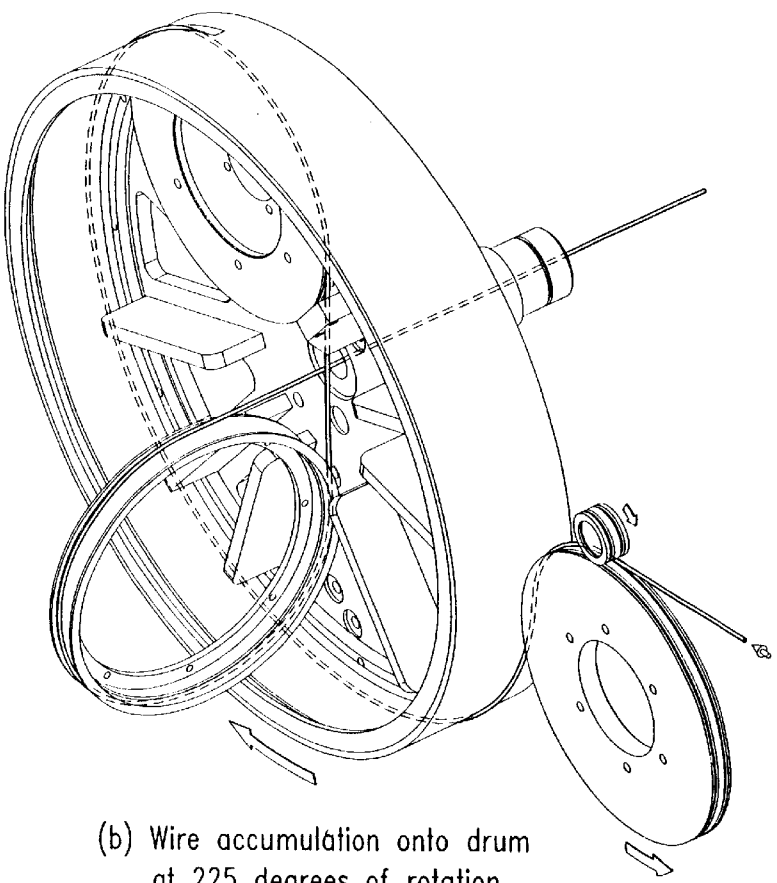
Figures 3, 4:
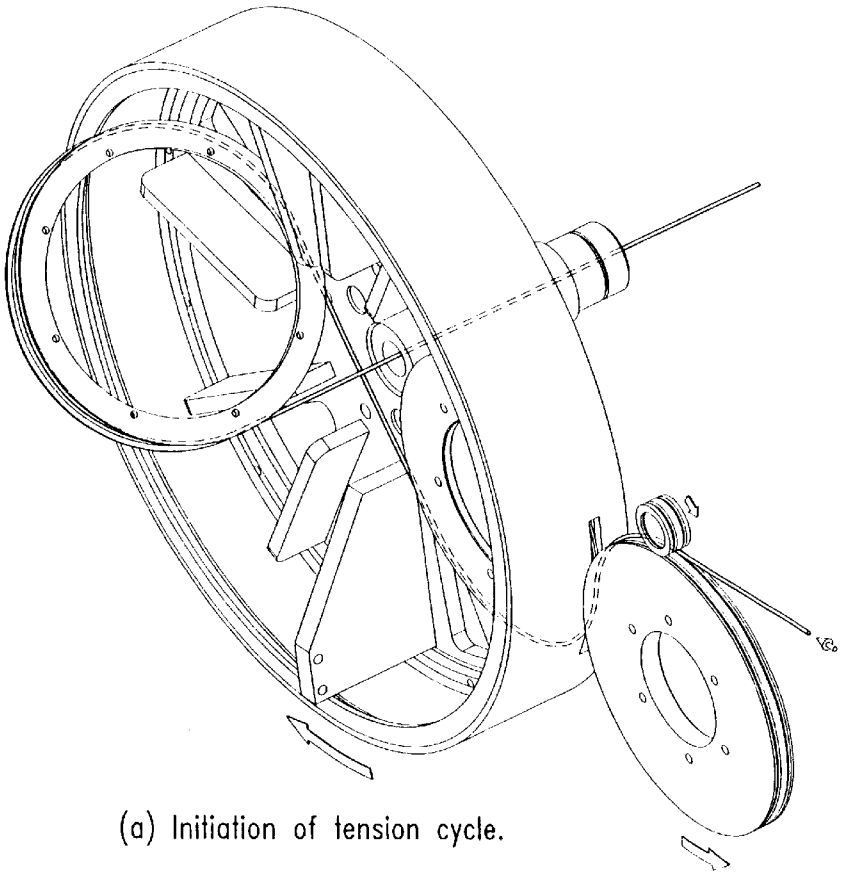

FIG. 4 is a front isometric view of the feed and tension assembly 200 of the wire-tying machine 100 of FIG. 1. As shown in FIG. 4 the feed and tension assembly 200 includes an accumulator subassembly 220, a drive subassembly 240, and a stop block subassembly 280. The accumulator subassembly 220 provides greater capacity than that necessary to accumulate all of the length of wire 102 fed into the largest wire-tying machine currently envisioned. The drive subassembly 240 provides the driving force requisite for feeding and tensioning the length of wire 102. Further, the interaction between the accumulator subassembly 220 and the drive subassembly 240 produce a compressive impingement upon the length of wire 102 which efficiently transfers the driving force frictionally into the length of wire 102. The stop block subassembly 260 indexes the accumulator subassembly 220 in its neutral home position and damps the motion of the accumulator drum 222 at the transition between feeding the length of wire 102 from the accumulator drum 222 to feeding the length of wire 102 from the external wire source 104. In some instances of the feed and tension assembly 200, the stop block subassembly 280 may be incorporated into the accumulator subassembly 220 and the drive subassembly 240, as shown in FIG. 4A.

Figures 4, 5:
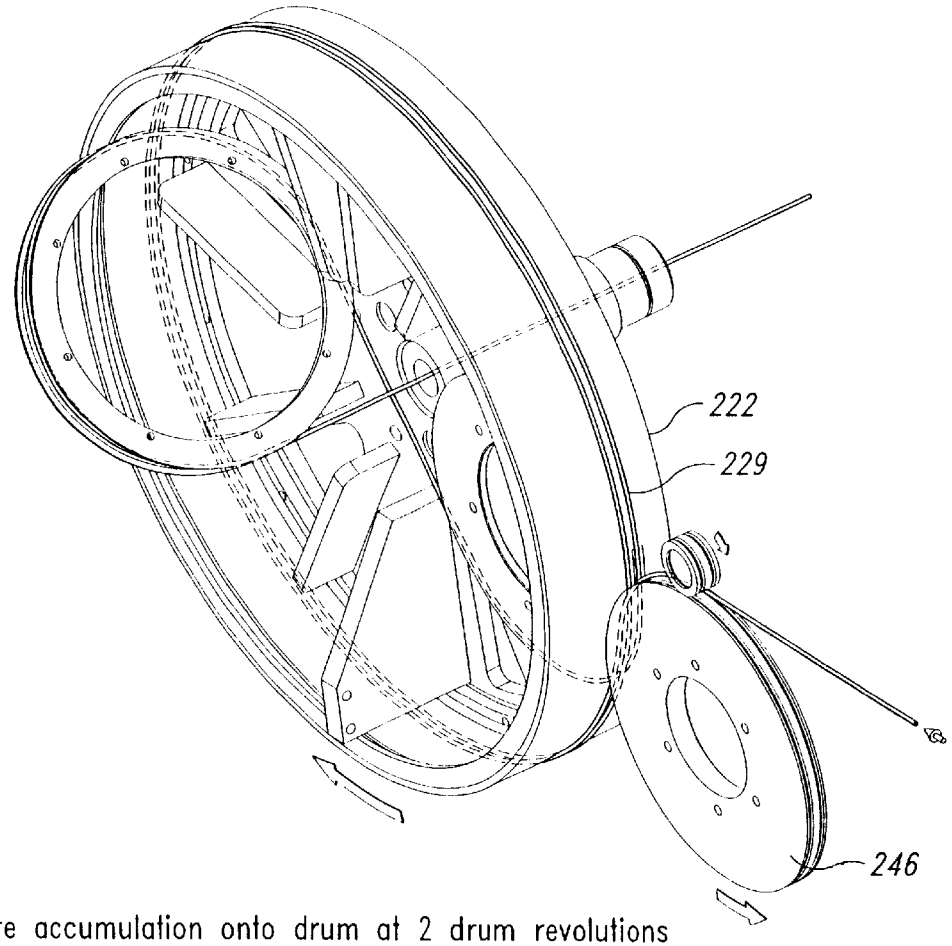
Figures 4, 5, 6, 7:
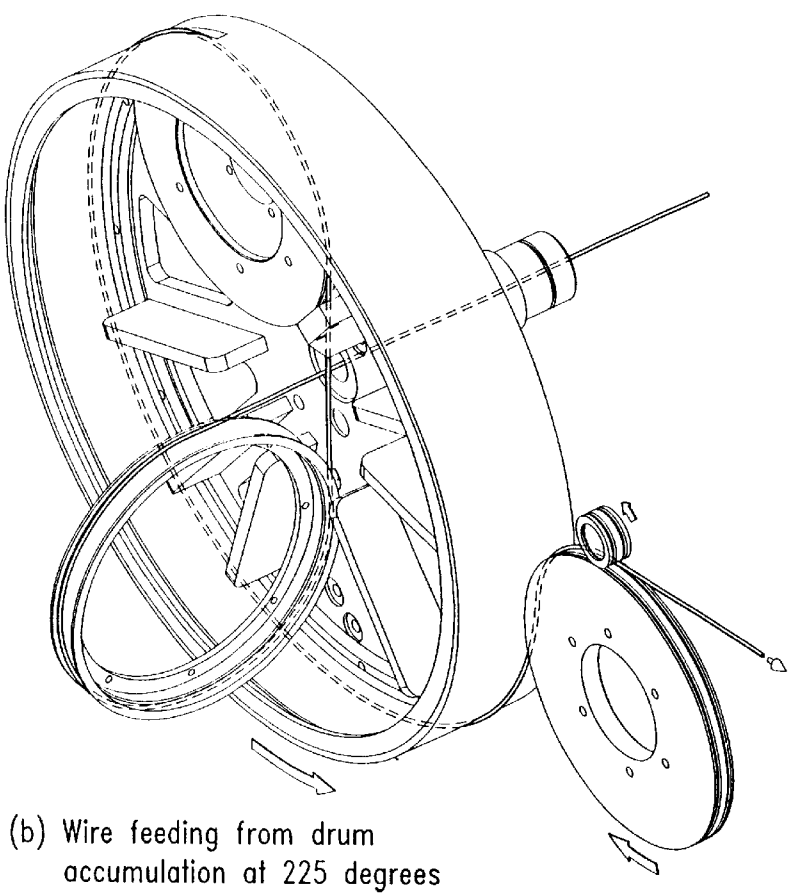
Figures 4, 5, 6:
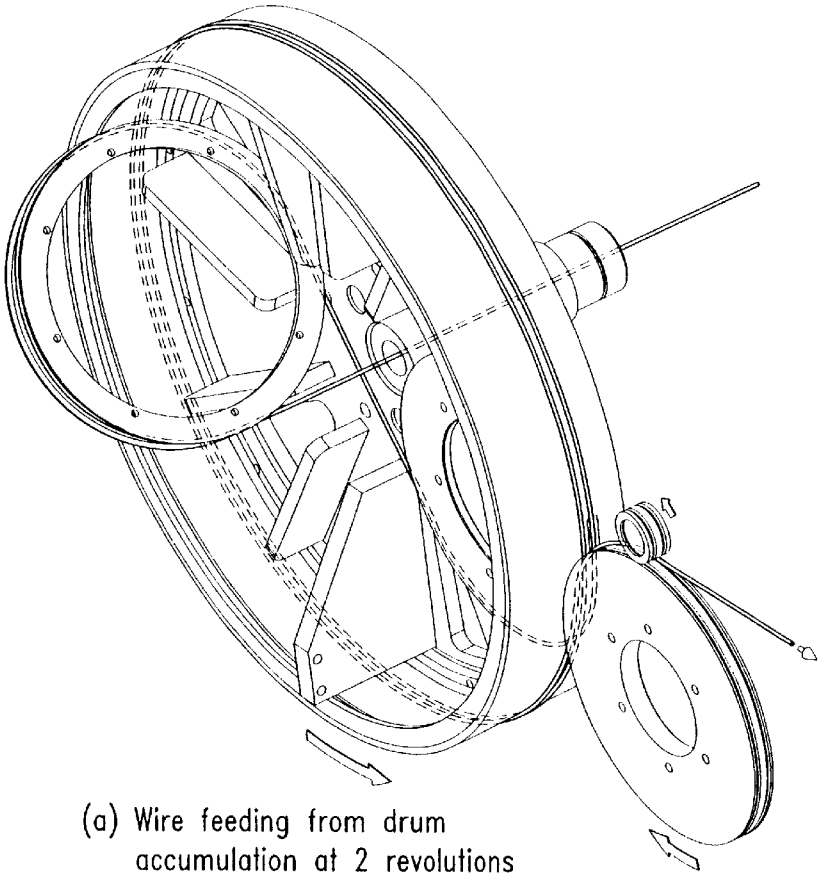
Figures 4, 5, 6, 7, 8:
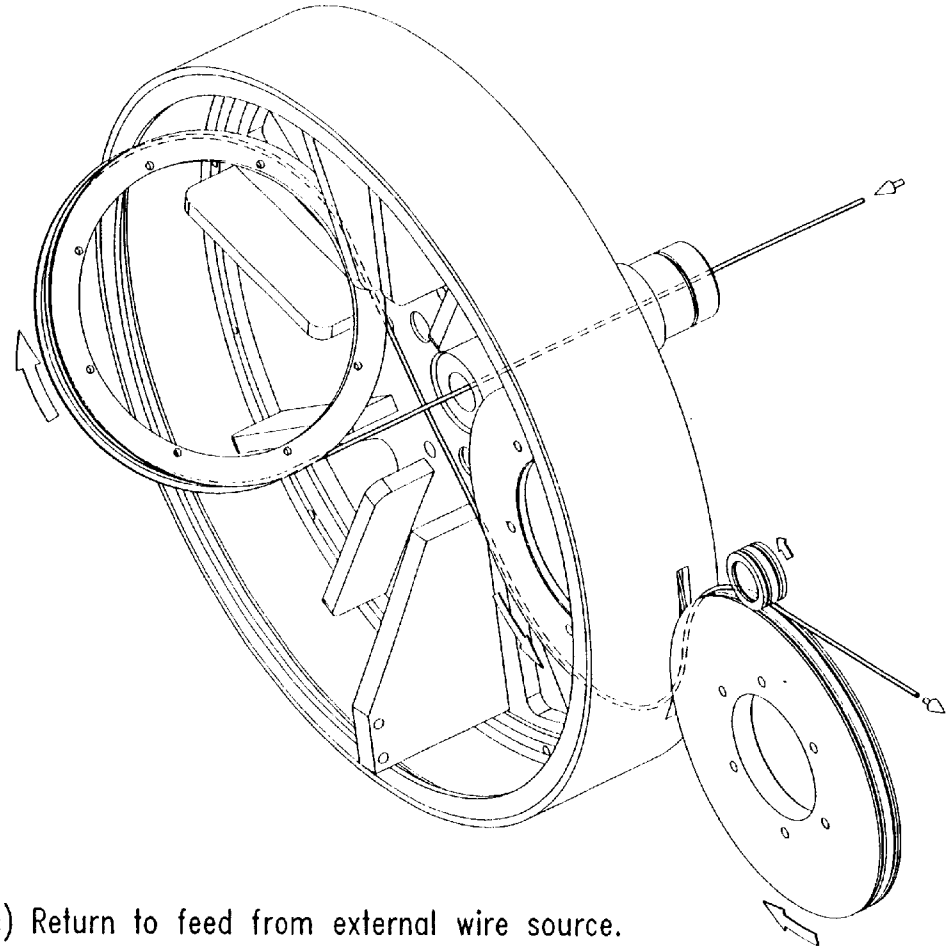
Figure 4A:
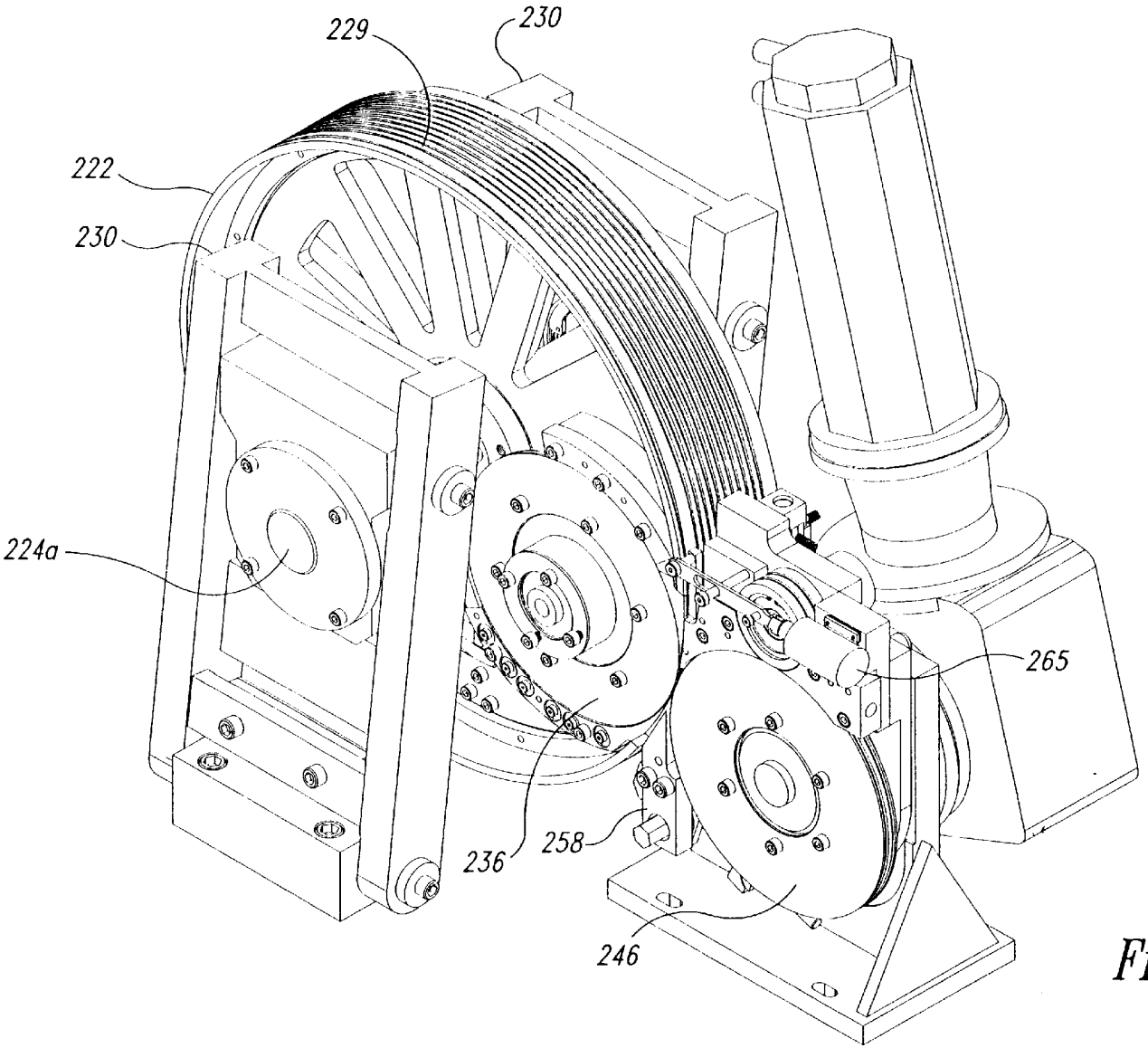
FIG. 4A is an alternative form of feed and tension assembly.
Figures 2, 4A:
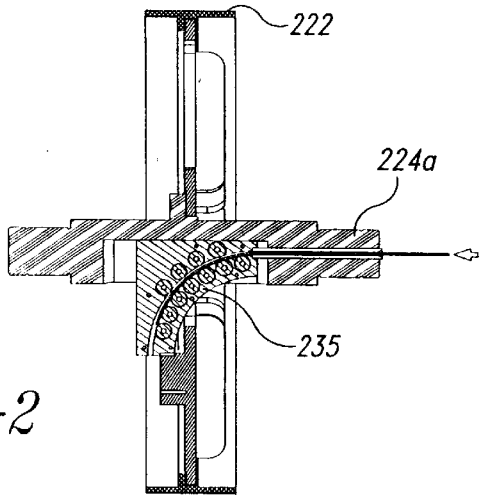
Figures 1, 4A:
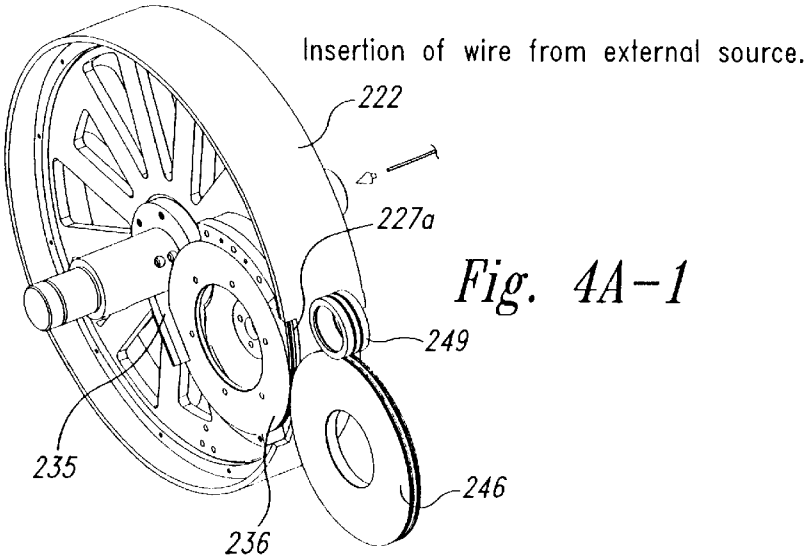
Figures 3, 4A:
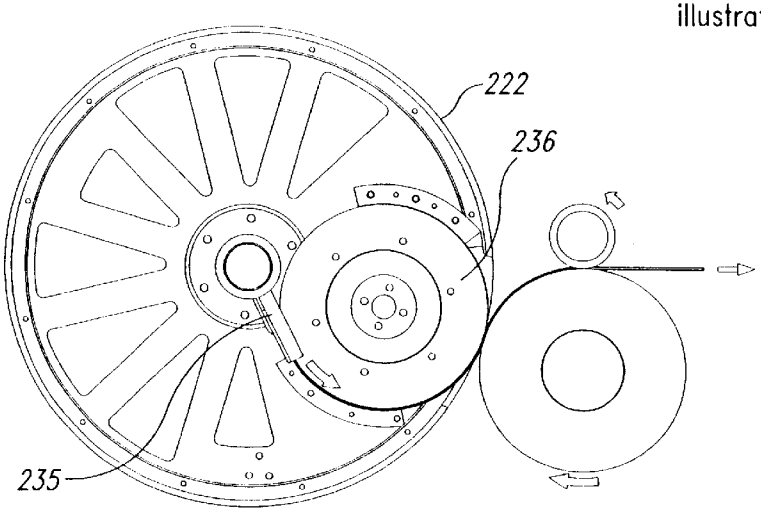
Figures 4, 4A, 5:
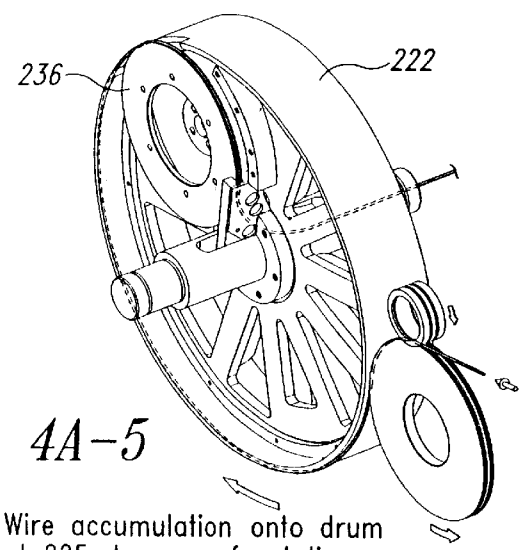
Figures 4, 4A:
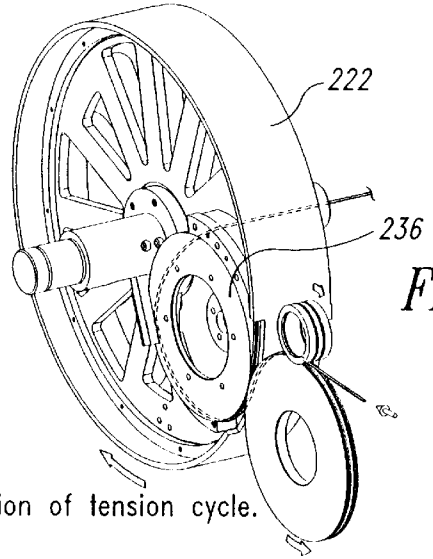
Figures 4, 4A, 5, 6:
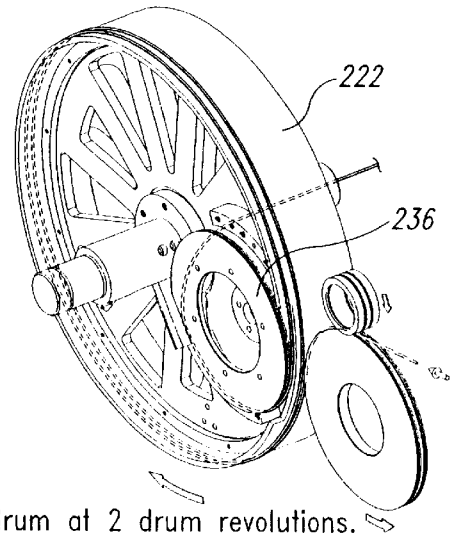
Figures 4, 4A, 5, 6, 7, 8:
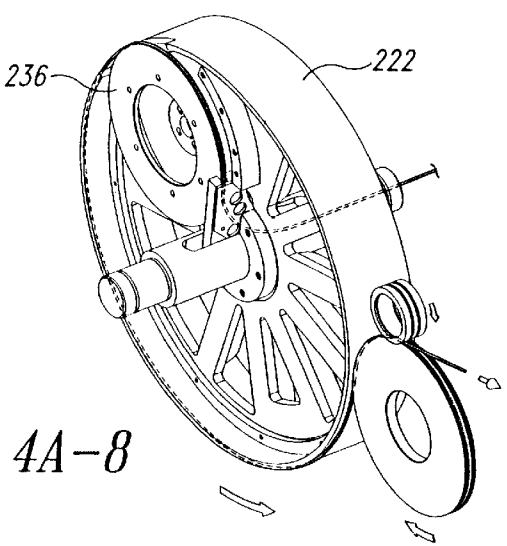
Figures 4, 4A, 5, 6, 7:
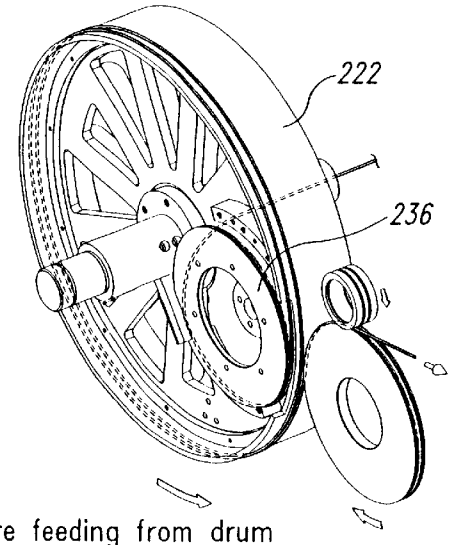

FIG. 5 is an exploded isometric view of the accumulator subassembly 220 of the feed and tension assembly 200 of FIG. 4. FIG. 6 is an exploded isometric view of the drive assembly 240 of the feed and tension assembly 200 of FIG. 4. FIG. 7 is an exploded isometric view of the stop block subassembly 280 of the feed and tension assembly 200 of FIG. 4. FIG. 8 is an isometric view of a wire feed path 202 of the feed and tension assembly 200 of FIG. 4.

As best seen in FIGS. 4, 5 and 8, the accumulator subassembly 200 includes an accumulator drum 222 mounted on an accumulator hub 223 that is concentrically supported on an accumulator axle 224. A wire inlet tube 225 is disposed through the center of the accumulator axle 224, and a wire passage 227 is disposed in the accumulator drum 222. Thus, as can be seen the wire enters the drum axially. Also, a continuous helical groove 229 is disposed within an outer surface of the accumulator drum 222, and a stop finger 231 is attached to a lateral edge of the accumulator drum 222.

A bearing block 226 houses a pair of accumulator bearings 228 that rotatably support the accumulator axle 224 in cantilevered fashion. A pair of supports 230 are pivotably coupled to the bearing block 226 and to a mounting plate 232 that is secured to the housing 130, allowing the accumulator drum 222 to move laterally (side-to-side) within the housing 130 during the feeding and tensioning of the length of wire 102.

Figure 5:
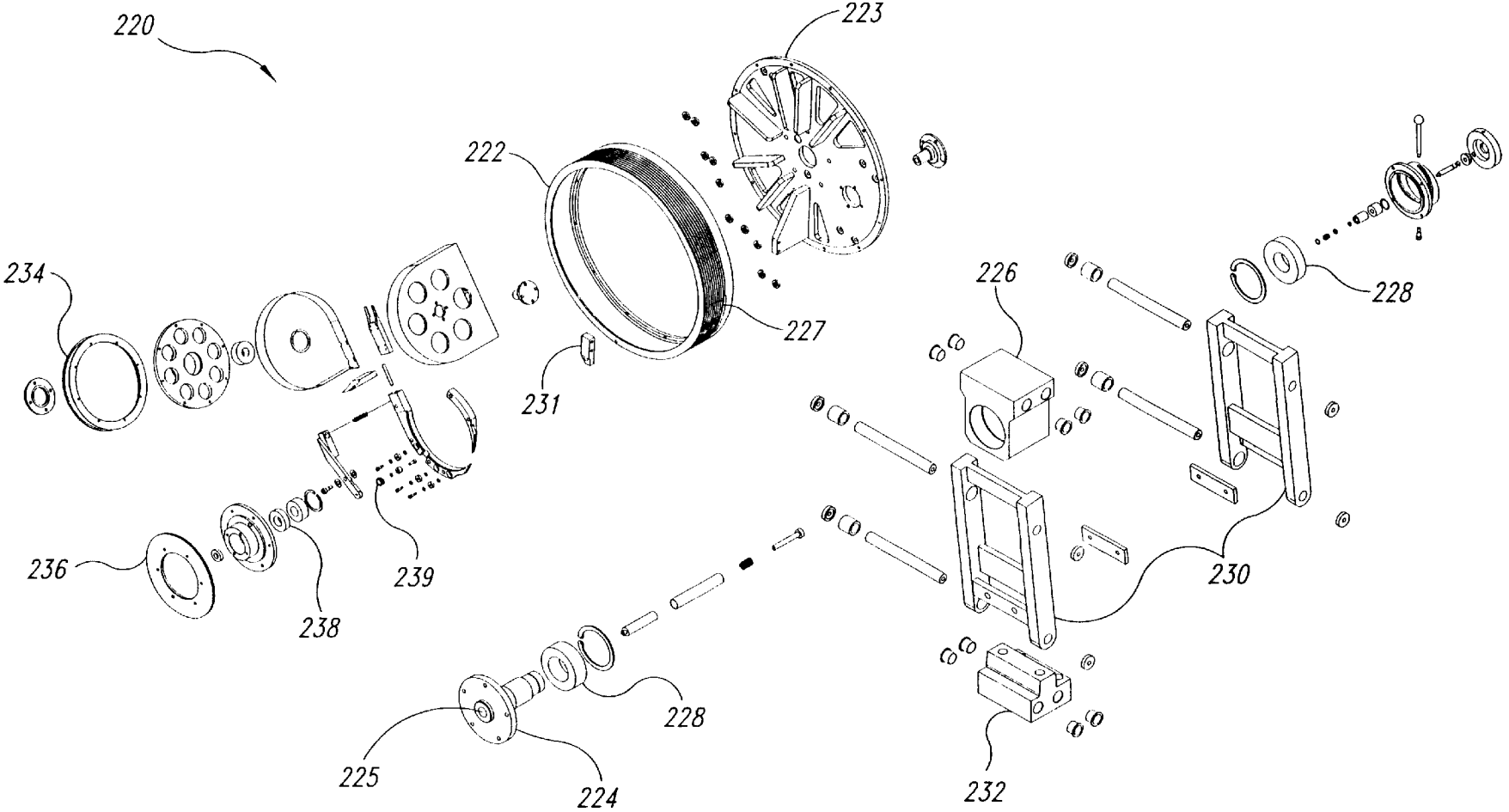
Figure 5A:
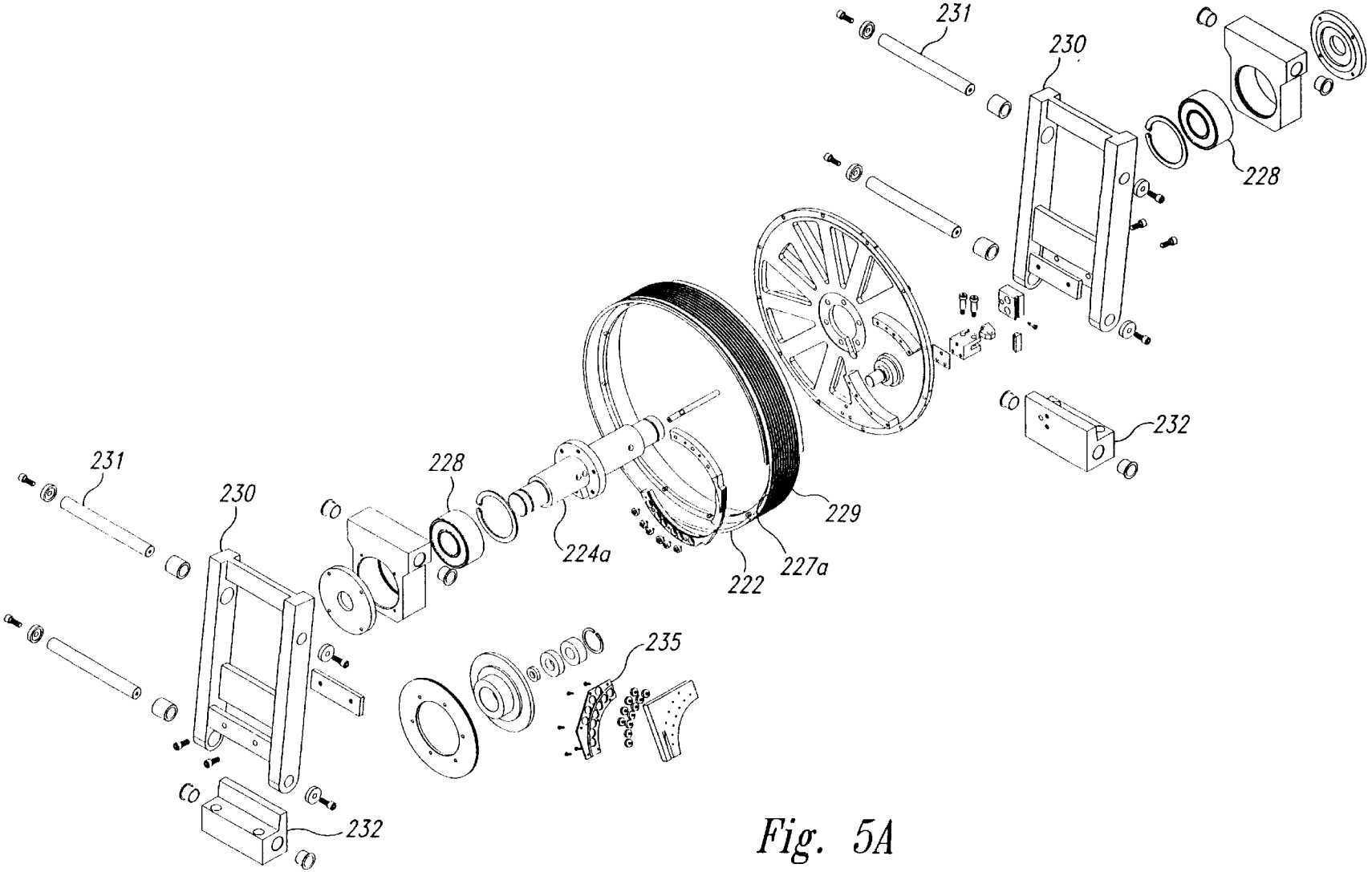
FIG. 5A is a schematic exploded isometric view of a modified form of the accumulator.

As shown in FIGS. 4A and 5A, in the alternative, the drum 222 can be mounted on an axle 224*a,* that is rotatably mounted on supports 230 that are on either side of the accumulator drum rather than on one side as in FIG. 4. The supports are pivotally mounted in mounting plates 232 that have bearings 228 that are swing mounted on pins 231. Thus, the drum can be freely swung transversely along its rotational axis to allow the wire to wrap into the helical groove 229 on the drum.

The feeding of wire axially through the hub of the accumulation drum and then tangentially out to the drive wheel as shown in both embodiments is a unique feature of the invention. It provides for fast delivery of the wire to the track and fast and easy accumulation of the wire free from kinking or buckling as in other accumulating techniques. The drum also eliminates the need for prior art type accumulation compartments that need to be re-sized when tracks get larger for larger bundles.

A transverse wheel or transverse guide wheel 234 is affixed to the accumulator hub 223 adjacent to the wire inlet tube 225. A tangent guide wheel 236 is mounted on a one-way clutch 238 that is also affixed to the accumulator hub 223. The clutch 238 restricts rotation of the tangent guide wheel 236 to the feed direction only. A tangent pinch roller 239 is springably biased against the tangent guide wheel 236.

As shown in FIGS. 4-1 and 4-2, the length of wire 102 is passed into and through the wire inlet tube 225 during the initial feed cycle (load cycle), approximately 270 degrees about the transverse wheel 234, and thence, approximately 132 degrees about the tangent wheel 236. The transverse wheel 234 diverts the incoming length of wire 102 into the plane of the accumulator hub 223. The tangent wheel 236 accepts the length of wire 102, which then passes about the tangent wheel 236 and under the pinch roller 239 (FIG. 5). Upon reaching the nip point between the tangent pinch roller 239 and the tangent wheel 236, power is transferred from the slowly rotating tangent wheel 236, being driven by frictional contact with the drive wheel 246, and carries the length of wire 102 through the wire passage 227 (FIG. 5) discharging the length of wire 102 approximately tangent the periphery of the accumulator drum 222. The length of wire 102 is then drawn about the drive wheel 246 and through the drive subassembly 240.

As best shown in FIG. 6, the drive subassembly 240 includes a drive motor 242 coupled to a 90° gear box 244. Although a variety of drive motor embodiments may be used, including hydraulic and pneumatic motors, the drive motor 242 preferably is an electric servo-motor. A drive wheel 246 is driveably coupled to the gear box 244 by a drive shaft 248. A drive base 250 supports a drive eccentric 251 that includes a drive bearing 252 which rotatably supports the drive shaft 248. The drive base 250 is attached to the housing 130 of the wire-tying machine 100. A drive pinch roller 249 is biased against the drive wheel 246, assisting in the transfer of power from the drive wheel 246 to the length of wire 102 during a feed cycle.

A drive tension spring 254 exerts an adjustable drive force on the drive eccentric 251, thereby biasing the drive wheel 246 against the tangent guide wheel 236 (or the accumulator drum 222). In this embodiment, the drive tension spring 254 is adjusted by adjusting the position of a nut 255 along a threaded rod 256. The threaded rod 256 is coupled to a drive tension cam 258. The drive force from the drive wheel may be disengaged by rotating the drive tension cam 258 from its over-center position to allow the drive wheel to be spaced away from the accumulator drum. This is done manually by engaging the hex-shaped pin on the cam 258 with a wrench. By removing the drive engagement between the drive wheel and the accumulator drum, wire can be removed by hand from the feed and tension assembly.

The drive subassembly 240 further includes a drive entry guide 260 and a drive exit guide 262 positioned proximate the drive wheel 246 and the drive pinch roller 249. Together with the drive pinch roller 249, the drive entry guide 260 and drive exit guide 262 maintain the path of the length of wire 102 about the drive wheel 246. In this embodiment, the length of wire 102 contacts the drive wheel 246 over an approximately 74.5° arc, although the arc length of the contact area may be different in other embodiments. An exhaust solenoid 264 is coupled to an exhaust pawl 266 that engages the drive exit guide 262. The exhaust solenoid 264 may be actuated to move the exhaust pawl 266, causing the drive exit guide 262 to deflect the wire 102 from its normal wire feed path 202 (FIG. 8) into an exhaust feed path 204 as necessary, such as when it is necessary to remove wire stored on the accumulator drum 222. Similarly, a drive solenoid 265 (FIG. 6) is coupled to a feed pawl 267 for directing the length of wire 102 onto the drive wheel 246 during the load cycle which cycle terminates shortly after the length of wire 102 has passed through the drive subassembly 240.

The length of wire 102 must be fed through the twister assembly 300, about the track assembly 400, and back into the twister assembly 300 to be ready to bind the one or more objects within the bundling station 106. At the start of the load cycle the accumulator drum 222 of the accumulator subassembly 220 is in the home position and the drive wheel 246 is aligned with the tangent wheel 236. In this position the length of wire 102 is compressed between the drive wheel 246 and the tangent wheel 236. The drive motor 242 is actuated causing the drive wheel 246 to rotate in the feed direction 132 (see arrows 132 in FIG. 4-2). Motion is imparted to the length of wire 102 and to the tangent wheel 236 through friction. The length of wire 102 is thus pushed through the twister assembly 300, about the track assembly 400, and back into the twister assembly 300, at which time the drive motor 242 is halted.

FIGS. 4-3 through 4-5 show the wire path during the tension cycle. When the tension cycle is initiated, the drive motor 242 starts rotating the drive wheel 246 in the tension direction. The length of wire 102, being compressed between the drive wheel 246 and the tangent wheel 236 is forced in the direction opposite of the feed direction. Because the tangent wheel 236 is constrained to rotate only in the feed direction, and because the tangent wheel 236 is rotatably affixed to the accumulator hub 223, the transfer of motion from the drive wheel 246 and through the length of wire 102 causes the accumulator drum 222 to rotate in the tension direction. The length of wire 102 is thus wound into the helical groove 229 of the accumulator drum 222. The drive wheel 246 delivers its torque through the drive eccentric 251 such that the drive wheel 246 produces increased compressive loading on the length of wire 102 as the imparted torque increases. This reduces the possibility of drive wheel 246 slippage during tensioning.

FIGS. 4-6 through 4-8 show a typical feed cycle. The feed cycle is initiated as soon as the twist cycle has been completed, as described more fully below. At the start of the feed cycle, the drive wheel 246 is activated in the feed direction. The length of wire 102 is typically compressed between the drive wheel 246 and the accumulator drum 222, and is entrained in the helical groove 229 thereon, and is thus fed from about the accumulator drum 222. As the accumulator drum 222 returns to the home position, the tangent wheel 236 re-aligns with the drive wheel 246 and the stop finger impinges on the stop block subassembly 280 slowing the motion of the accumulator drum 222 to a stop. The length of wire 102 continues to feed, but the path is returned to feeding from the external wire reservoir 104 (not shown). This continues as described for the load cycle above until the feed cycle is terminated. The feed and tension assembly 200 is now ready to duplicate overall procedure from the start of the tension cycle.

Referring to FIG. 7, the stop block subassembly 280 includes a stop pawl 282 pivotably attached to a stop block base 284 by a pawl pivot pin 286. The stop block base 284 is rigidly attached to the housing 130 of the wire-tying machine 100. A stop plunger 288 is disposed within a stop spring 290 and is partially constrained within the stop block base 284. The stop plunger 288 engages a first end 292 of the stop pawl 282. A stop pawl return spring 294 is coupled between the stop block base 284 and a second end 296 of the stop pawl 282.

The stop block subassembly 280 is rigidly affixed to the housing 130 to check rotation of the accumulator drum 222 and to index its position relative to the drive wheel 246 when no wire is stored on the accumulator subassembly 220. In operation, the second end 296 of the stop pawl 282 engages the stop finger 231 to slow and stop rotation of the accumulator drum 222. When the stop finger 231 strikes the stop pawl 282 it depresses the stop plunger 288 and the stop spring 290. The stop spring 290 absorbs the shock prior to bottoming out and stopping the movement of the accumulator drum 222. The stop pawl 282 is free to deflect clear of the stop finger 231 if struck in the wrong direction, such as may happen, for example, in a rare instance when the feed and tension assembly 200 malfunctions by skipping out of the helical groove 229 of the accumulator drum 222 during tensioning.

FIGS. 4A, 4A-1 through 4A-9, 5A, and 6A show an alternative form of feed and tension assembly. In this embodiment, the transverse guide wheel is eliminated and a curved roller axle tube 235 (FIG. 5A) feeds the wire through the hub of the accumulation drum and guides the wire directly into the rim of the tangent guide wheel 236. Further, in some instances of the feed and tension assembly 200, the elements and functions of the stop block subassembly 280 are incorporated into the accumulator subassembly 220 and the drive subassembly 240. In this preferred embodiment, the operation is best shown in FIGS. 4A-1 to 4A-9. Again, the wire feeds axially through the drum axle 224*a,* then through the curved roller axle tube 235, exiting at the tangent guide wheel 236, then through the slot 227*a* (FIG. 5A), about the drive wheel 246, and between the pinch roller 249 and the drive wheel 246.

In the tension cycle in FIGS. 4A-4 to 4A-6, the wire is retracted by the drive wheel and lays the wire in the groove of the rotating accumulator drum 222. As the wire feeds into the helical groove on the drum, the drum moves freely laterally (along its axis of rotation).

As best shown in FIGS. 4A-7 to 4A-9, when wire is to be re-fed into the track, the wire is first fed from the accumulator drum, until all accumulated wire is off the periphery of the drum and then additional wire is fed from the supply.

Figure 6:
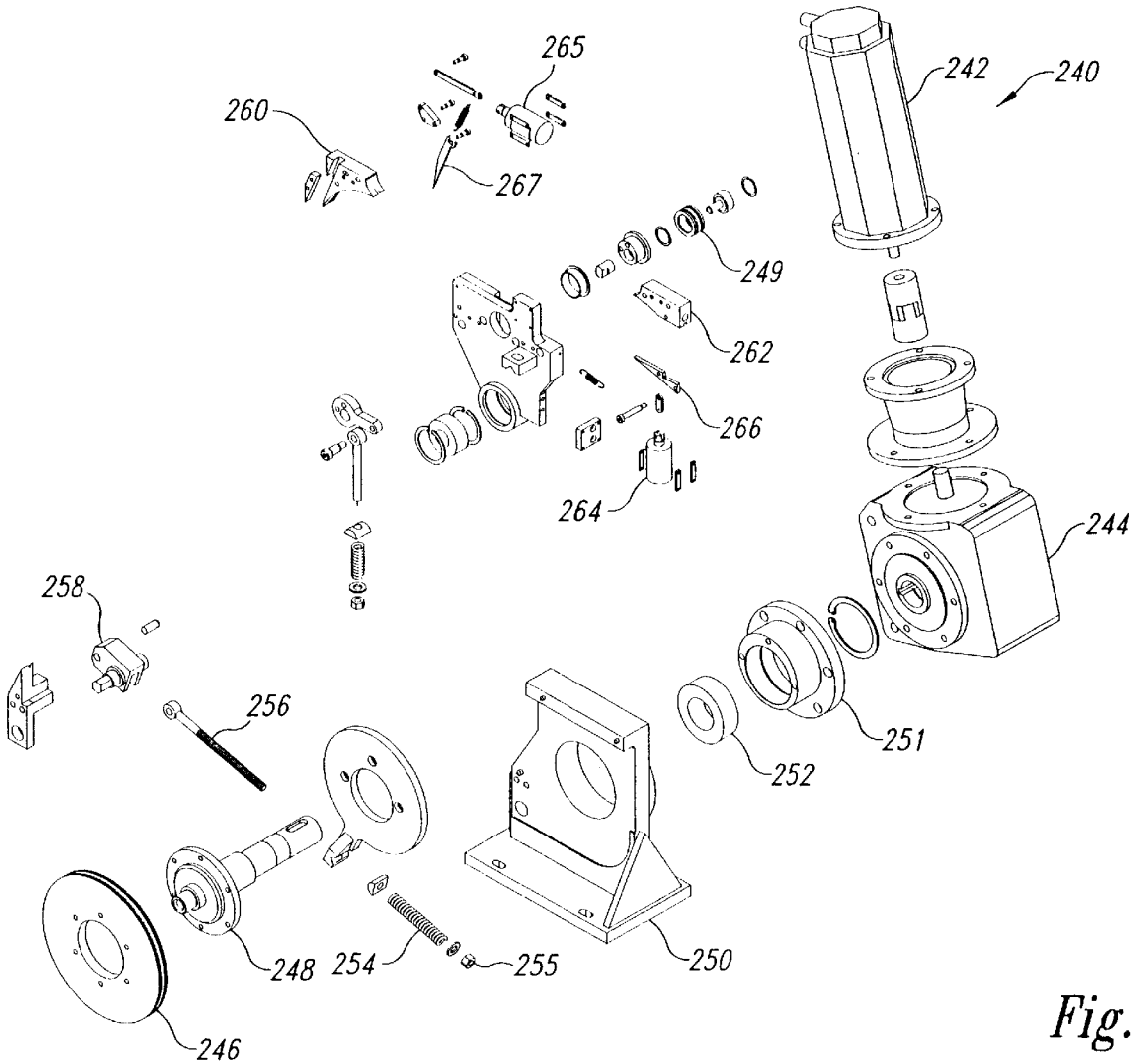
Figure 6A:
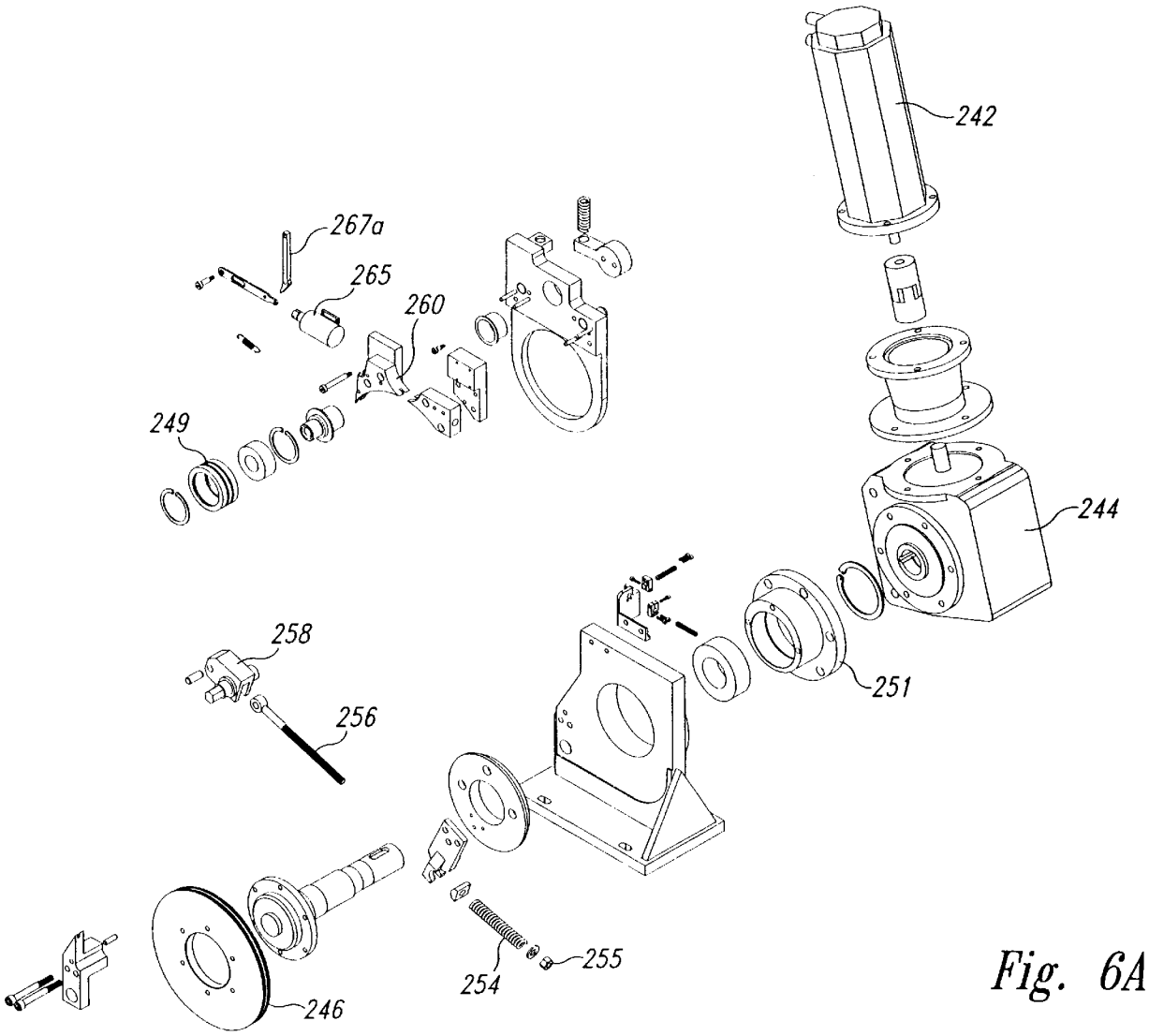
FIG. 6A is an exploded isometric view of a modified form of feed and tension assembly.
Figure 7:
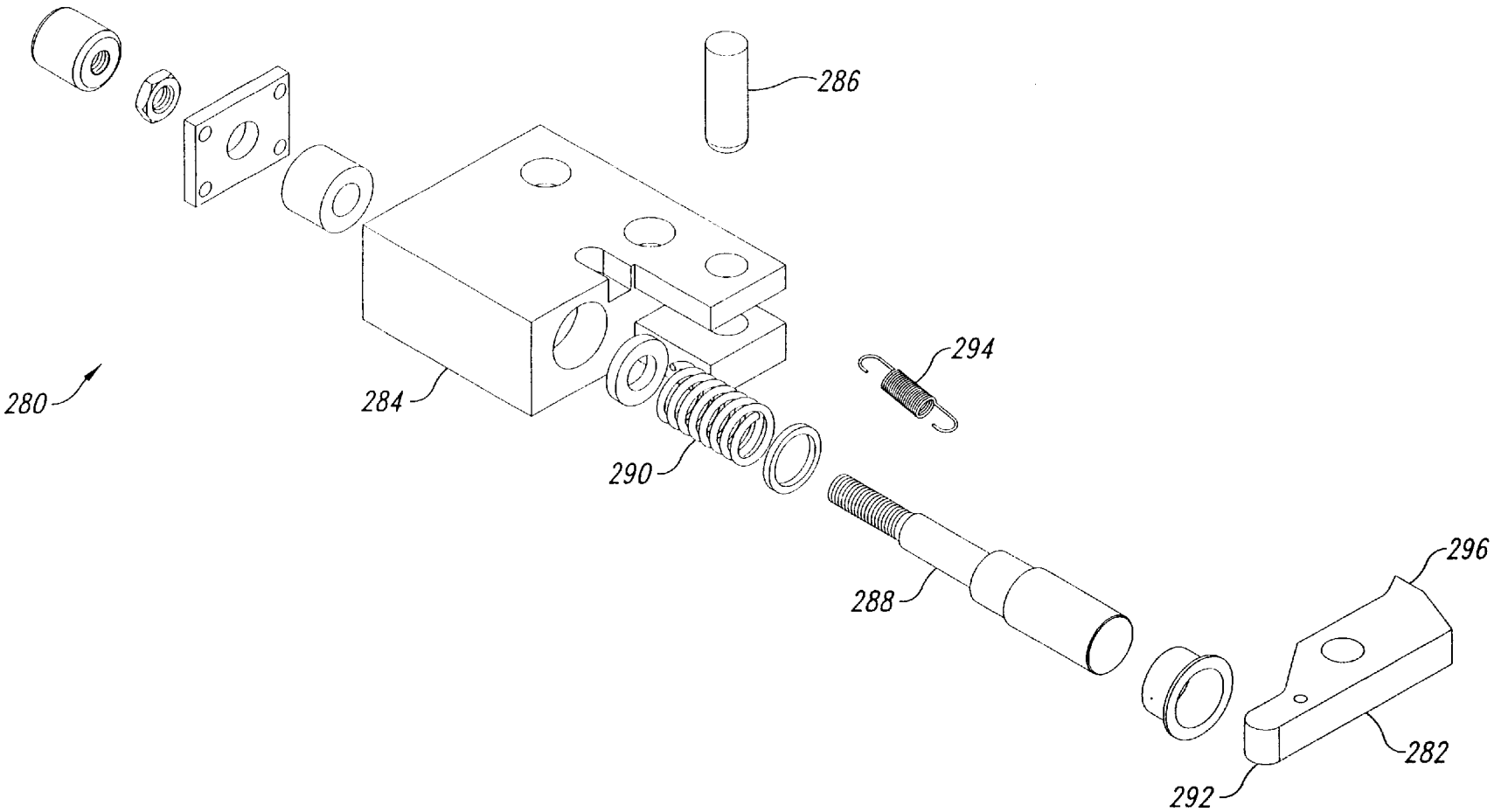
Figure 8:
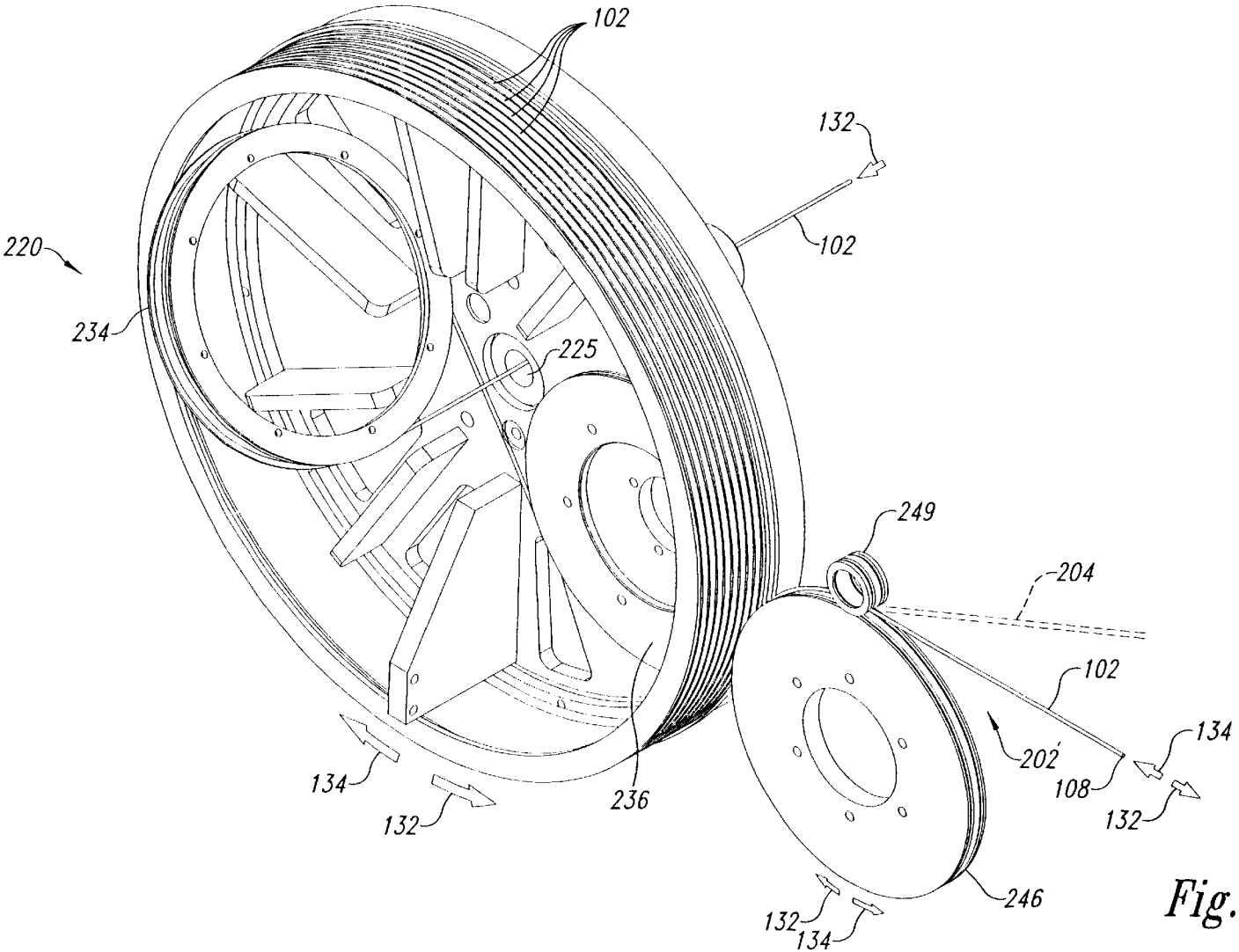
Figure 9:
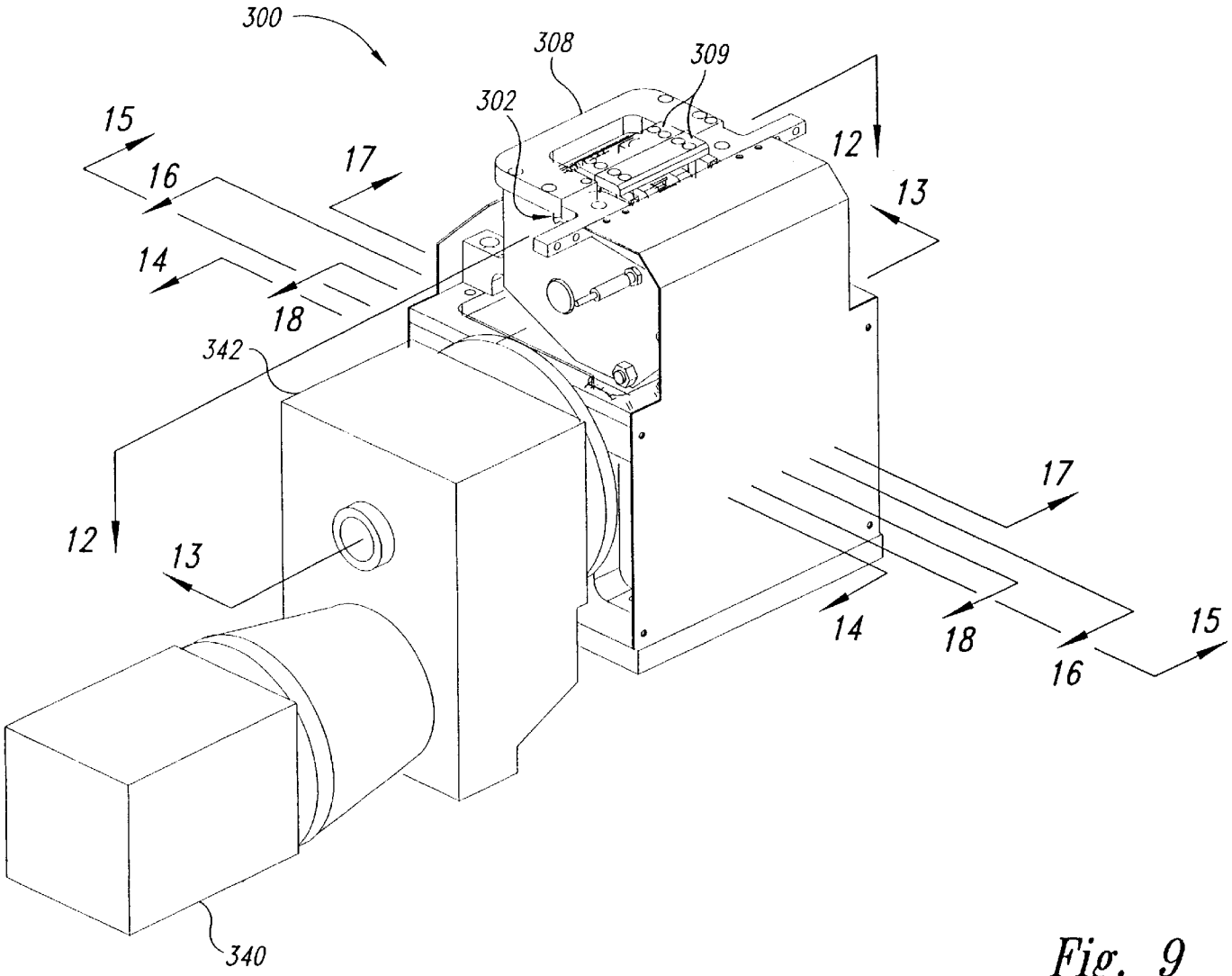
Figure 9A:
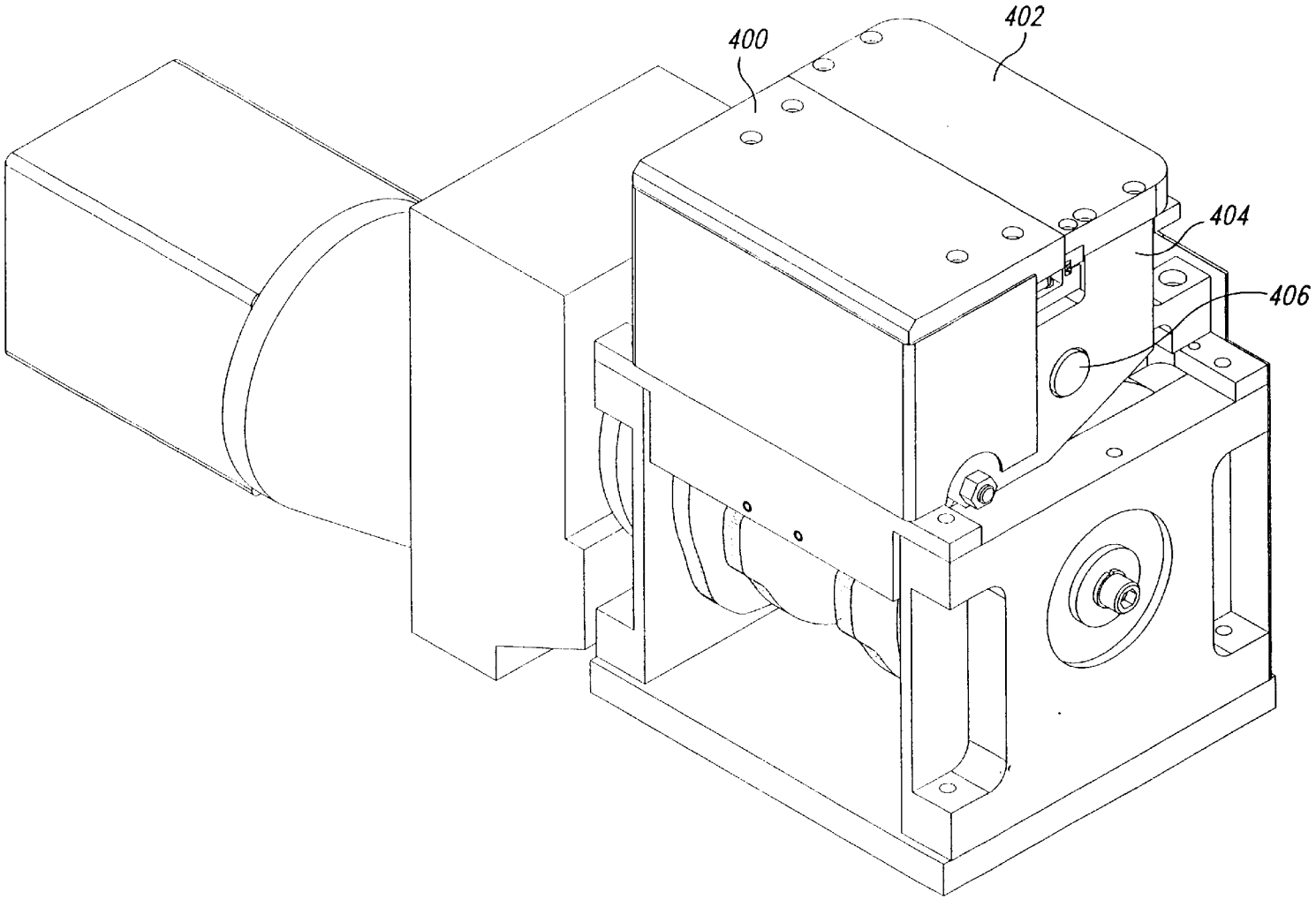
FIG. 9A is an isometric of a modified form of twister assembly.

FIGS. 4A and 6A show further details of the second embodiment of the feed and tension assembly. In this embodiment the feed pawl 267*a* is modified and is actuated during the load cycle to move down close to the drive wheel 246 to guide the incoming wire from the tangent wheel 236 into the nip between the drive wheel and the drive entry guide 260. After the wire is fed about the drive wheel the feed pawl is moved away from the drive wheel by the solenoid 265.

Figures 4, 4A, 5, 6, 7, 8, 9:
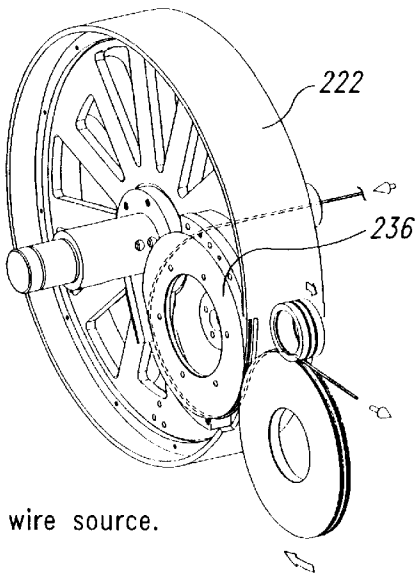
Figure 10:
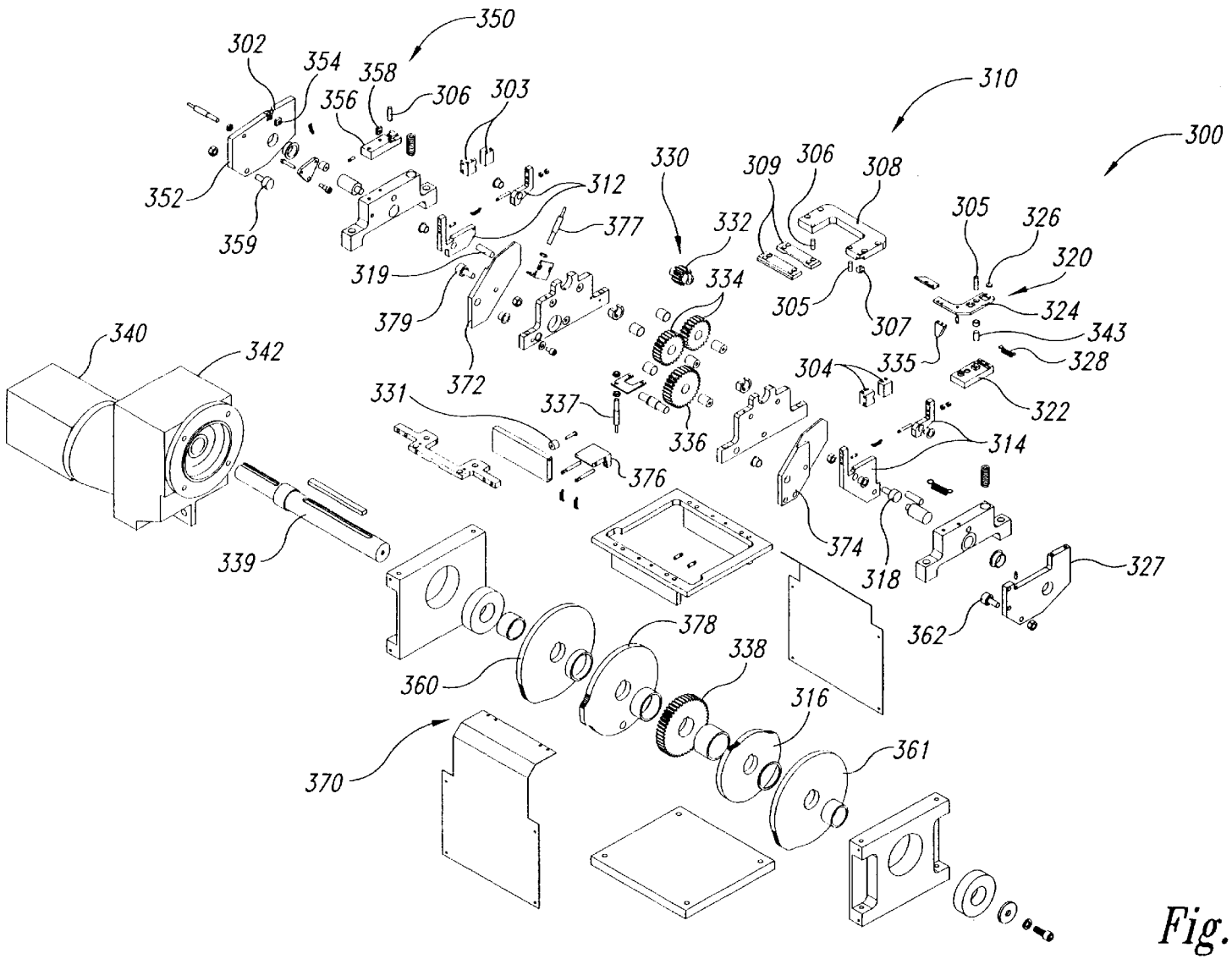
FIG. 10 is an exploded isometric view of the twister assembly of FIG. 9.
Figure 10A:
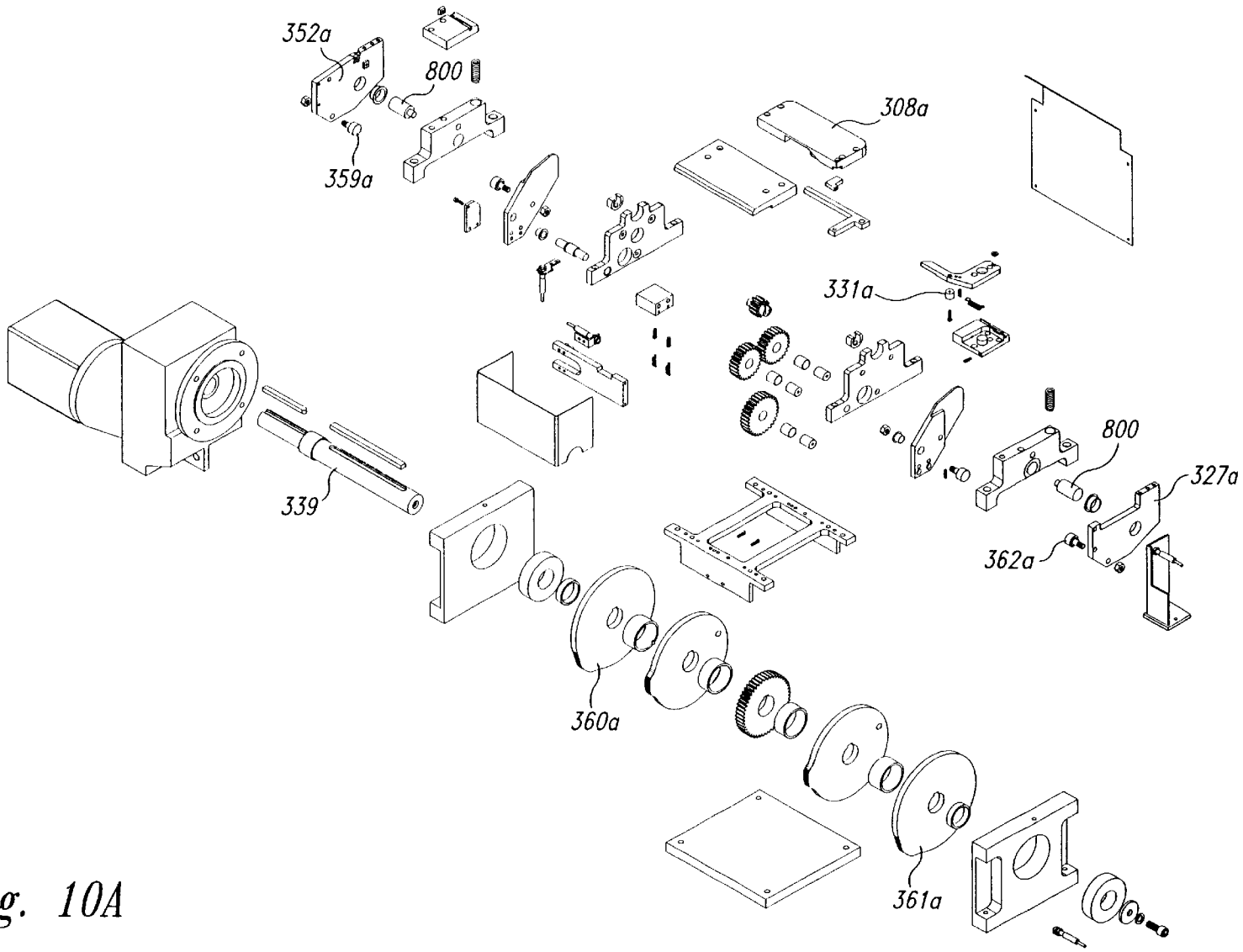
FIG. 10A is an exploded isometric of the modified form of the twister assembly.
Figure 11:
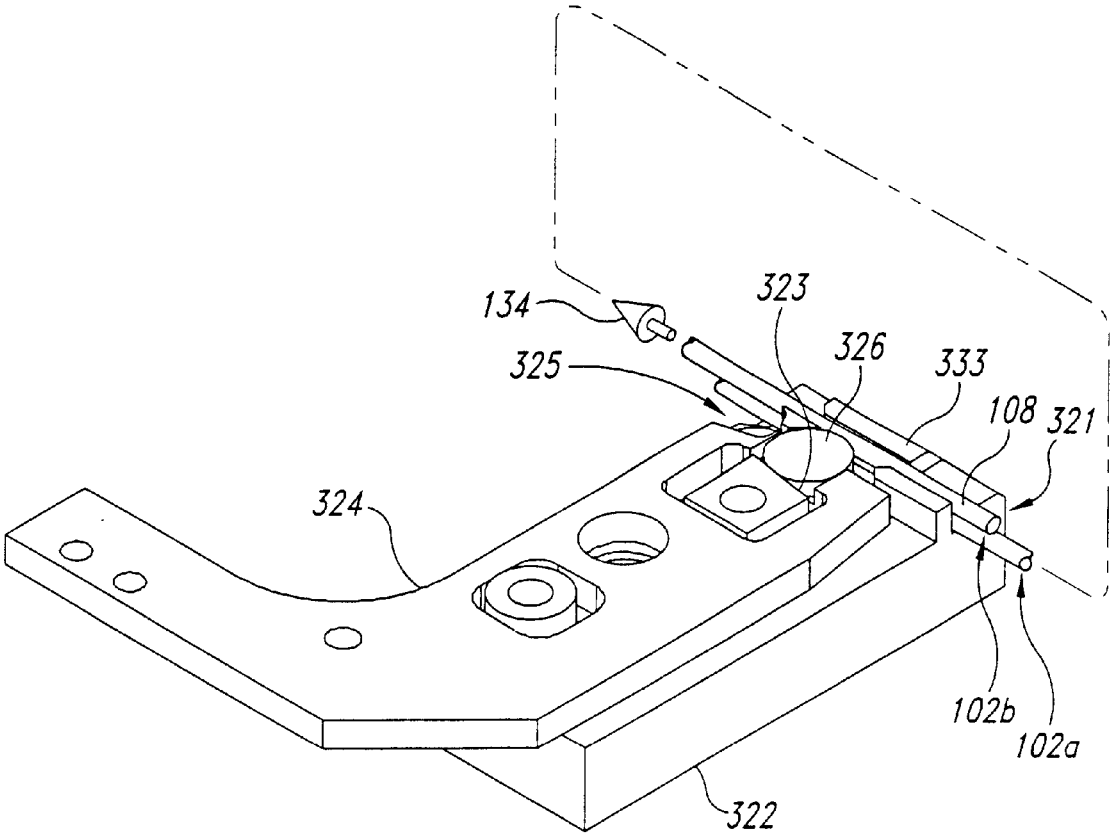
FIG. 11 is an enlarged isometric partial view of a gripper subassembly of the twister assembly of FIG. 9.

FIG. 9 is an isometric view of the twister assembly 300 of the wire-tying machine 100 of FIG. 1. FIG. 10 is an exploded isometric view of the twister assembly 300 of FIG. 9. FIG. 11 is an enlarged isometric partial view of a gripper subassembly 320 of the twister assembly 300 of FIG. 9. FIGS. 12 through 18 are various cross-sectional views of the twister assembly 300 of FIG. 9. FIG. 19 is a partial isometric view of a knot 118 produced by the twister assembly 300 of FIG. 9. As best seen in FIG. 10, the twister assembly 300 includes a guiding subassembly 310, a gripping subassembly 320, a twisting subassembly 330, a shearing subassembly 350, and an ejecting subassembly 370.

Figure 15:
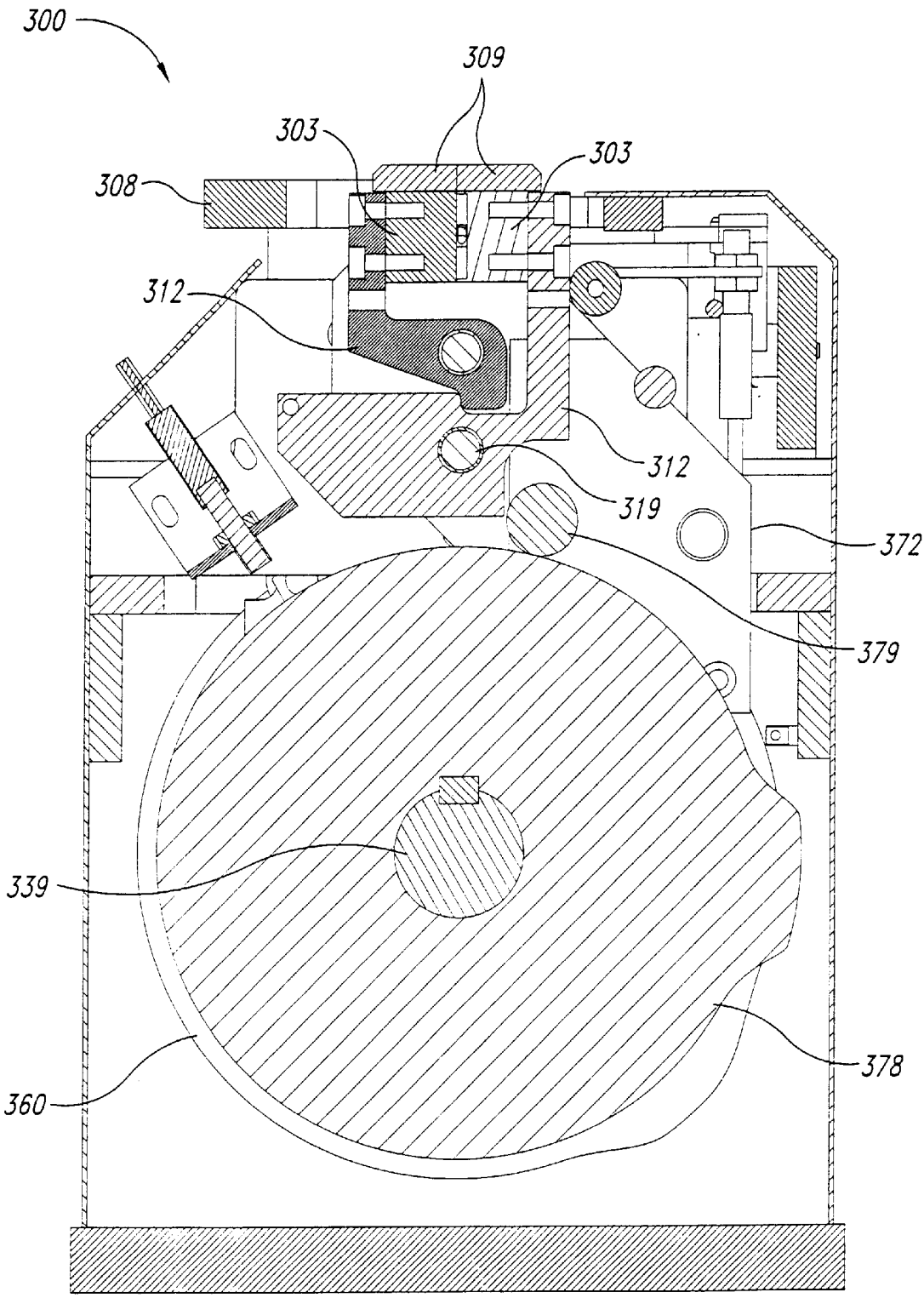
FIG. 15 is a right elevational cross-sectional view of the twister assembly of FIG. 9 taken along line 15—15.

Referring to FIGS. 9, 10, 15, and 16, the guiding subassembly 310 includes a twister inlet 302 that receives the length of wire 102 fed from the feed and tension assembly 200. As best shown in FIG. 15, a pair of front guide blocks 303 are positioned proximate the twister inlet 302 and are coupled to a pair of front guide carriers 312. A pair of rear guide pins 305 and a pair of front guide pins 306 are secured to a head cover 308 at the top of the twister assembly 300. A pair of rear guide blocks 304 are positioned near the head cover 308 opposite from the front guide blocks 303, and are coupled to a pair of rear guide carriers 314. A diverter stop block 307 is secured to the head cover 308 proximate the rear guide pins 305.

Figure 16:
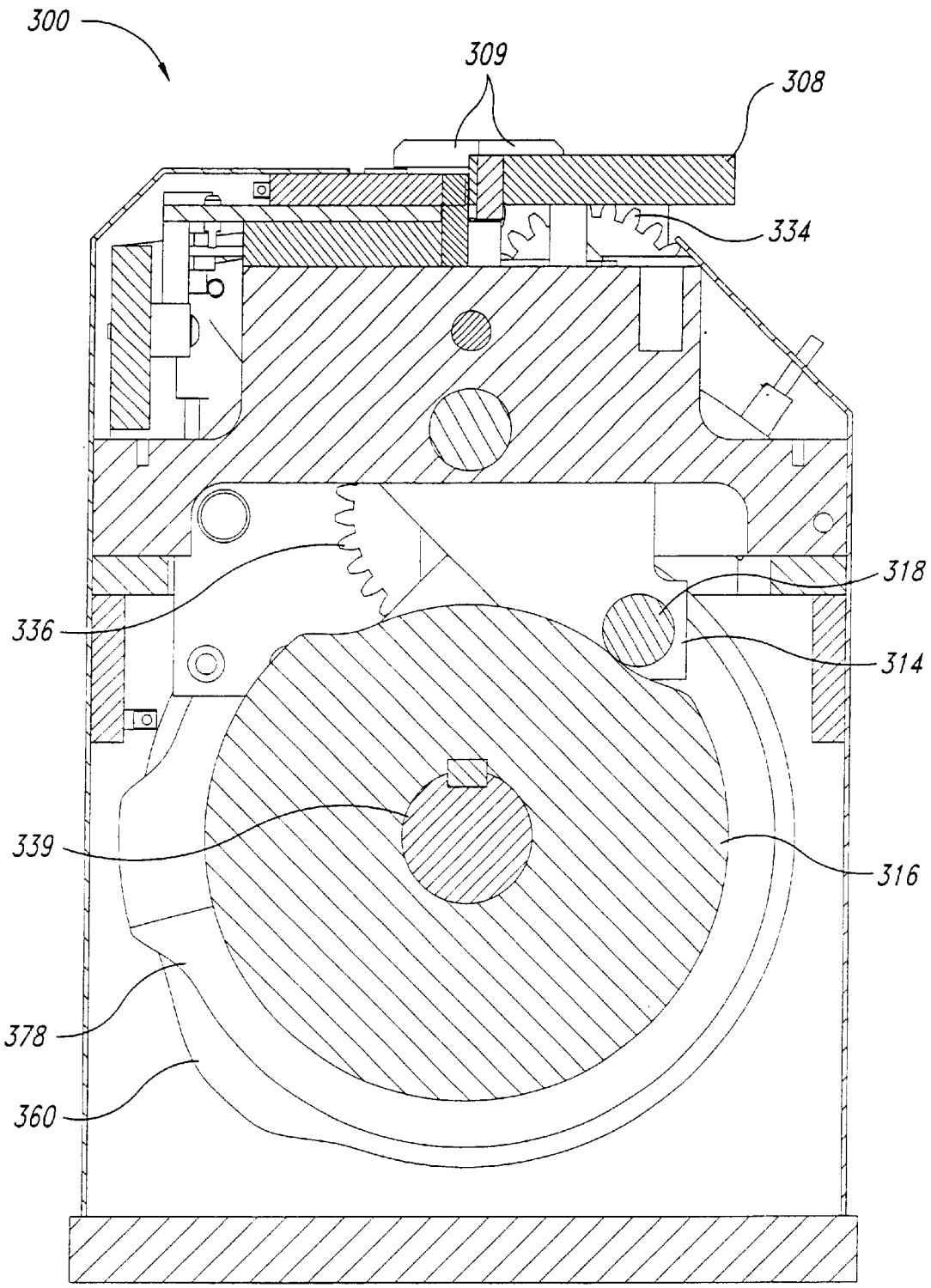
FIG. 16 is a right elevational cross-sectional view of the twister assembly of FIG. 9 taken along line 16—16.

A pair of guide covers 309 are positioned adjacent the head cover 308 and together form the bottom of the bundling station 106 (FIGS. 1–3). A guide cam 316 is mounted on a twister shaft 339 and engages a guide cam follower 318 coupled to one of the rear guide carriers 314. As best seen in FIG. 15, one of the front guide carriers 312 is pivotably coupled to a guide shaft 319, and the front guide carriers 312 are positioned to pivot simultaneously. As shown in FIG. 16, the guide cam 316 and guide cam follower 318 actuate the rear guide carriers 314. The front guide carrier 312 is rigidly connected to the rear carrier 314 by the guide cover 309 such that the guide cam 316 operates both front and rear carriers 312, 314 simultaneously.

Figure 12:
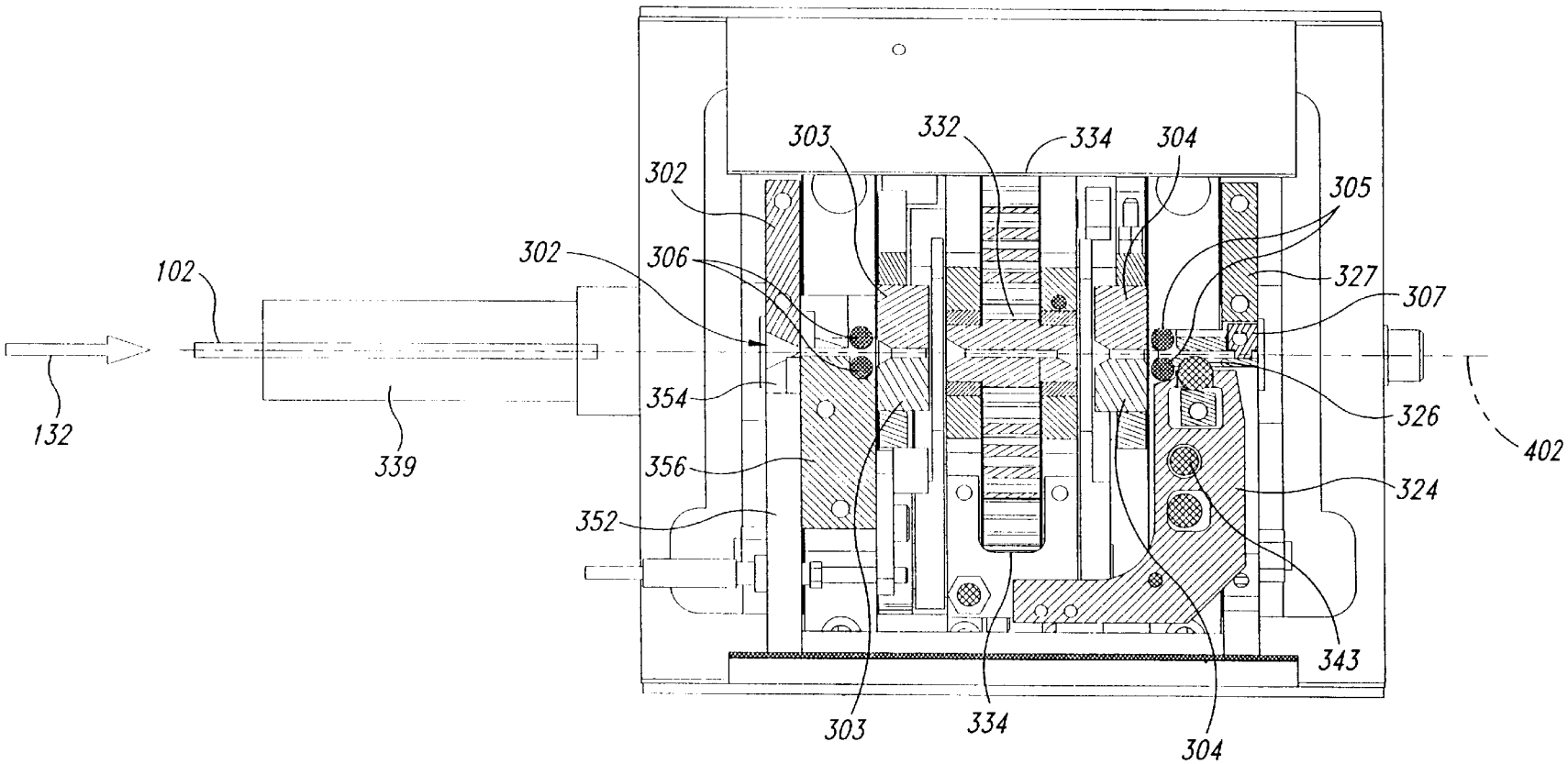
FIG. 12 is a top cross-sectional view of the twister assembly of FIG. 9 taken along line 12—12.
Figure 17:
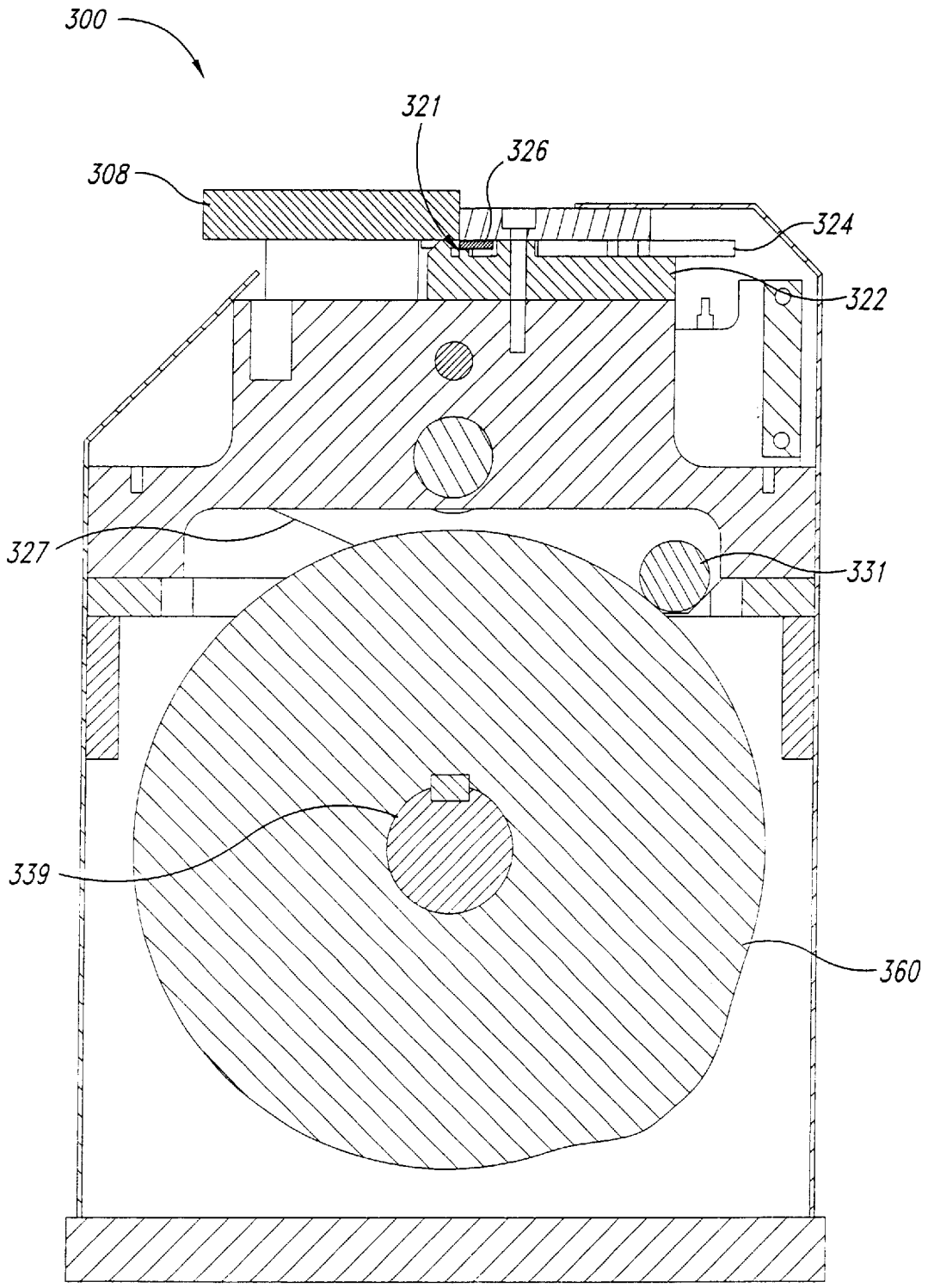
FIG. 17 is a right elevational cross-sectional view of the twister assembly of FIG. 9 taken along line 17—17.

Referring to FIGS. 10 and 17, the gripping subassembly 320 includes a gripper block 322 having a gripper release lever 324 pivotally attached thereto. As best seen in FIGS. 11 and 12, the gripper block 322 also has a wire receptacle 321 disposed therein, and a gripper opposite wall 333 adjacent the wire receptacle 321. A tapered wall 323 projects from the gripper block 322 proximate to the wire receptacle 321, forming a tapered gap 325 therebetween. A gripper disc 326 is constrained to move within the tapered gap 325 by the gripper release lever 324. A gripper return spring 328 is coupled to the gripper release lever 324. A pair of multi-purpose cams 360, 361 are mounted on the twister shaft 339. One of the multi-purpose cams 360 indirectly activates a gripper cam follower 331 through a gripper release rocker 327. The gripper release rocker 322 in turn engages a gripper release cam block 335 which, in turn, engages the gripper release lever 324. A feed stop switch 337 (FIG. 10) is positioned proximate the gripper release lever 324 to detect the movement thereof.

Figure 18:
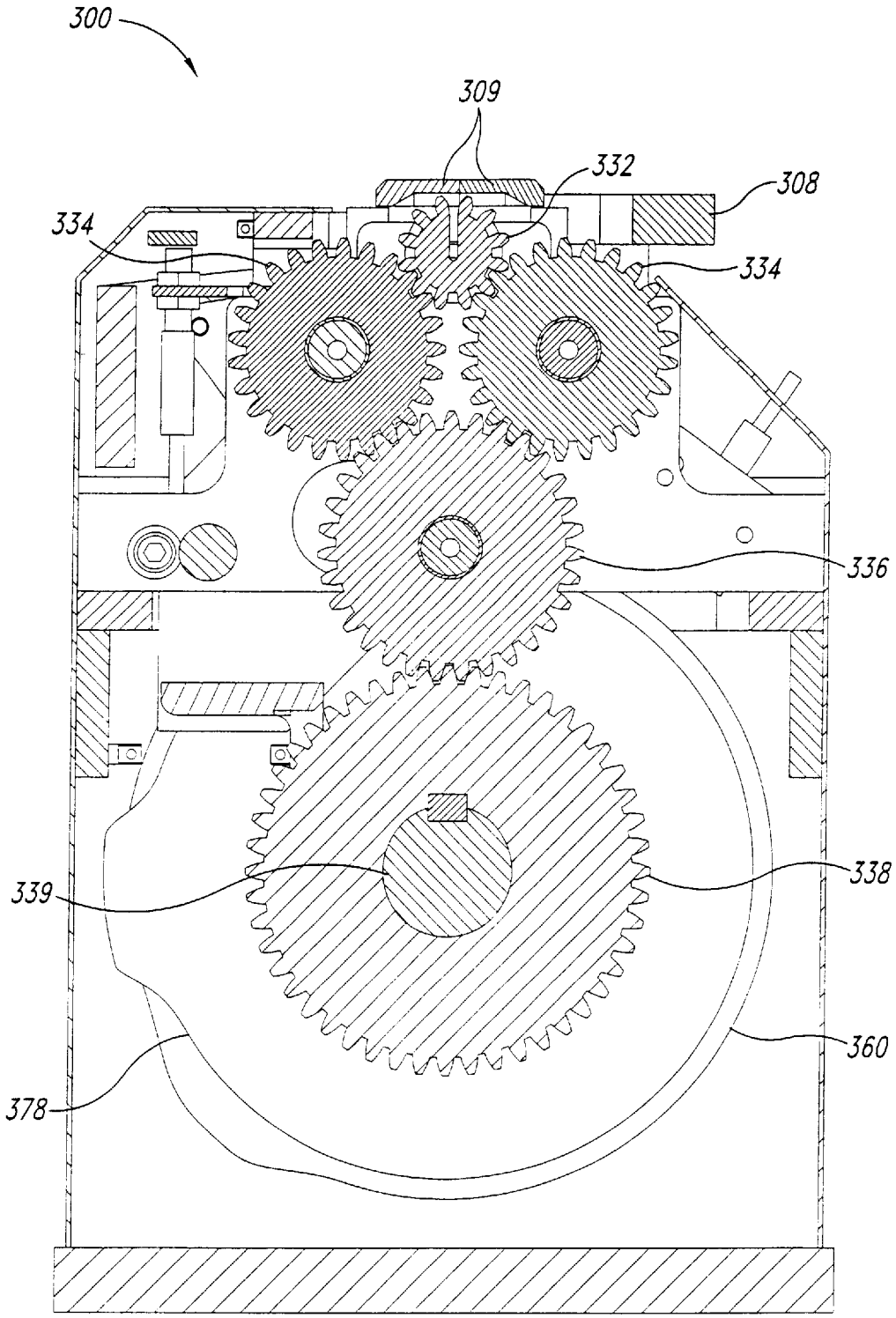
FIG. 18 is a right elevational cross-sectional view of the twister assembly of FIG. 9 taken along line 18—18.
Figure 19:
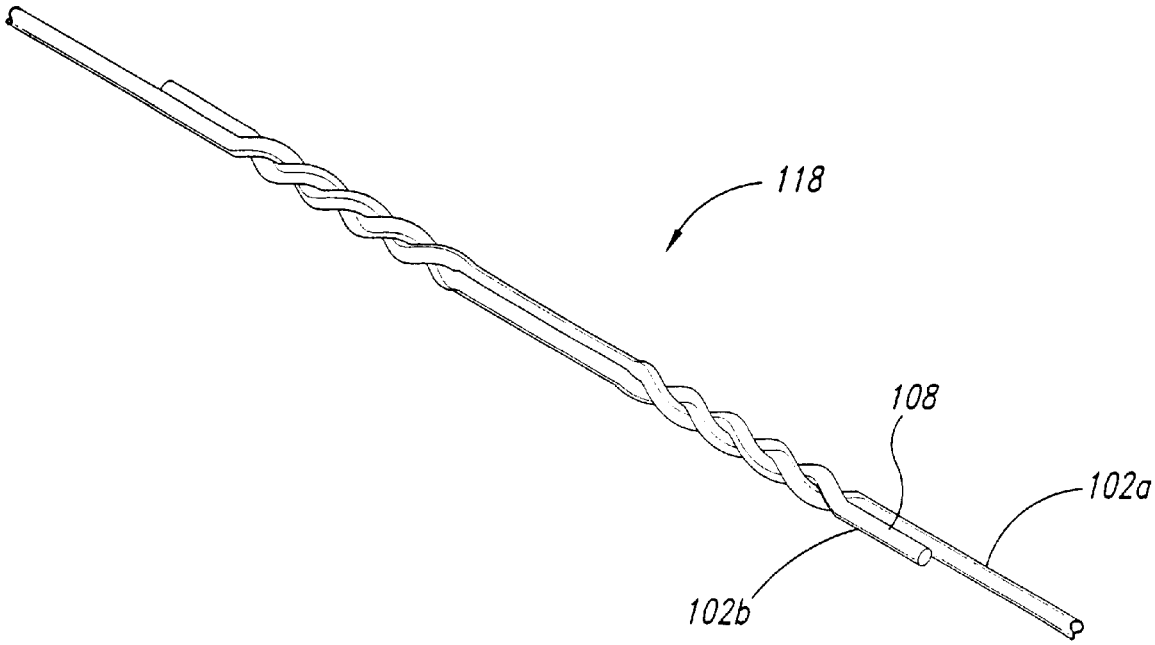
FIG. 19 is a partial isometric view of a knot produced by the twister assembly of FIG. 9.

Referring to FIGS. 10, 12, 13, and 18, the twisting subassembly 330 includes a slotted pinion 332 driven by a pair of idler gears 334. As best seen in FIG. 18, the idler gears 334 engage a driven gear 336 which in turn engages a drive gear 338 mounted on the twister shaft 339. A twister motor 340 coupled to a gear reducer 342 drives the twister shaft 339. Although a variety of motor embodiments may be used, the twister motor 340 preferably is an electric servomotor.

Figure 14:
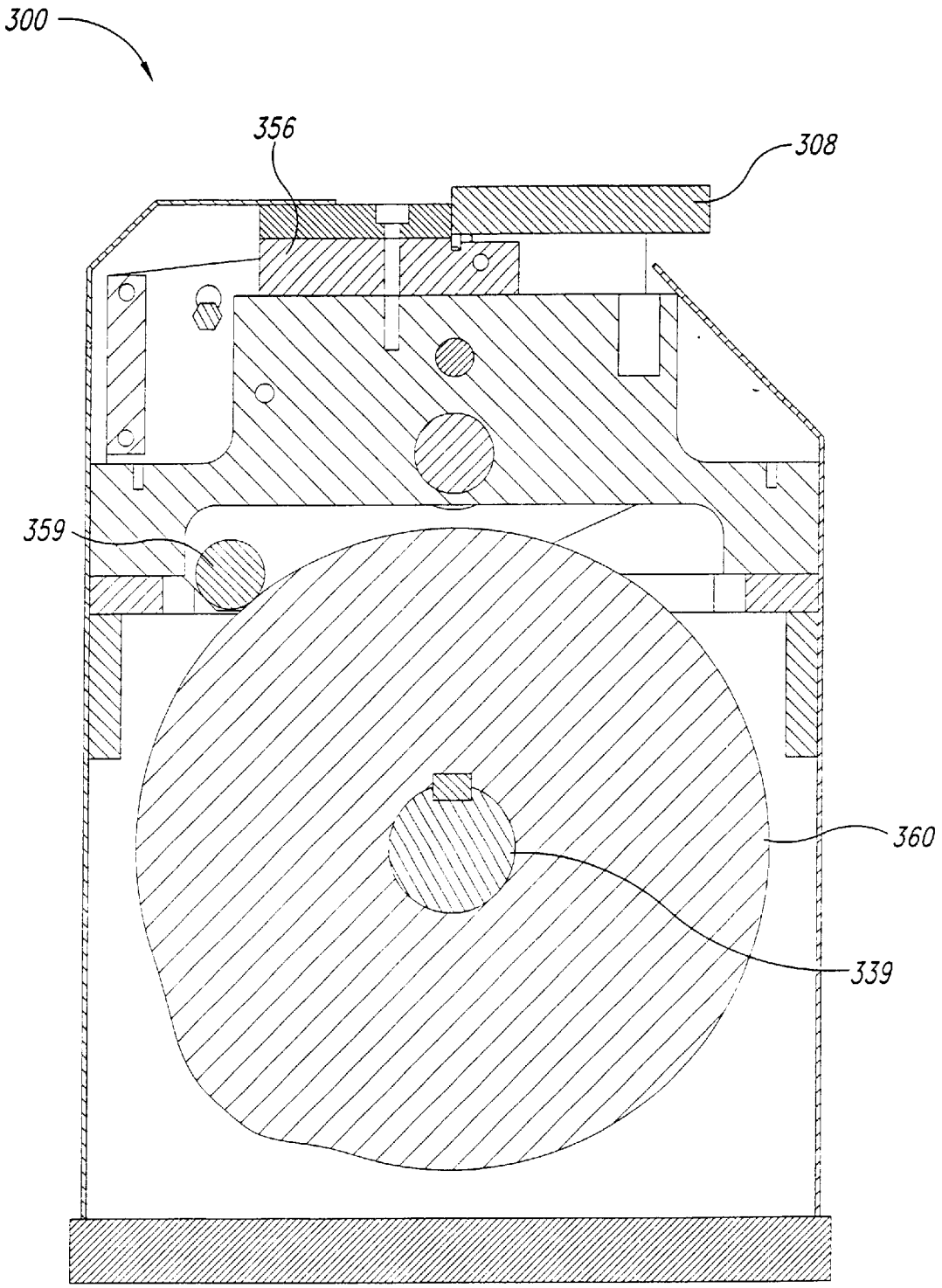
FIG. 14 is a right elevational cross-sectional view of the twister assembly of FIG. 9 taken along line 14—14.

As best seen in FIGS. 10 and 14, the cutting subassembly 350 includes a moveable cutter carrier 352 having a first cutter insert 354 attached thereto proximate the twister inlet 302. A stationary cutter carrier 356 is positioned proximate the moveable cutter carrier 352. A second cutter insert 358 is attached to the stationary cutter carrier 356 and is aligned with the first cutter insert 354. One of the multi-purpose cams 360 mounted on the twister shaft 339 engages a cutter cam follower 359 attached to the moveable cutter carrier 352.

Referring to FIGS. 10 and 15, the ejecting subassembly 370 includes a front ejector 372 pivotally positioned near the front guide blocks 303, and a second ejector 374 pivotally positioned near the rear guide blocks 304. An ejector cross support 376 (FIG. 10) is coupled between the front and rear ejectors 372, 374, causing the front and rear ejectors 372, 374 to move together as a unit. An ejector cam 378 is mounted on the twister shaft 339 and engages an ejector cam follower 379 coupled to the front ejector 372. A home switch 377 is position proximate the ejector cam 378 for detecting the position thereof.

Generally, the twister assembly 300 performs several functions, including gripping the free end 108 of the length of wire 102, twisting the knot 118, shearing the closed wire loop 116 from the wire source 104, and ejecting the twisted knot 118 while providing a clear path for the passage of the wire 102 through the twister assembly 300. As described more fully below, these functions are performed by a single unit having several innovative features, an internal passive gripper capability, replaceable cutters, and actuation of all functions by a single rotation of the main shaft 339.

Figure 13:
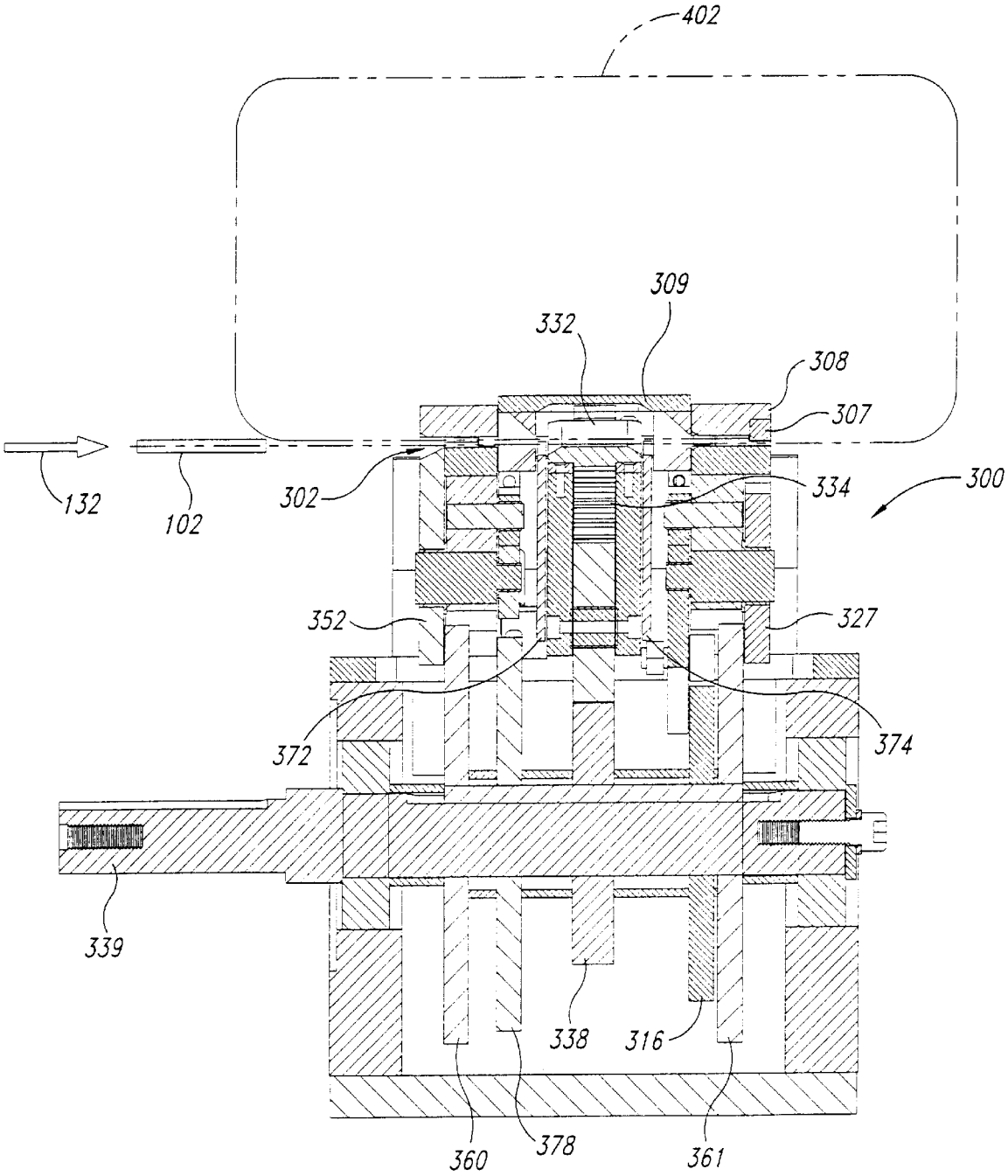
FIG. 13 is a side cross-sectional view of the twister assembly of FIG. 9 taken along line 13—13.
Figure 13A:
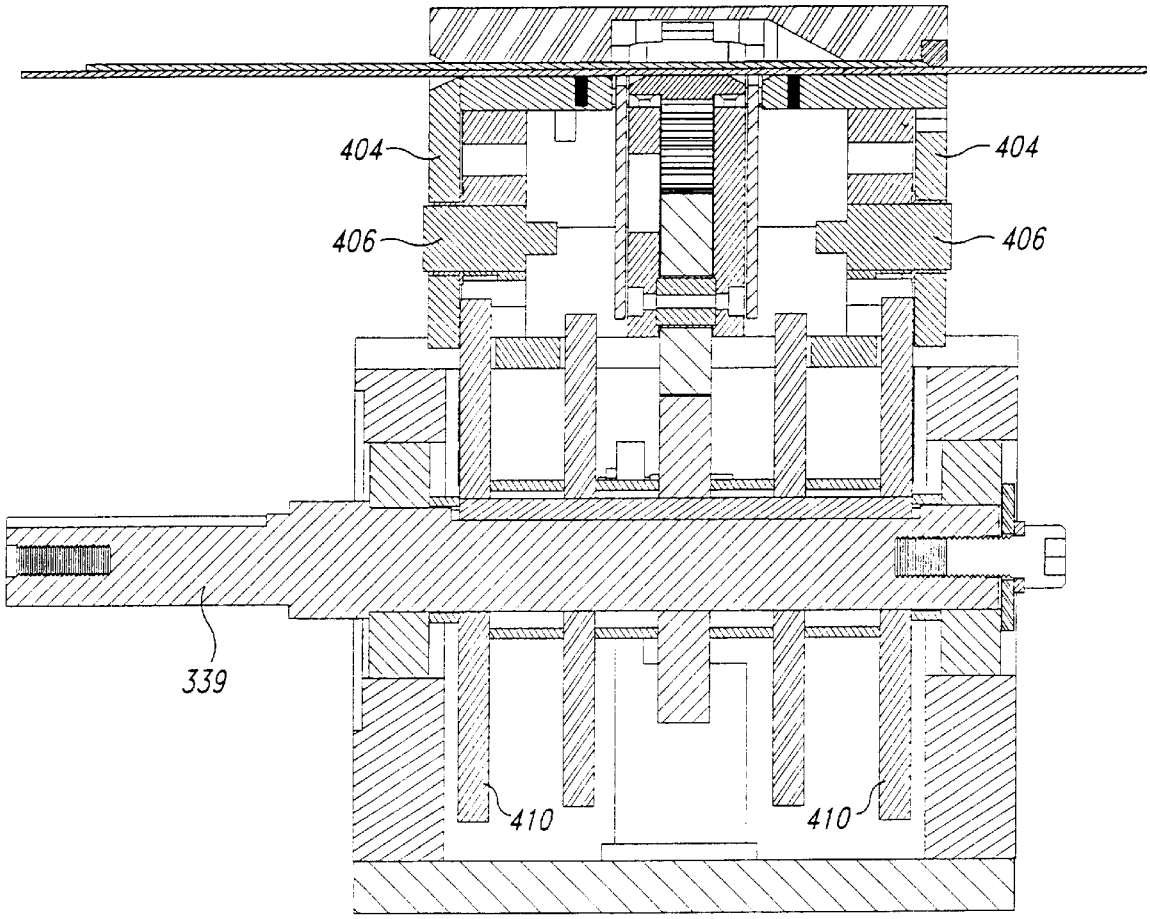
FIG. 13A is a cross-sectional view of the modified twister assembly of FIG. 9A.

During the feed cycle, the free end 108 of the length of wire 102 is fed by the feed and tension assembly 200 through the twister inlet 302 of the twister assembly 300. As best seen in FIG. 12, the free end 108 passes between the front guide pins 306, and between the front guide blocks 303, and through the slotted pinion 332. The free end 108 continues along the wire feed path 202, passing between the rear guide blocks 304, between the rear guide pins 305, and through the wire receptacle 321 in the gripper block 322 (FIG. 11). The free end 108 then exits from the twister assembly 300 to travel around the track assembly 400 along the wire guide path 402, as shown in FIG. 13, described more fully below.

After passing around the track assembly 400, the free end 108 reenters the twister inlet 302 (as the upper wire shown in FIGS. 11, 11A and 11B) above the first passage of wire 102*a* (FIG. 11). The free end 108 again passes between the front guide pins 306, between the front guide blocks 303, through the slotted pinion 332, and between the rear guide blocks 304 and rear guide pins 305. As best seen in FIG. 11, the free end 108 then reenters the wire receptacle 321 and passes above the first passage of wire 102*a,* past the gripper disc 326 and stops upon impact with the diverter stop block 307. The feed cycle is then complete.

Figure 11A:
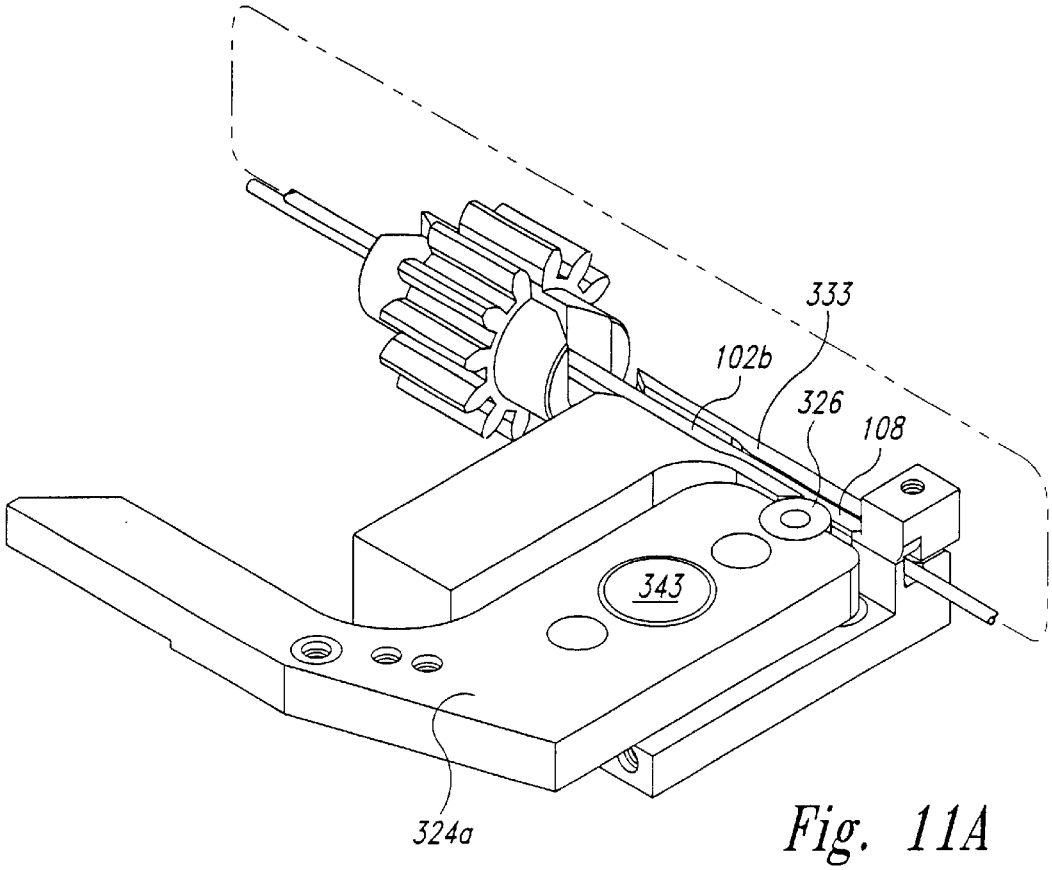
FIG. 11A is an alternative form of a gripper subassembly.
Figure 11B:
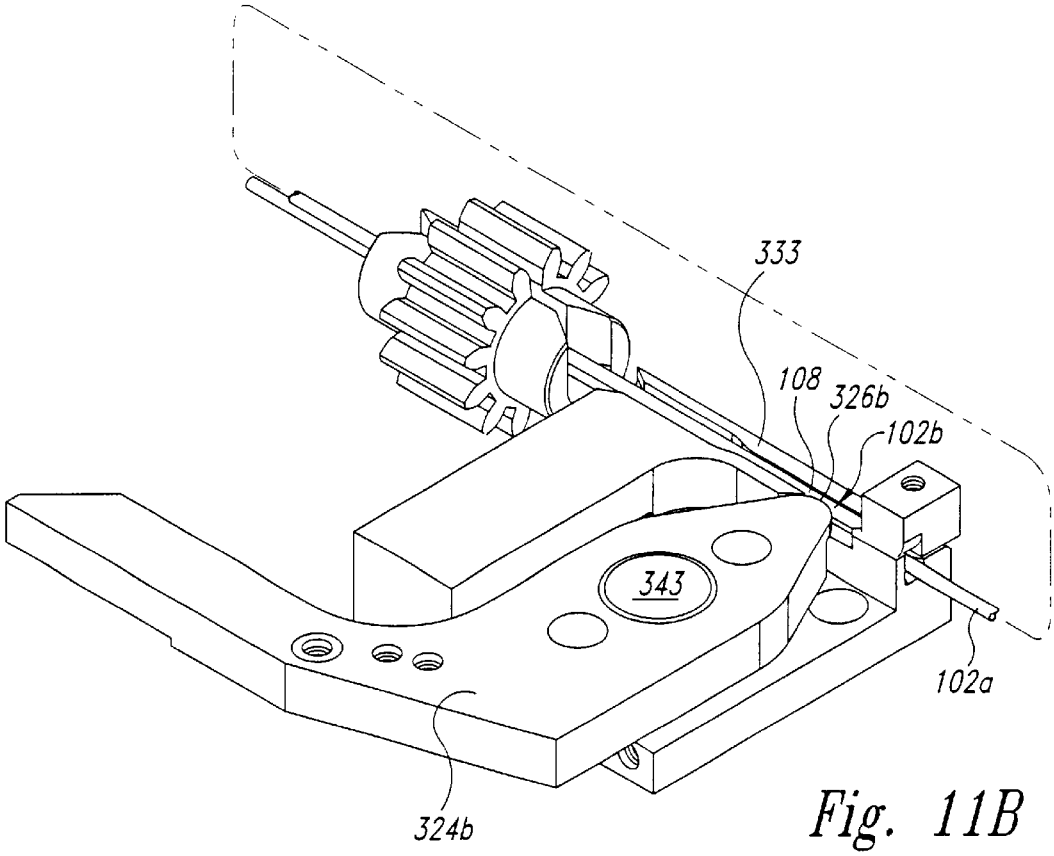
FIG. 11B is another alternative form of a gripper subassembly.

A dot-dashed line is shown in FIGS. 11, 11A and 11B to show schematically the completion of the loop of wire around the track. The now free end 108 is above the lower wire pass 102*a* and has been stopped in the twister. The lower wire pass 102*a* remains connected to the accumulator to be pulled back and tighten the wire around the bundle in the track.

The twister assembly 300 advantageously provides a feed path having a second passage of wire 102*b* (the free end 108) positioned over a first passage of wire 102*a* (that goes to the accumulator). This over/under wire arrangement reduces wear on the components of the twister assembly 300, especially the head cover 308, during feeding and tensioning. Because the length of wire 102 is pushed or pulled across itself instead of being drawn across the inside of the head cover 308 or other component, wear of the twister assembly 300 is greatly reduced, particularly for the tension cycle.

At the end of the feed cycle, the free end 108 (or the upper passage of wire 102*b*) of the length of wire 102 is aligned adjacent to the gripper disc 326. The gripper disc 326 (FIG. 11) is constrained to move within the gap 325 by the gripper release lever 324, the tapered wall 323, and the back wall; both walls being within the gripper block 322. At the initiation of the tension cycle, the second passage of wire 102*b* begins to move in the tension direction (arrow 134) and frictionally engages the gripper disc 326, moving the gripper disc 326 in the tension direction and forcing the gripper disc 326 into increasingly tight engagement between the wire's free end 102*b* and the tapered wall 323. As the wire's free end 102*b* is drawn toward the narrow end of the tapered wall 323, the wire's free end 102*b* is simultaneously forced into the back wall 333 increasing the frictional force and securely retaining the wire's free end 102*b*. Also, as best shown in FIG. 12, the gripper release lever is pivotally mounted on an offset pivot pin 343 so that the friction force between the wire and the disc 326 create an increasing moment pivoting the lever counter clockwise and closer to the opposite wall 333.

Although the gripper disk 326 may be constructed from a variety of materials, including, for example, tempered tool steel and carbide, a fairly hard material is preferred to withstand repeated cycling.

FIGS. 11A and 11B show alternative embodiments of the gripper release lever 324. In FIG. 11A the gripper disc 326 is rotatably fixed in the gripper release lever 324*a*. The gripper release lever 324*a* is pivoted on pivot pin 343 such that movement of the wire pass 102*b* to the left as viewed in FIG. 11A will cause the disc 324 to frictionally engage the wire, causing the gripper release lever 324*a* to pivot counter clockwise about the pin pivot 343, pressing the disc 326 against the wire 102*b*. Here the wire becomes squeezed between the disc 326 and the opposite wall 333.

In FIG. 11B the disc 326 is eliminated and only the end of the gripper release lever 324*b* is formed to a curved point 326*b*. Here the gripper release lever 324*b* is also pivoted about the pivot pin 343 such that movement of the upper wire pass 102*b* to the left in FIG. 11B will cause the point 326*a* to frictionally engage the wire, and pivot the lever arm counter clockwise in FIG. 11B, squeezing the upper pass of wire 102*b* between the point and the opposite wall 333.

In the embodiment of FIGS. 11A and 11B no tapered gap is employed. The friction caused between the pivoting gripper lever arm and the opposite wall 333 is sufficient to positively lock the free end 108 (102*b*) of the wire against movement.

All of these embodiments uniquely accomplish gripping of the free end of the wire with a passive gripper that requires no separate powered solenoids or actuators. The gripper release lever is biased by spring 328 to normally pivot counter clockwise. The friction then between the wire, the wall, and the gripper disc provides the holding power.

Figure 12A:
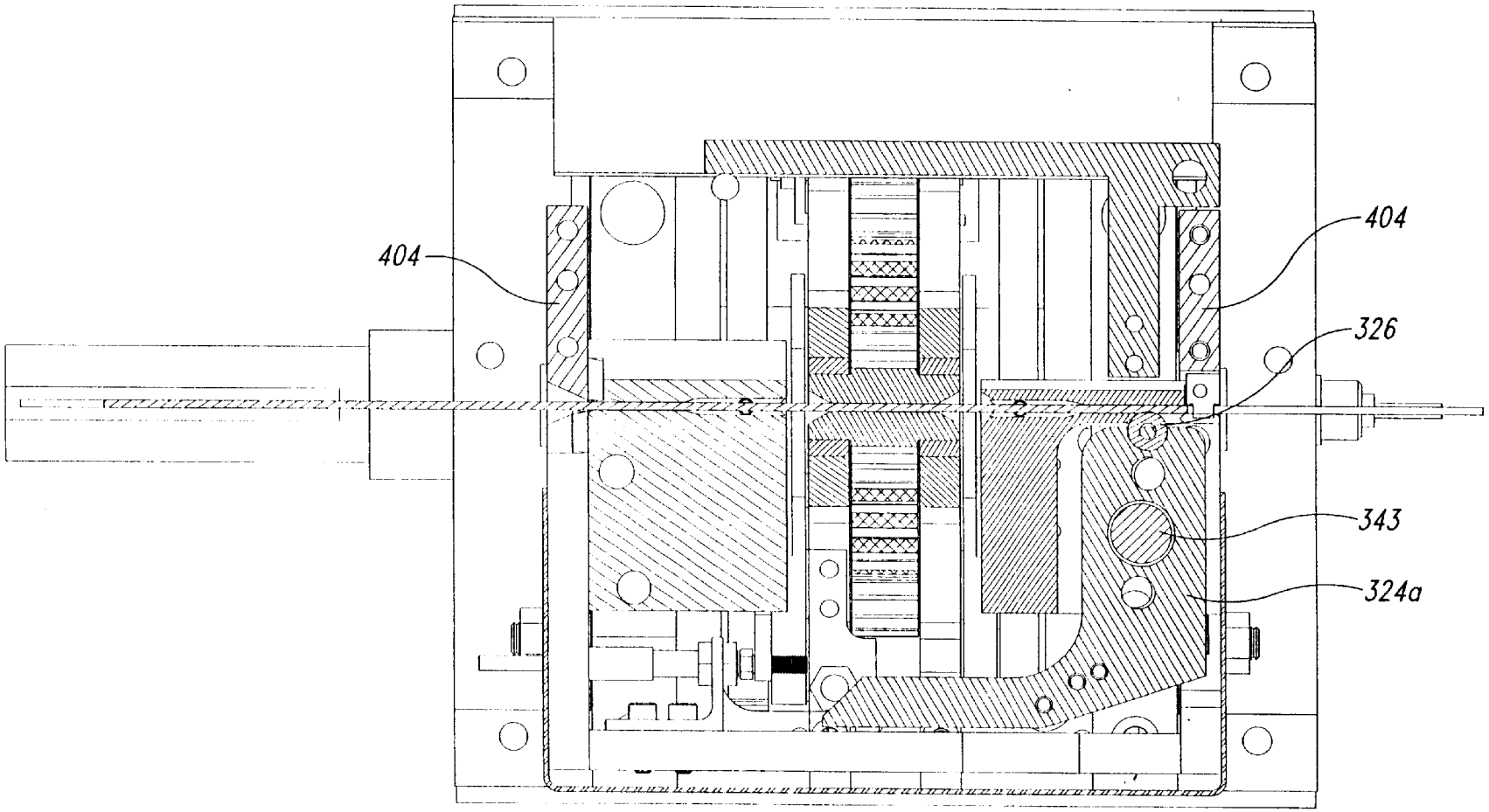
FIG. 12A is a cross-sectional view of the modified twister assembly of FIG. 9A.

After the wire loop 116 has been tensioned, and the knot 118 twisted and severed from the length of wire 102, the magnitude of the imparted force wedging the disc 326 into the narrow end of the tapered gap 325 is reduced and the direction with which the wire end 108 engages the gripper disc 326 is altered. This allows the wire end 108 to slip transversally up from between the disc 326 and the wall 333. To speed the release of the wire end 108 from the gripper subassembly 320, the cam block 335 is engaged by the gripper release cam follower 331 at the end of the twist cycle forcing the gripper release lever 324 to rotate in a clockwise direction, as viewed in FIGS. 12 and 12A, disengaging contact between the gripper disc 326 and the wire end 108. This also opens an unobstructed path for the wire to clear the gripper subassembly 320 at the time of wire ejection.

The twisting subassembly 330 twists a knot 118 in the wire 102 to close and secure the wire loop 116. The twisting is accomplished by rotating the slotted pinion 332. The twister motor 340 rotates the twister shaft 339, causing the drive gear 338 to rotate. The drive gear 338 in turn drives the driven gear 336. The two idler gears 334 are driven by the driven gear 336 and, in turn, drive the slotted pinion 332. The rotation of the slotted pinion 332 twists the first and second passages of wire 102*a,* 102*b* forming the knot 118 shown in FIG. 19.

At the completion of the twist cycle, the wire 102 is severed to release the formed loop 116. The motion of the multi-purpose cams 360, 361 against the cutter cam followers 359, 362 actuates the movable cutter carrier 352 (FIG. 13) relative to the stationary cutter carrier 356, causing the wire 102 to be sheared between the first and second cutters 354, 358. Preferably, the first and second cutters 354, 358 are replaceable inserts of the type commonly used in commercial milling and cutting machinery, although other types of cutters may be used.

The twister assembly 300 advantageously provides symmetrical loading on the pinion 332 by the two idler gears 334. This double drive arrangement produces less stress within the pinion 332, the strength of which is reduced by the slot. Also, the pinion 332 is slotted between gear teeth, which allows complete intermeshing with the idler gears 334. This configuration also results in less stress in the pinion 332. Generally, for heavy wire applications, such as for 11-gauge wire or heavier, an alternate pinion embodiment having a tooth removed may be used to provide clearance for the wire during ejection, as described below.

After the wire 102 has been cut, the tension in the wire 102 restrained by the gripping subassembly 320 is reduced. The rotation of the multi-purpose cams 360, 361 actuates the cutter cam followers 359–362, causing the head cover 308 and guide covers 309 to open. The rotation of the ejector cam 378 actuates the ejector cam follower 379, causing the front and rear ejectors 372, 374 to raise. The rotation of the multi-purpose cams 360–361 also causes the gripper cam follower 331 to engage the gripper release cam block 335, pivoting the gripper release lever 324 and forcing the gripper disc 326 away from the wire 102. This allows the free end 108 to freely escape from the twister assembly 300. The front and rear ejectors 372, 374 push the wire 102 and the knot 118 out of the pinion 332, lifting the wire loop 116 free from the twister assembly 300.

A modified form of twister assembly 300*a* is shown in FIGS. 9A, 10A, 12A and 13A. In this modified twister assembly a movable head cover 308*a* abuts a fixed hard cover. The moveable head cover is attached to a pair of rocker arms 327*a* and 352*a* that pivot on pins 800. A pair of cam followers 362*a* and 359*a* (FIG. 13A) pivot the rocker arms in response to head opening cams 360*a* and 361*a* mounted on the main twister shaft 339. This opens the movable head cover away from the fixed head cover to release the wire.

Thus, the twister assembly 300 advantageously performs the guiding, gripping, twisting, shearing, and ejecting functions in a relatively simple and efficient cam-actuated system. The simplicity of the above-described cam-actuated twister assembly 300 reduces the initial cost of the wire-tying machine 100, and the maintenance costs associated with the twister assembly 300.

Figure 20:
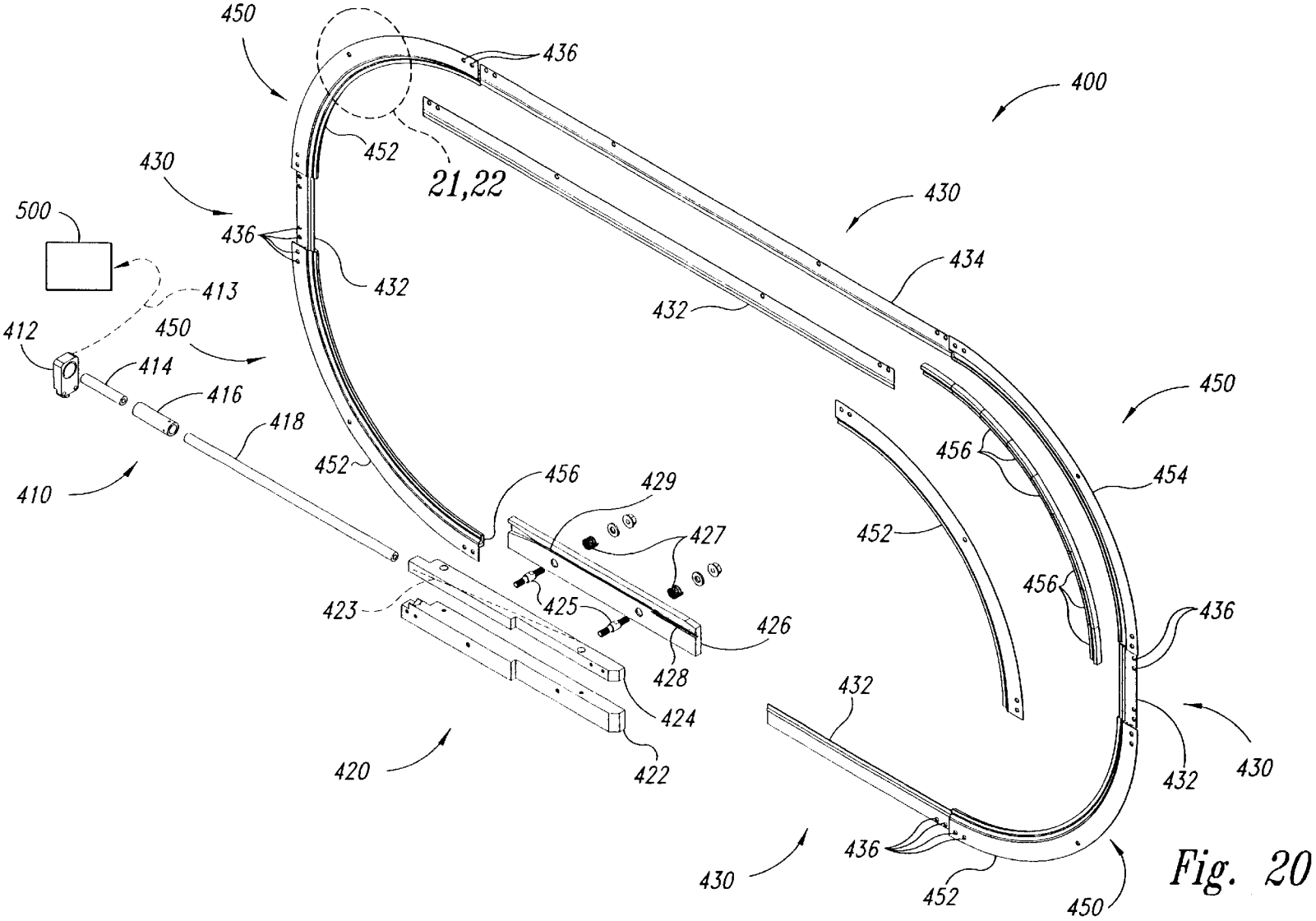
FIG. 20 is an exploded isometric view of a track assembly of the wire-tying machine of FIG. 1.
Figure 20A:
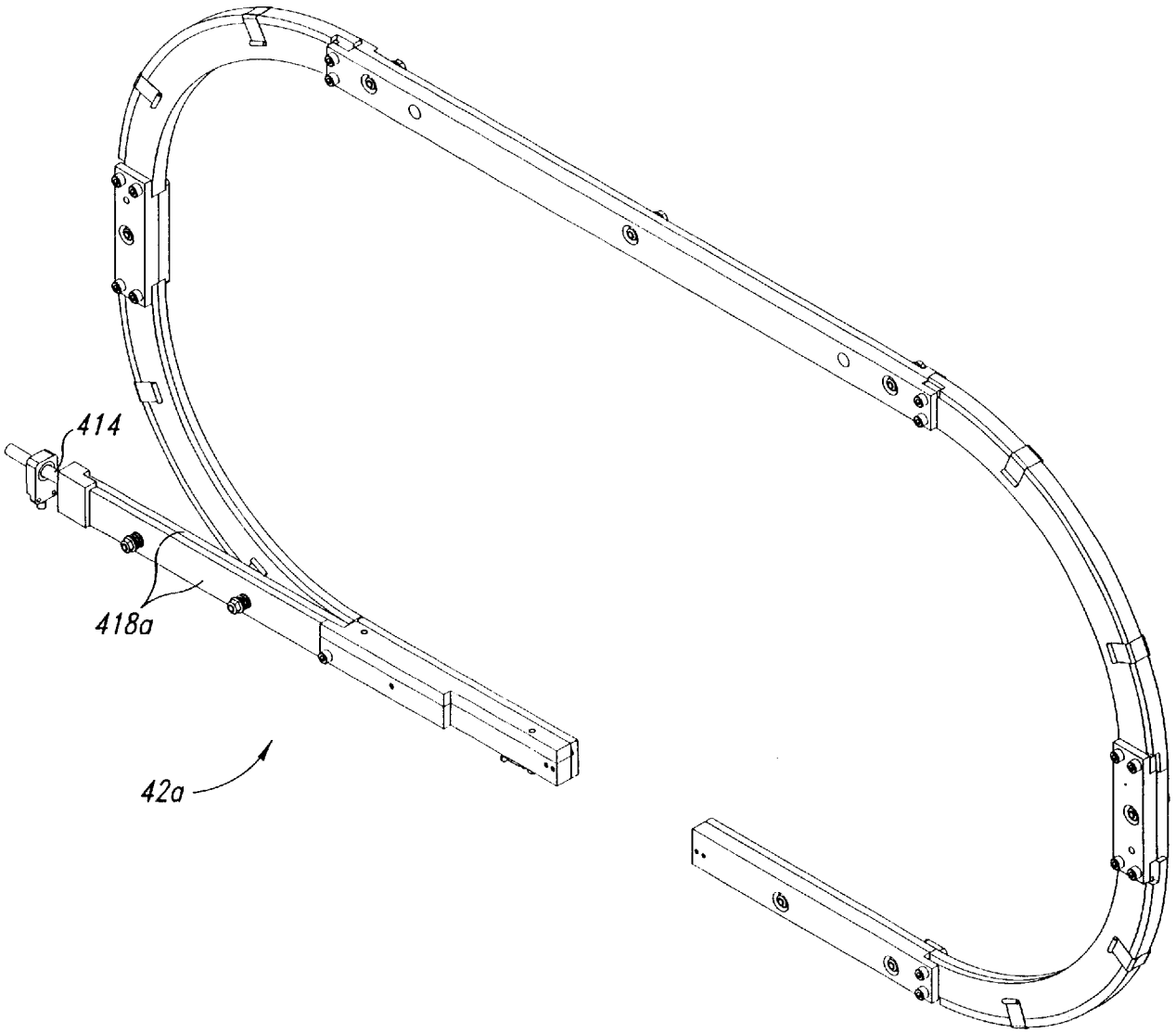
FIG. 20A is an isometric of a modified form of track entry sub-assembly 420*a*.

FIG. 20 is an exploded isometric view of the track assembly 400 of the wire-tying machine 100 of FIG. 1. As best seen in FIG. 20, the track assembly 400 includes a feed tube subassembly 410, a track entry subassembly 420, and alternating straight sections 430 and corner sections 450.

Referring to FIG. 20, the feed tube assembly 410 includes a ring sensor 412 coupled to a non-metallic tube 414. A feed tube coupling 416 couples a main feed tube 418 to the non-metallic tube 414. The main feed tube 418 is, in turn, coupled to the track entry subassembly 420.

The track entry subassembly 420 includes a track entry bottom 422 coupled to a track entry top 424 and a track entry back 426. A groove 423 is formed in a lower surface of the track entry top 424. The track entry back 426 is coupled to the track entry bottom and top 422, 424 by a pair of entry studs 425 and is held in compression against the track entry bottom and top 422, 424 by a pair of entry springs 427 installed over the entry studs 425. A first wire slot 428 and a second wire slot 429 are formed in the track entry back 426. The track entry subassembly 420 is coupled between the feed tube 418, a track corner 452, 456, and the twister assembly 300.

As shown in FIG. 20 the straight section 430 of the track is constructed to guide the wire but to release the wire when tension is applied to the wire.

Figure 21:
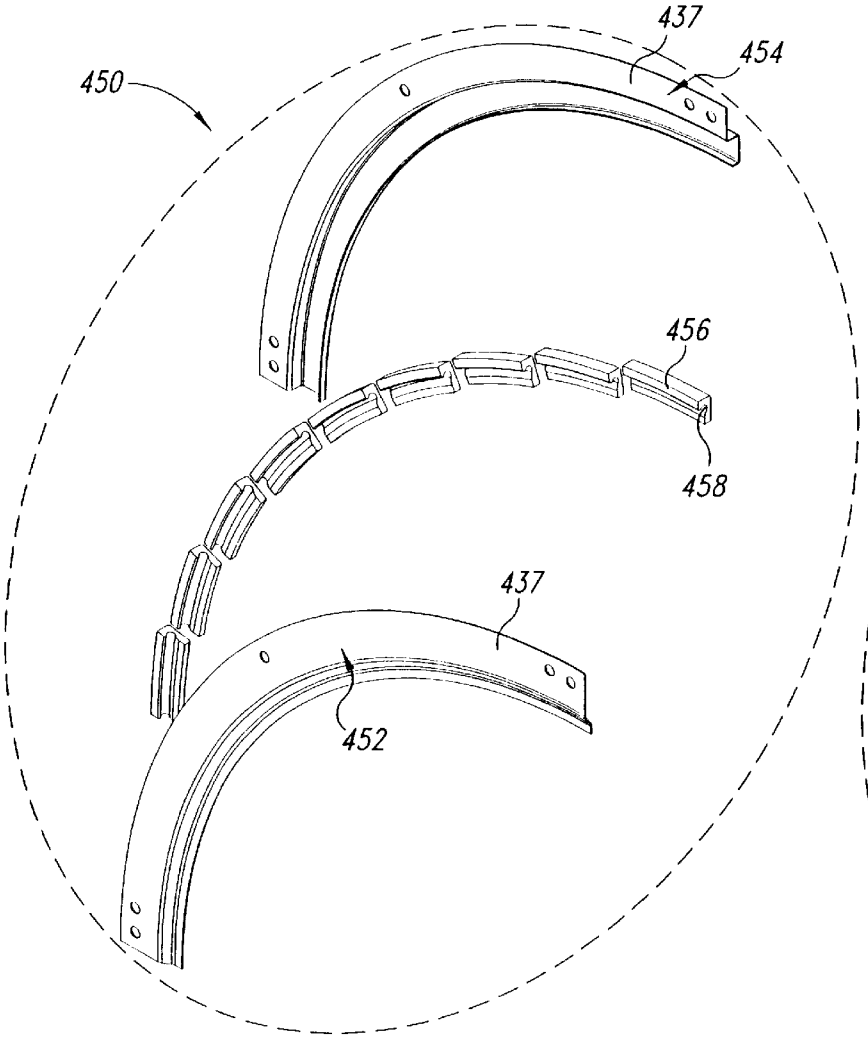
FIG. 21 is an enlarged schematic detail view of a corner section of the track assembly of FIG. 20 taken at detail reference numeral 21.

Referring to the detail of FIG. 21 each corner section 450 includes a corner front plate 452 and a corner back plate 454. The corner front and back plates 452, 454 are held together by fasteners 436 along their respective spine sections 437. A plurality of identical ceramic segments 456 are attached to each corner back plate 454 and are disposed between the corner front and back plates 452, 454. The ceramic sections 456 each include a rounded face 458 that partially surrounds the wire guide path 402.

During the feed cycle, the free end 108 of the length of wire 102 is fed by the feed and tension assembly 200 through the non-metallic tube 414 about which the ring sensor 412 is located. The ring sensor 412 detects the internal presence of the wire 102 and transmits a detection signal 413 to the control system 500. The free end 108 then passes through the feed tube coupling 416, the main feed tube 418 and into the track entry subassembly 420.

In the track entry subassembly 420, the free end 108 initially passes from the main feed tube 418 into the groove 423 cut into the track entry top 424, which is secured to the track entry bottom 422. The free end 108 passes through the groove 423 into and through the first wire slot 428 in the track entry back 426, through the twister assembly 300, and into the first straight section 430 of the track assembly 400.

An alternative form of track entry sub-assembly 420*a* substitutes conventional straight opening track sections 418*a* for the main feed tube 118. This opening track section allows for removal of excess wire from the accumulator drum by opening the twister head and then feeding the wire against the cutter. This causes the wire to bubble out of the track sections 418*a* while controlling both ends of the wire which are to be removed from the machine.

The straight sections 430 maintain the direction of the free end 108 along the wire guide path 402. The straight front and back plates 432, 434 are releasably held together along their respective spine sections 437. The structure allows the sections to separate in a manner to free the wire when tensioned.

From the straight section 430, the free end 108 is fed into the corner section 450. As the free end 108 enters the corner section 450, it obliquely strikes the rounded face 458 of the ceramic sections 456. The ceramic sections 456 change the direction of the free end 108 of the length of wire 102, while preferably imposing minimal friction. Preferably, the ceramic sections 456 are relatively impervious to gouging by the sharp, rapidly moving free end 108. The ceramic sections 456 may be fabricated from a variety of suitable, commercially-available materials, including, for example, pressure formed and fired A94 ceramic. It is understood that the plurality of ceramic sections 456 contained within each corner section 450 may be replaced with a single, large ceramic section.

As with the straight sections 430, the structure of the corner sections 450 provides for the containment of the wire 102 during the feed cycle by the natural elasticity of the corner front and back plates 452, 454, while allowing the wire 102 to escape from the corner section 450 during the tension cycle. Because the rounded face 458 only partially surrounds the wire guide path 402, the wire 102 may escape from between the corner front and back plates 452, 454 during tensioning.

It should be noted that the track assembly 400 need not have a plurality of alternating straight and corner sections 430, 450. The track assembly 400 having the alternating straight and corner sections 430, 450, however, affords a modular construction that may be easily modified to accommodate varying sizes of bundles.

Figure 22:
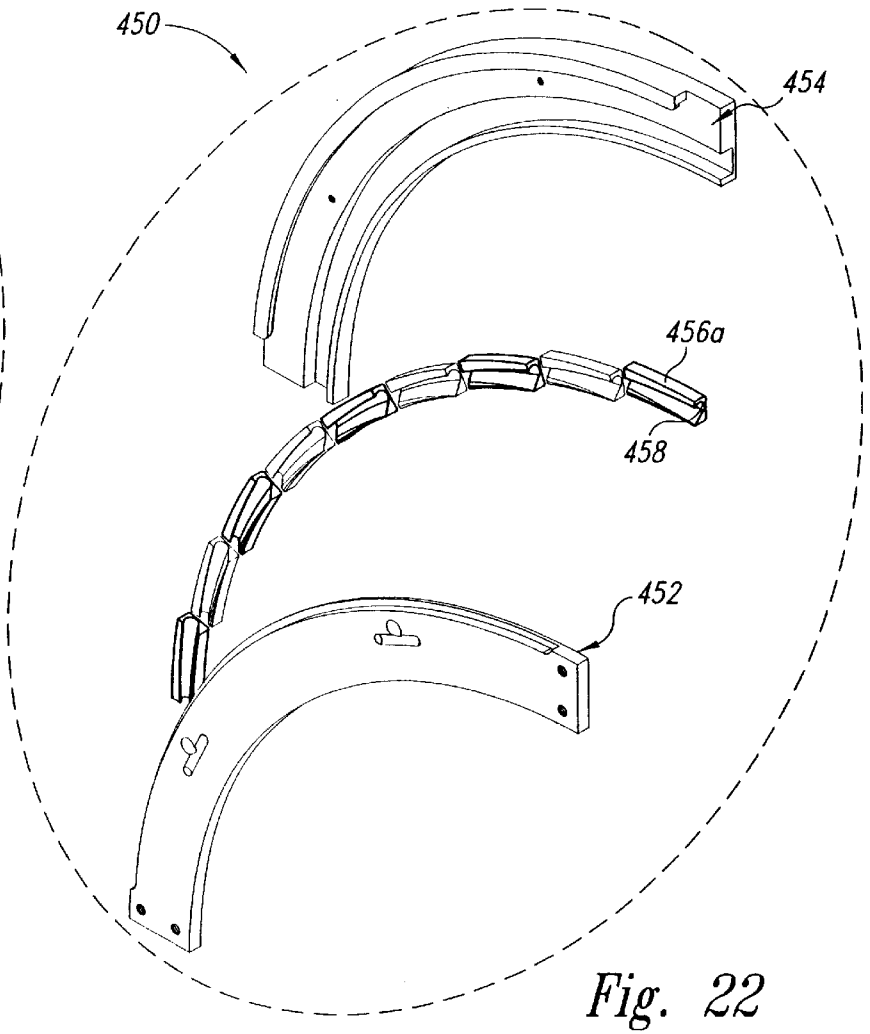
FIG. 22 is an enlarged schematic detail of a modified corner section of the track assembly of FIG. 20 taken also at detail reference numeral 22.

This means as a track is to be expanded to handle larger objects or bundles, new larger single piece corners need not be expensively manufactured. One piece corners of hard metal, for example, are expensive to manufacture. Whereas it is a unique feature of the corners of this invention that they are made of multiple identical segments. FIG. 21 shows ceramic segments and FIG. 22 shows hardened tool steel segments. When it is necessary to enlarge the corners, more segments, all of the same modular shapes, can be inserted into new larger radius corners.

FIG. 22 shows segments 456*a* as hardened tool steel with a rounded face 458*a*. These steel segments are also tapered from entry end to exit end into a funnel shape to guide the wire concentrically into the next abutting segment.

The free end 108 continues to be fed into and through alternating straight and corner sections 430, 450 until it is fed completely around the track assembly 400. The free end 108 then enters the track entry subassembly 420, passing into the second wire slot 429 in the track entry back 426. The free end 108 then reenters the twister assembly 300 and is held by the gripping subassembly 320 as described above. During the tension cycle, the track entry back 426 is disengaged from the track entry top 424 by compression of the entry springs 427 as the wire 102 is drawn upwardly between the track entry back and top 426, 424, releasing the second passage of the wire 102 from the track entry subassembly 420 and allowing the wire 102 to be drawn tightly about the one or more objects located in the bundling station 106. After the twister assembly 300 performs the twisting, cutting, and ejecting functions, the wire loop 116 is free of the track assembly 400.

Figure 23:
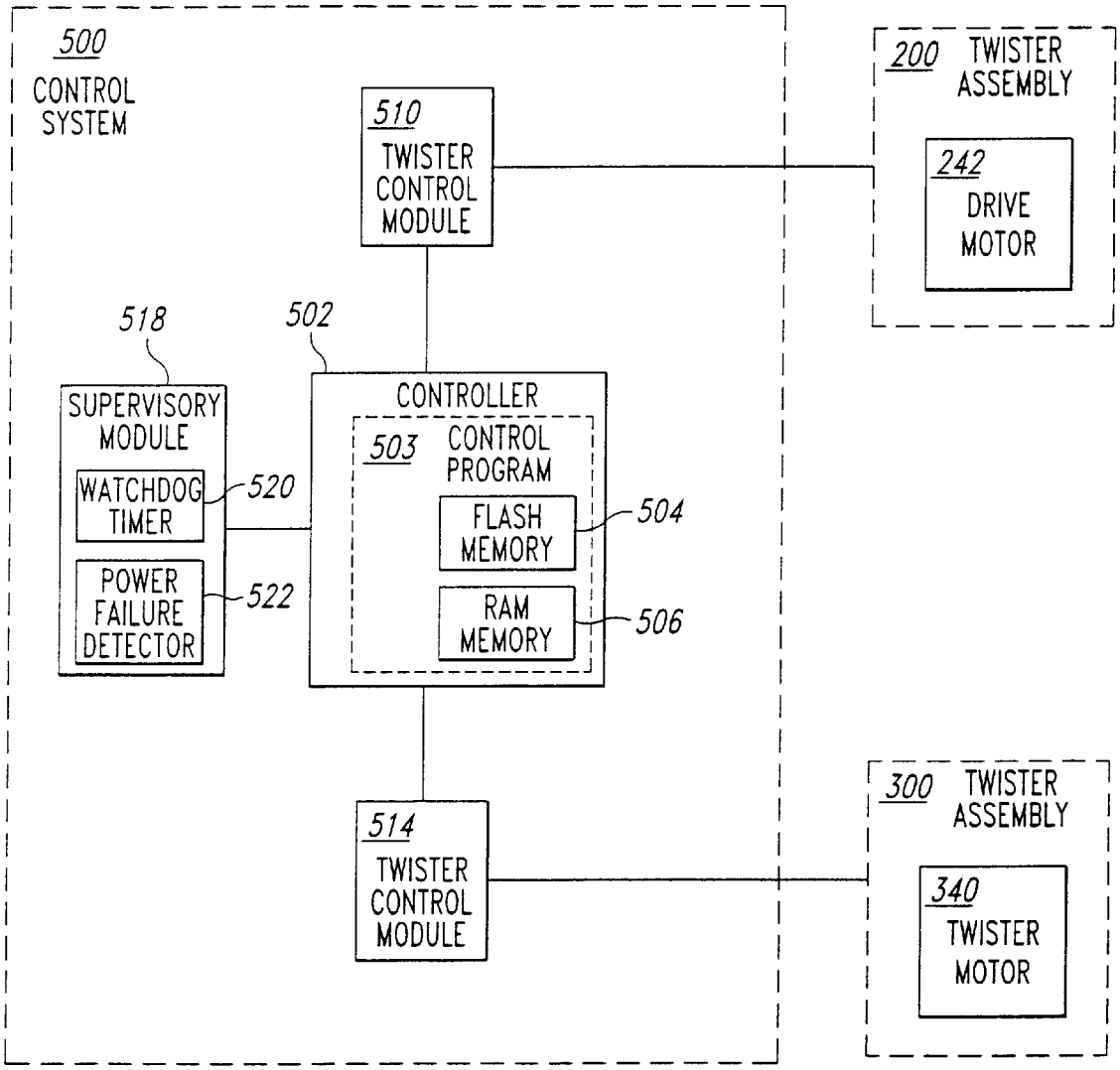
FIG. 23 is a schematic diagram of a control system of the wire-tying machine of FIG. 1.
Figure 24:
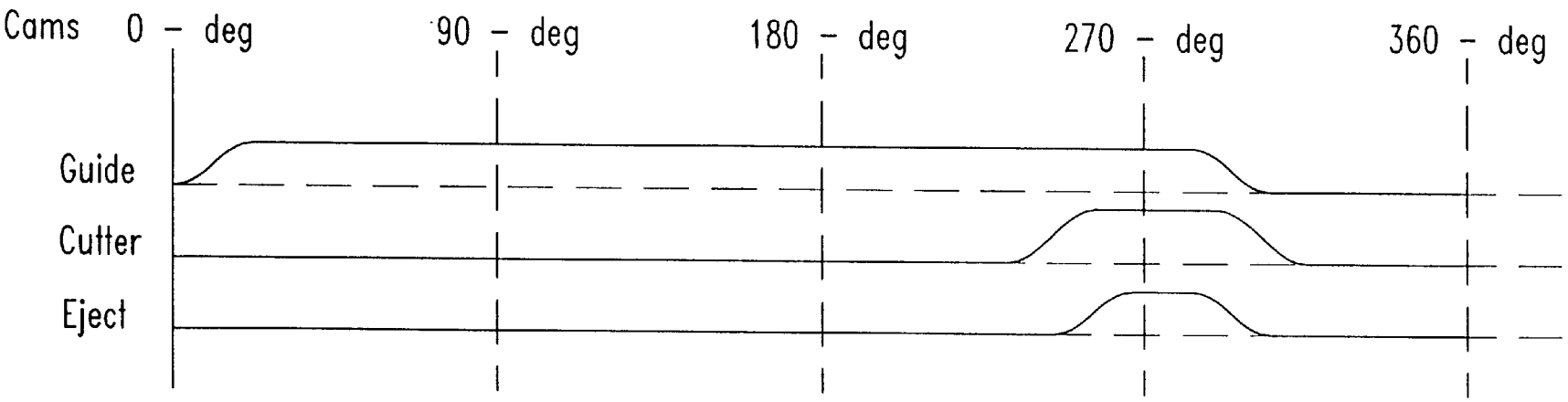
FIG. 24 is a graphical representation of a cam control timing diagram of the twister assembly of FIG. 9.
Figure 25:
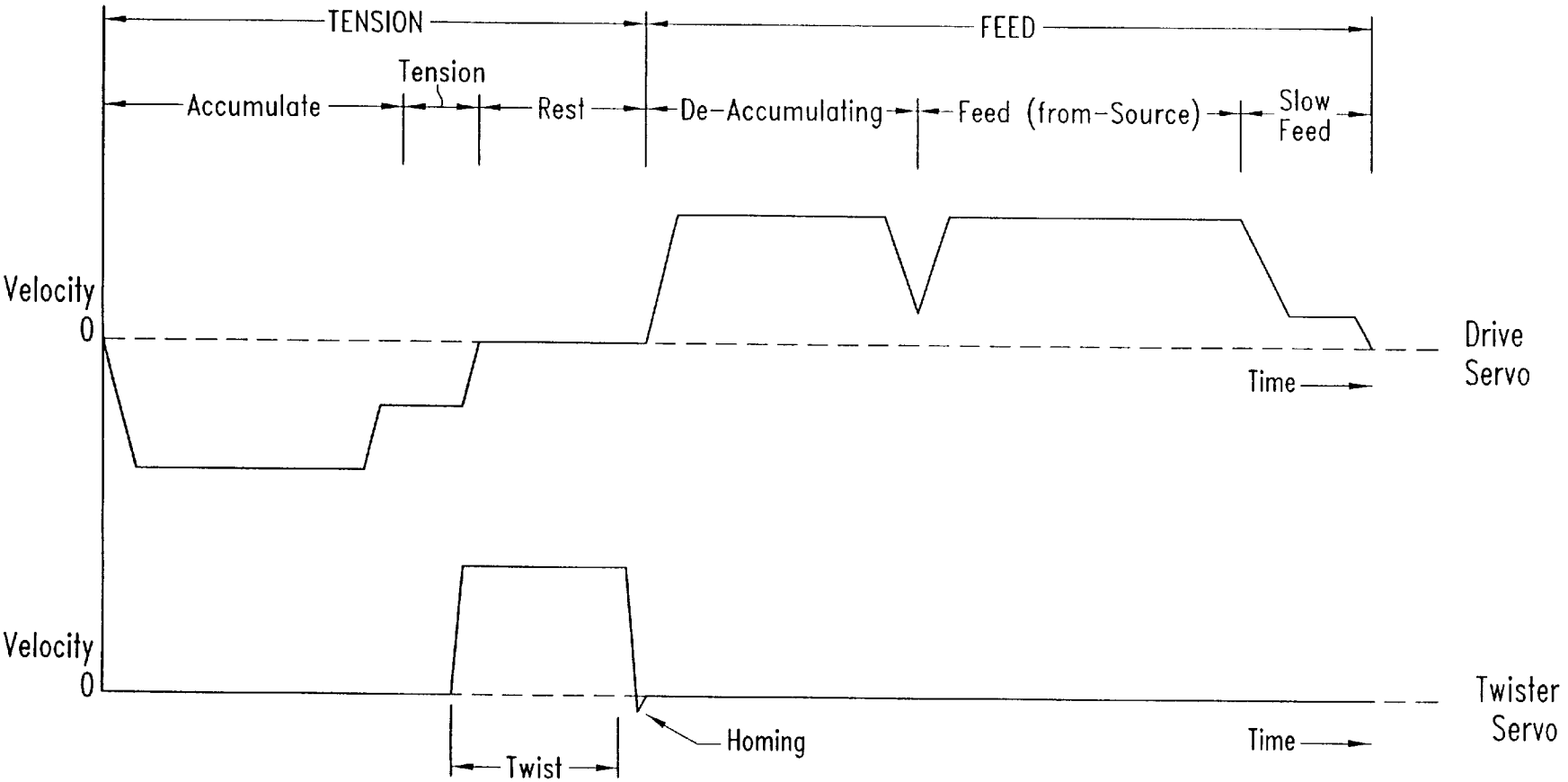
FIG. 25 is a graphical representation of a servo-motor control timing diagram of the twister assembly of FIG. 9.

As described above, all of the functions of the wire-tying machine 100 are activated through two motors: the drive motor 242 (FIG. 4), and the twister motor 340 (FIG. 9). The drive and twister motors 242, 340 are controlled by the control system 500. FIG. 23 is a schematic diagram of the control system 500 of the wire-tying machine 100 of FIG. 1. FIG. 24 is a graphical representation of a cam control timing diagram of the twister assembly 300 of FIG. 9. FIG. 25 is a graphical representation of a twister motor control timing diagram of the twister assembly 300 of FIG. 9.

Referring to FIG. 23, in this embodiment, the control system 500 includes a controller 502 having a control program 503 and being operatively coupled to a non-volatile flash memory 504, and also to a RAM memory 506. The RAM 506 may be re-programmed, allowing the control system 500 to be modified to meet the requirements of varying wire-tying applications without the need to change components. The non-volatile flash memory 504 stores various software routines and operating data that are not changed from application to application.

The controller 502 transmits control signals to the drive and twister control modules 510, 514, which in turn transmit control signals to the drive and twister assemblies 200, 300, particularly to the drive and twister motors 242, 340. A variety of commercially available processors may be used for the controller 502. For example, in one embodiment, the controller 502 is a model 80C196NP manufactured by Intel Corporation of Santa Clara, Calif.; and having features: a) 25 Mhz operation, b)1000 bytes of RAM register, c) register-register architecture, d) 32 I/O port pins, e) 16 prioritized interrupt sources, f) 4 external interrupt pins and NMI pins, g) 2 flexible 16-bit timer/counters with quadrature counting capability, h) 3 pulse-width modulator (PWM) outputs with high drive capability, i) full-duplex serial port with dedicated baud rate generator, j) peripheral transaction server (PTS), and k) an event processor array (EPA) with 4 high-speed capture/compare channels. Analog feedback signals may also be used, allowing the controller 502 to use a variety of analog sensors, such as photoelectric or ultrasonic measuring devices. The control program 503 determines, for example, the number of rotations, the acceleration rate, and the velocity of the motors 242, 340, and the controller 502 computes trapezoidal motion profiles and sends appropriate control signals to the drive and twister control modules 510, 514. In turn, the control modules 510, 514, provide the desired timing control signals to drive the twister assemblies 200, 300, as shown in FIGS. 24, 25.

A variety of commercially available processors may be used for controllers 510 and 514. For example, in one embodiment, the controllers 510, 514, are model LM628 manufactured by National Semiconductor Corporation of Santa Clara, Calif. The controller 502 may also receive motor position feedback signals from, for example, motor mounted encoders. The controller 502 may then compare positions of the drive motor 242 and the twister motor 340 with desired positions, and may update the control signals appropriately.

The controller 502, for example, may update the control signals at rate of 3000 times per second. Preferably, if the feedback signals are digital signals, the feedback signals are conditioned and optically isolated from the controller 502. Optical isolation limits voltage spikes and electrical noise which commonly occur in industrial environments. Analog feedback signals may also be used, allowing the controller 502 to use a variety of analog sensors, such as photoelectric or ultrasonic measuring devices.

The watchdog timer 520 of the supervisory module 518 interrupts the controller 502 if the controller 502 does not periodically poll the watchdog timer 520. The watchdog timer 520 will reset controller 502 if there is a program or controller failure. The power failure detector 522 detects a power failure and prompts the controller 502 to perform an orderly shutdown of the wire-tying machine 100.

The load cycle is used to thread (or re-thread) the length of wire 102 into the wire tying machine 100 from the wire supply 104. Typically, the load cycle is utilized when the wire supply 104 has been exhausted, or when a fold or break necessitates reinsertion of the wire 102 into the machine 100. Referring to FIG. 6, the feed solenoid 265 is actuated. The wire 102 is then manually fed into the wire tying machine 100 from the remote wire supply 104, through the wire inlet 225 (FIG. 3). The wire 102 is then manually forced through the hollow center of the accumulator axle 224, around the transverse guide wheel 234 (or through the curved roller axle tube 235) and around the tangent guide wheel 236. The wire 102 is forced into the pinch area between the tangent guide wheel 236 and tangent pinch roller 239.

At this point, the drive motor 242 having been actuated by the insertion of wire 102, turns the drive wheel 246 at slow speed in the feed direction 132. The wire 102 is deflected around the tangent guide wheel 236 and between the tangent guide wheel 236 and a drive wheel 246. The feed pawl 267 having been forced down by the feed solenoid 265 deflects the free end 108 of the wire 102 around the drive wheel 246. The load cycle is halted when the wire 102 is detected at the ring sensor 412, or by deactivation of the manual feed.

Initiation of the feed cycle engages the drive wheel 246 to feed the length of wire 102 through the twister assembly 300 and around the track assembly 400. The drive motor 242 rotates the drive shaft 248 and drive wheel 246 through the 90° gear box 244. The wire 102 is fed across the drive wheel 246 adjacent to the drive entry guide 260, under the drive pinch roller 249, and adjacent to the drive exit guide 262 where the exhaust pawl 266 is located. The wire 102 is then fed through the feed tube subassembly 410, through the twister assembly 300, around the track assembly 400, and back into the twister assembly 300 to be restrained by the gripping subassembly 320. The feed stop switch 337 detects the movement of the gripper disc 326 associated with the presence of the wire 102 and signals the location of the wire 102 to the control system 500 to complete the feed cycle.

Typically there will be some length of wire accumulated on the accumulator drum 222 from the previous tension cycle. As best shown in FIG. 25, this accumulation of wire will be payed off from the helical groove 229 of the accumulator drum 222 by the drive wheel 246, with a brief reduction of wire feed rate at the transition point until the accumulator drum 222 rotates into its stop position with the drive wheel 246 adjacent to the tangent guide wheel 236. The feed cycle then continues by drawing the wire 102 from the external wire supply 104 as indicated above. The feed rate ramps down to a slow feed rate as the free end 108 of the wire 102 approaches the twister assembly 300 on its second pass. The slow speed feed continues until the free end 108 energizes the feed stop switch 337 indicating the completion of the feed cycle. If the control system 500 detects that a sufficient length of wire 102 has been fed without triggering the feed stop switch 337 (i.e., a wire misfeed has occurred), the control system 500 halts operation and issues an appropriate error message, such as illuminating a warning light.

The tension cycle is initiated, either manually or by the control system 500, causing the drive motor 242 to rotate the drive wheel 246 in the tension direction 134, withdrawing the wire 102 partially from the track assembly 400. A shown in FIG. 25, the drive motor 242 ramps to high-speed in the tension (accumulate) direction 134. The number of rotations of the drive motor 242 may be counted for reference during the following feed cycle. The high-speed phase is terminated when a minimum loop size has been reached or when the drive motor 242 stalls. If the minimum loop size is encountered the machine will be directed to do one of two possible things depending upon desired machine operation. Either the control system 500 halts operation, or the machine continues as normal by initiation of the twist cycle, thus clearing the empty wire loop from the machine for continued operation.

Tension on the wire causes the gripper disc 326 to impinge upon the second passage of the wire 102*b,* passively increasing its gripping power with increased wire tension. The wire 102 is thus pulled from the wire guide path 402 and is drawn about the one or more objects within the bundling station 106.

Initially the drive wheel 246 is located adjacent to the tangent guide wheel 236. Because the tangent guide wheel 236 is mounted on a clutch 238 that operates freely in only one direction, the tangent guide wheel 236 is unable to rotate relative to the accumulator drum 222 into tension direction 134. The entire accumulator drum 222 rotates in response to the impetus from the drive wheel 246, smoothly laying the wire along the helical groove 229 in the accumulator drum 222. The accumulator drum 222 is forced to move laterally along its axis of rotation between the supports 230 by the wire laying into the groove as the wire proceeds along the helical groove 229.

Wire is wound around the accumulator drum 222 until the drive motor 242 stalls, at which time the drive motor 242 is given a halt command by the control system 500. The halt command causes the drive motor 242 to maintain its position at the time the command was given, thus maintaining tension in the wire 102. The control system 500 may record the amount of wire stored on the accumulator drum 222 by means of a signal from an encoder on the drive motor 242, which may be used during the subsequent feed cycle to determine a feed transition point, that is, a point at which feeding is transitioned from feeding wire stored on the accumulator drum 222 to feeding from the external wire supply 104.

The drive motor 242 maintains the tension in the wire 102 by maintaining its position at the time when the halt command was given by the control system 500. The drive motor stall also initiates the twist cycle in the automatic mode, as described below. After the wire 102 has been severed during the overlapping twist cycle, the tension in the wire 102 may cause the wire to retract a short distance after it is abruptly released. The tension cycle is terminated at the completion of the twist cycle (described below) and the drive motor 242 ceases operation until the start of the next feed cycle.

When the drive motor 242 stalls, the twist cycle is initiated. The head cover 308 opens to allow space for formation of the knot 118. The twister motor 340 applies torque to the twister shaft 339 through the gear reducer 342, rotating the drive gear 338 and ultimately the slotted pinion 332. The guide cam 316 engages the guide cam follower 318, opening the front and rear guide blocks 303, 304 to allow clearance for the knot 118 to be formed. The wire 102 is forced by the rotating pinion 332 to wrap about itself, typically between two and one-half and four times, creating the knot 118 which secures to be wire loop 116. As the twist cycle nears completion, the movable cutter carrier 352 is actuated to sever the wire 102, and the front and rear ejectors 372, 374 are raised, as the head opens, ejecting the wire loop 116 from the twister assembly 300.

As shown in FIG. 24, the total twist cycle is produced by one complete revolution of the twister shaft 339, which is typically a result of several revolutions of the twister motor 340 whose number varies depending upon the gear ratio used in the gear reducer 342. As the twister shaft 339 nears completion of a revolution, all elements of the twister assembly 300 are repositioned to their home positions, ready to reinitiate additional cycles. The home switch 377 detects the position of the ejector cam 378 and signals the control system 500 that a complete revolution has occurred. Upon receiving the signal from the home switch 377, the control system 500 reduces the speed of the twister motor 340 to slow, and a homing adjustment is made (FIG. 25).

The control system 500 may also halt the rotation of the twister motor 340 if an excessive number of rotations of the twister motor 340 is detected. If this occurs, the twister motor 340 is halted with enough clearance to allow the release of the wire 102 or wire loop 116. The control system 500 may then generate an appropriate error message to the operator, such as illuminating a warning lamp. If the twister motor 340 has not faulted, the control system makes a homing adjustment and the twister motor 340 is dormant until required for the next twist cycle.

The wire reject cycle is used to clear any accumulated wire in the event that all wire must be removed from the wire tying machine 100. The wire reject cycle typically operates in the manual mode. The wire reject cycle is initiated by to energizing the drive motor 242, rotating the drive wheel 246 at slow speed in the tension direction 134. Wire fed into the track assembly 400 and the twister assembly 300 is withdrawn and stored about the accumulator drum 222 until the free end 108 is inboard of the exhaust pawl 266. Then the exhaust solenoid 264 is energized to deflect the exhaust pawl 266, and a drive wheel 246 rotation is re-energized in the feed direction 132. The drive wheel 246 continues to run slowly in the feed direction 132 until the manual feed command is released and as long as the wire 102 remains in the machine 100. The wire 102 is exhausted slowly out of the machine 100 along the wire exhaust path 204 (FIG. 8) and onto the floor were it may be easily removed.

The control system 500 advantageously allows important control functions to be programmably controlled and varied. Conventional wire-tying machines utilized control systems which were designed to apply a particular force for a set period of time. The control system 500 of the wire-tying machine 100, however, permits the machine to adapt its performance and specifications to yet undefined requirements. Due to this flexibility, great cost savings may be realized as wire-tying requirements are varied from application to application.

Furthermore, in the case where the drive and twister motors 242, 340 are electric servo-motors, the wire tying machine 100 is fully electric without using hydraulic or pneumatic systems traditionally used in wire-tying apparatus. Elimination of hydraulics reduces the physical dimensions of the machine 100, eliminates the impact of hydraulic fluid spills and the need for hydraulic fluid storage, reduces maintenance requirements by eliminating hydraulic fluid filters and hoses, and reduces mechanical complexity. Also, because electric servo-motors are motion-based systems, as opposed to hydraulic systems that are forced or power-based systems, inherent flexibility in motion control is provided without the need for additional control mechanisms or feedback loops. Another advantage is that the power consumption of a servo-motor system is much less than that of a hydraulic system.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with prior art methods to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein of the invention can be applied to other methods and apparatus for wire-tying bundles of objects, and not just to the methods and apparatus for wire-tying bundles of objects described above and shown in the figures. In general, in the following claims, the terms used should not be construed to limit the invention to the specific embodiments disclosed in the specification. Accordingly, the invention is not limited by the foregoing disclosure, but instead its scope is to be determined by the following claims.

What is claimed is:

1. An apparatus for bundling one or more objects with a length of wire, comprising: a track assembly extending substantially about a bundling station sized to receive the one or more objects, the track assembly configured to receive the length of wire and guide the length of wire about the one or more objects, and to passively release the length of wire, wherein the track assembly included a front plate and a back plate together forming an enclosed, contoured channel region, the front and back plates being biasly attached by one or more fasteners, the one or more fasteners being positioned opposite the wire guide path from the bundling station, the front and back plates each having an obliquely angled surface for receiving the wire under tension such that the plates are separable by forces exerted by the wire on the contoured channel region; and a twister assembly having a gripping mechanism enagageable with the length of a wire, a twisting mechanism including a twisting motor operatively couple to a twist pinion engageable with the length of wire and a multipurpose cam, the twist pinion being rotatable to twist a portion of the length of wire to form a knot, a cutting mechanism engageable with the length of wire to disengage the length of wire from the twister assembly, wherein the gripping mechanism includes: a gripper block having a wire receptacle formed therein, an opposing wall positioned proximate the wire receptacle; a gripper member constrained to move and frictionally engageable with the length of wire disposed within the wire receptacle, the gripper member being driven frictional engagement with the length of wire and pinching the length of wire against said opposing wall when the drive motor is operated in the tension direction; and a gripper release engageable with said gripper member and actuatable by said multipurpose cam.

2. The apparatus of claim 1 wherein said gripper block includes a tapered gap formed in the gripper block proximate the wire receptacle and opposite from the opposing wall, said gripper member including a gripper disc, said gripper disc moving into said tapered gap to hold the wire.

3. The apparatus of claim 1, said gripper member having a gripper tapered end, said tapered end engaging the wire.

4. The apparatus of claim 1 wherein the wire receptacle comprises a slot sized to receive a first passage of wire in a lower portion thereof and a second passage of wire in an upper portion thereof, the gripper member being frictionally engageable with the second passage of wire.

5. The apparatus of claim 1 wherein the twister assembly includes a multi-purpose cam rotatably driven by the twister motor, and the cutting mechanism includes a cutter cam follower coupled to a moveable cutter and engageable with the multi-purpose cam, the rotation of the multi-purpose cam actuating the moveable cutter into engagement with the length of wire.

6. The apparatus of claim 1 wherein the twister assembly includes an ejector cam rotatably driven by the twister motor, and the ejecting mechanism includes an ejector cam follower coupled to a moveable ejector and engageable with the ejector cam, the rotation of the ejector cam actuating the moveable ejector into engagement with the length of wire.

7. The apparatus of claim 1 wherein the twisting mechanism includes a drive gear rotatably driven by the twister motor, a driven gear rotatably engageable with the drive gear, a pair of idler gears rotatably engageable with the driven gear and symmetrically engageable with the twist pinion, the rotation of the drive gear actuating the twist pinion to form the knot.

8. The apparatus of claim 1, further comprising a feed and tension assembly having a drive motor rotatably coupled to a drive roller, the drive roller being rotatable in a feed direction to feed the length of wire into the track assembly, and being rotatable in a tension direction to pull the length of wire tightly about the one or more objects.

9. The apparatus of claim 6 wherein the track assembly further includes at least one corner section formed from multiple modular segments disposed between the front and back plates, the modular segments having a curved face at least partially surrounding the wire guide path.

10. The apparatus of claim 1, further comprising a control system operatively coupled to the drive motor and the twister motor and including a controller coupled to a programmable memory and a control program, the controller transmitting a programmably-adjustable drive control signal to the drive motor and a programmably-adjustable twist control signal to the twister motor.

11. The apparatus of claim 1 wherein the track assembly has corners formed from a plurality of multiple modular segments, wherein enlargement of the corners of the track can be made by adding segments.

12. The apparatus of claim 11 wherein the segments are ceramic.

13. The apparatus of claim 11 wherein the segments are hard metal and each segment has a funnel shape to guide the wire into the next segment.

14. The apparatus of claim 1 wherein:

the twist motor is coupled to a single rotatable twist axle having a first multi-purpose cam, an ejector cam, a drive gear, and a second multi-purpose cam attached thereto;

the gripping mechanism has a gripper cam follower engageable with the second multi-purpose cam, the gripping mechanism being actuatable by the second multi-purpose cam;

the twisting mechanism has a twist pinion engageable with the length of wire, the twist pinion being actuatable by the drive gear;

the cutting mechanism has a cutting cam follower engageable with the first multi-purpose cam, the cutting mechanism being actuatable by the first multi-purpose cam;

the ejecting mechanism has an ejecting cam follower engageable with the ejector cam, the ejecting mechanism being actuatable by the ejector cam; and wherein all of the actuators are controlled from said single rotatable twist axle.

15. The apparatus of claim 14 wherein the twister assembly further includes a guiding mechanism engageable with the length of wire along a wire feed path through the twister assembly and having a guide cam follower engageable with the second multi-purpose cam, the guiding mechanism being actuatable by the second multi-purpose cam.

16. The apparatus of claim 14 wherein the gripping mechanism includes:

a gripper block having a wire receptacle formed therein, an opposing wall positioned proximate the wire receptacle; and a gripper release lever constrained to move toward the opposing wall and frictionally engageable with the length of wire disposed within the wire receptacle, the gripper release lever being driven by frictional engagement with the length of wire and pinching the length of wire against the opposing wall when the drive motor is operated in the tension direction.

* * * * *

UNITED STATES PATENT AND TRADEMARK OFFICE

CERTIFICATE OF CORRECTION

PATENT NO. : 6,584,891 B1
DATED : July 1, 2003
INVENTOR(S) : Donald Smith et al.

It is certified that error appears in the above-identified patent and that said Letters Patent is hereby corrected as shown below:

Title page,
Item [56], FOREIGN PATENT DOCUMENTS, the following should be listed:

-- GB 1 124 366 A 8/1968 --.

Signed and Sealed this

Sixteenth Day of March, 2004

JON W. DUDAS
*Acting Director of the United States Patent and Trademark Office*